US009127538B2

(12) United States Patent
Lin et al.

(10) Patent No.: US 9,127,538 B2
(45) Date of Patent: Sep. 8, 2015

(54) METHODOLOGIES FOR TREATMENT OF HYDROCARBON FORMATIONS USING STAGED PYROLYZATION

(75) Inventors: Ming Lin, Katy, TX (US); John Michael Karanikas, Houston, TX (US)

(73) Assignee: Shell Oil Company, Houston, TX (US)

( * ) Notice: Subject to any disclaimer, the term of this patent is extended or adjusted under 35 U.S.C. 154(b) by 475 days.

(21) Appl. No.: 13/083,257

(22) Filed: Apr. 8, 2011

(65) Prior Publication Data

US 2011/0247809 A1 Oct. 13, 2011

Related U.S. Application Data

(60) Provisional application No. 61/322,647, filed on Apr. 9, 2010, provisional application No. 61/322,513, filed on Apr. 9, 2010.

(51) Int. Cl.
*E21B 43/24* (2006.01)

(52) U.S. Cl.
CPC ..... *E21B 43/24* (2013.01)

(58) Field of Classification Search
None
See application file for complete search history.

(56) References Cited

U.S. PATENT DOCUMENTS

| | | | |
|---|---|---|---|
| 48,994 | A | 7/1865 | Parry |
| 94,813 | A | 9/1885 | Dickey |
| 326,439 | A | 9/1885 | McEachen |
| 345,586 | A | 7/1886 | Hall |
| 760,304 | A | 5/1904 | Butler |
| 1,269,747 | A | 6/1918 | Rogers |
| 1,342,741 | A | 6/1920 | Day |
| 1,457,479 | A | 6/1923 | Wolcott |
| 1,510,655 | A | 6/1924 | Clark |
| 1,634,236 | A | 6/1927 | Ranney |
| 1,646,599 | A | 10/1927 | Schaefer |
| 1,660,818 | A | 2/1928 | Ranney |
| 1,666,488 | A | 4/1928 | Crawshaw |
| 1,681,523 | A | 8/1928 | Downey et. al. |
| 1,811,560 | A | 6/1931 | Ranney |

(Continued)

FOREIGN PATENT DOCUMENTS

| | | |
|---|---|---|
| CA | 899987 | 5/1972 |
| CA | 1168283 | 5/1984 |

(Continued)

OTHER PUBLICATIONS

Reaction Kinetics Between CO2 and Oil Shale Residual Carbon. I. Effect of Heating Rate on Reactivity, Alan K. Burnham, Jul. 11, 1978 (22 pages).

(Continued)

*Primary Examiner* — Doug Hutton, Jr.
*Assistant Examiner* — Anuradha Ahuja

(57) ABSTRACT

Methods for treating a subsurface formation are described herein. Some methods include providing heat from a plurality of heaters to a section of the hydrocarbon containing formation; controlling the heat from the plurality of heaters such that an average temperature in at least a majority of a first portion of the section is above a pyrolyzation temperature; providing heat from the plurality of heaters to a second portion substantially above the first portion of the section after heating the first portion for a selected time; controlling the heat from the plurality of heaters such that an average temperature in the second portion is sufficient to allow the second portion to expand into the first portion; and producing hydrocarbons from the formation.

22 Claims, 14 Drawing Sheets

(56) References Cited

U.S. PATENT DOCUMENTS

| | | | |
|---|---|---|---|
| 1,913,395 | A | 6/1933 | Karrick |
| 2,244,255 | A | 6/1941 | Looman |
| 2,244,256 | A | 6/1941 | Looman |
| 2,288,857 | A | 7/1942 | Subkow |
| 2,319,702 | A | 5/1943 | Moon |
| 2,365,591 | A | 12/1944 | Ranney |
| 2,381,256 | A | 8/1945 | Callaway |
| 2,390,770 | A | 12/1945 | Barton et al. |
| 2,423,674 | A | 7/1947 | Agren |
| 2,444,755 | A | 7/1948 | Steffen |
| 2,466,945 | A | 4/1949 | Greene |
| 2,472,445 | A | 6/1949 | Sprong |
| 2,481,051 | A | 9/1949 | Uren |
| 2,484,063 | A | 10/1949 | Ackley |
| 2,497,868 | A | 2/1951 | Dalin |
| 2,548,360 | A | 4/1951 | Germain |
| 2,593,477 | A | 4/1952 | Newman et al. |
| 2,595,979 | A | 5/1952 | Pevere et al. |
| 2,623,596 | A | 12/1952 | Whorton et al. |
| 2,630,306 | A | 3/1953 | Evans |
| 2,630,307 | A | 3/1953 | Martin |
| 2,634,961 | A | 4/1953 | Ljungstrom |
| 2,642,943 | A | 6/1953 | Smith et al. |
| 2,670,802 | A | 3/1954 | Ackley |
| 2,685,930 | A | 8/1954 | Albaugh |
| 2,695,163 | A | 11/1954 | Pearce et al. |
| 2,703,621 | A | 3/1955 | Ford |
| 2,714,930 | A | 8/1955 | Carpenter |
| 2,732,195 | A | 1/1956 | Ljungstrom |
| 2,734,579 | A | 2/1956 | Elkins |
| 2,743,906 | A | 5/1956 | Coyle |
| 2,757,739 | A | 8/1956 | Douglas et al. |
| 2,759,877 | A | 8/1956 | Eron |
| 2,761,663 | A | 9/1956 | Gerdetz |
| 2,771,954 | A | 11/1956 | Jenks et al. |
| 2,777,679 | A | 1/1957 | Ljungstrom |
| 2,780,449 | A | 2/1957 | Fisher et al. |
| 2,780,450 | A | 2/1957 | Ljungstrom |
| 2,786,660 | A | 3/1957 | Alleman |
| 2,789,805 | A | 4/1957 | Ljungstrom |
| 2,793,696 | A | 5/1957 | Morse |
| 2,794,504 | A | 6/1957 | Carpenter |
| 2,799,341 | A | 7/1957 | Maly |
| 2,801,089 | A | 7/1957 | Scott, Jr. |
| 2,803,305 | A | 8/1957 | Behning et al. |
| 2,804,149 | A | 8/1957 | Kile |
| 2,819,761 | A | 1/1958 | Popham et al. |
| 2,825,408 | A | 3/1958 | Watson |
| 2,841,375 | A | 7/1958 | Salomonsson |
| 2,857,002 | A | 10/1958 | Pevere et al. |
| 2,647,306 | A | 12/1958 | Stewart et al. |
| 2,862,558 | A | 12/1958 | Dixon |
| 2,889,882 | A | 6/1959 | Schleicher |
| 2,890,754 | A | 6/1959 | Hoffstrom et al. |
| 2,890,755 | A | 6/1959 | Eurenius et al. |
| 2,902,270 | A | 9/1959 | Salomonsson et al. |
| 2,906,337 | A | 9/1959 | Henning |
| 2,906,340 | A | 9/1959 | Herzog |
| 2,914,309 | A | 11/1959 | Salomonsson |
| 2,923,535 | A | 2/1960 | Ljungstrom |
| 2,932,352 | A | 4/1960 | Stegemeier |
| 2,939,689 | A | 6/1960 | Ljungstrom |
| 2,942,223 | A | 6/1960 | Lennox et al. |
| 2,954,826 | A | 10/1960 | Sievers |
| 2,958,519 | A | 11/1960 | Hurley |
| 2,969,226 | A | 1/1961 | Huntington |
| 2,970,826 | A | 2/1961 | Woodruff |
| 2,974,937 | A | 3/1961 | Kiel |
| 2,991,046 | A | 7/1961 | Yahn |
| 2,994,376 | A | 8/1961 | Crawford et al. |
| 2,997,105 | A | 8/1961 | Campion et al. |
| 2,998,457 | A | 8/1961 | Paulsen |
| 3,004,601 | A | 10/1961 | Bodine |
| 3,004,603 | A | 10/1961 | Rogers et al. |
| 3,007,521 | A | 11/1961 | Trantham et al. |
| 3,010,513 | A | 11/1961 | Gerner |
| 3,010,516 | A | 11/1961 | Schleicher |
| 3,016,053 | A | 1/1962 | Medovick |
| 3,017,168 | A | 1/1962 | Carr |
| 3,026,940 | A | 3/1962 | Spitz |
| 3,032,102 | A | 5/1962 | Parker |
| 3,036,632 | A | 5/1962 | Koch et al. |
| 3,044,545 | A | 7/1962 | Tooke |
| 3,048,221 | A | 8/1962 | Tek |
| 3,050,123 | A | 8/1962 | Scott |
| 3,051,235 | A | 8/1962 | Banks |
| 3,057,404 | A | 10/1962 | Berstrom |
| 3,061,009 | A | 10/1962 | Shirley |
| 3,062,282 | A | 11/1962 | Schleicher |
| 3,095,031 | A | 6/1963 | Eurenius et al. |
| 3,097,690 | A | 7/1963 | Terwilliger et al. |
| 3,105,545 | A | 10/1963 | Prats et al. |
| 3,106,244 | A | 10/1963 | Parker |
| 3,110,345 | A | 11/1963 | Reed et al. |
| 3,113,619 | A | 12/1963 | Reichle |
| 3,113,620 | A | 12/1963 | Hemminger |
| 3,113,623 | A | 12/1963 | Krueger |
| 3,114,417 | A | 12/1963 | McCarthy |
| 3,116,792 | A | 1/1964 | Purre |
| 3,120,264 | A | 2/1964 | Barron |
| 3,127,935 | A | 4/1964 | Poettmann et al. |
| 3,127,936 | A | 4/1964 | Eurenius |
| 3,131,763 | A | 5/1964 | Kunetka et al. |
| 3,132,692 | A | 5/1964 | Marx et al. |
| 3,137,347 | A | 6/1964 | Parker |
| 3,138,203 | A | 6/1964 | Weiss et al. |
| 3,139,928 | A | 7/1964 | Broussard |
| 3,142,336 | A | 7/1964 | Doscher |
| 3,149,670 | A | 9/1964 | Grant |
| 3,149,672 | A | 9/1964 | Orkiszewski |
| 3,150,715 | A | 9/1964 | Dietz |
| 3,163,745 | A | 12/1964 | Boston |
| 3,164,207 | A | 1/1965 | Thessen et al. |
| 3,165,154 | A | 1/1965 | Santourian |
| 3,170,842 | A | 2/1965 | Kehler |
| 3,181,613 | A | 5/1965 | Krueger |
| 3,182,721 | A | 5/1965 | Hardy |
| 3,183,675 | A | 5/1965 | Schroeder |
| 3,191,679 | A | 6/1965 | Miller |
| 3,205,942 | A | 9/1965 | Sandberg |
| 3,205,944 | A | 9/1965 | Walton |
| 3,205,946 | A | 9/1965 | Prats et al. |
| 3,207,220 | A | 9/1965 | Williams |
| 3,208,531 | A | 9/1965 | Tamplen |
| 3,209,825 | A | 10/1965 | Alexander et al. |
| 3,221,505 | A | 12/1965 | Goodwin et al. |
| 3,221,811 | A | 12/1965 | Prats |
| 3,233,668 | A | 2/1966 | Hamilton et al. |
| 3,237,689 | A | 3/1966 | Justheim |
| 3,241,611 | A | 3/1966 | Dougan |
| 3,246,695 | A | 4/1966 | Robinson |
| 3,250,327 | A | 5/1966 | Crider |
| 3,267,680 | A | 8/1966 | Schlumberger |
| 3,272,261 | A | 9/1966 | Morse |
| 3,273,640 | A | 9/1966 | Huntington |
| 3,275,076 | A | 9/1966 | Sharp |
| 3,284,281 | A | 11/1966 | Thomas |
| 3,285,335 | A | 11/1966 | Reistle, Jr. |
| 3,288,648 | A | 11/1966 | Jones |
| 3,294,167 | A | 12/1966 | Vogel |
| 3,302,707 | A | 2/1967 | Slusser |
| 3,303,883 | A | 2/1967 | Slusser |
| 3,310,109 | A | 3/1967 | Marx et al. |
| 3,316,344 | A | 4/1967 | Kidd et al. |
| 3,316,962 | A | 5/1967 | Lange |
| 3,332,480 | A | 7/1967 | Parrish |
| 3,338,306 | A | 8/1967 | Cook |
| 3,342,258 | A | 9/1967 | Prats |
| 3,342,267 | A | 9/1967 | Cotter et al. |
| 3,346,044 | A | 10/1967 | Slusser |
| 3,349,845 | A | 10/1967 | Holbert et al. |
| 3,352,355 | A | 11/1967 | Putman |
| 3,354,654 | A | 11/1967 | Vignovich |
| 3,358,756 | A | 12/1967 | Vogel |

(56) References Cited

U.S. PATENT DOCUMENTS

| | | | |
|---|---|---|---|
| 3,362,751 | A | 1/1968 | Tinlin |
| 3,372,754 | A | 3/1968 | McDonald |
| 3,379,248 | A | 4/1968 | Strange |
| 3,380,913 | A | 4/1968 | Henderson |
| 3,386,508 | A | 6/1968 | Bielstein et al. |
| 3,389,975 | A | 6/1968 | Van Nostrand |
| 3,399,623 | A | 9/1968 | Creed |
| 3,410,796 | A | 11/1968 | Hull |
| 3,410,977 | A | 11/1968 | Ando |
| 3,412,011 | A | 11/1968 | Lindsay |
| 3,434,541 | A | 3/1969 | Cook et al. |
| 3,455,383 | A | 7/1969 | Prats et al. |
| 3,465,819 | A | 9/1969 | Dixon |
| 3,474,863 | A | 10/1969 | Deans et al. |
| 3,477,058 | A | 11/1969 | Vedder et al. |
| 3,480,082 | A | 11/1969 | Gilliland |
| 3,485,300 | A | 12/1969 | Engle |
| 3,492,463 | A | 1/1970 | Wringer et al. |
| 3,501,201 | A | 3/1970 | Closmann et al. |
| 3,502,372 | A | 3/1970 | Prats |
| 3,513,913 | A | 5/1970 | Bruist |
| 3,515,213 | A | 6/1970 | Prats |
| 3,515,837 | A | 6/1970 | Ando |
| 3,526,095 | A | 9/1970 | Peck |
| 3,528,501 | A | 9/1970 | Parker |
| 3,529,682 | A | 9/1970 | Coyne et al. |
| 3,537,528 | A | 11/1970 | Herce et al. |
| 3,542,131 | A | 11/1970 | Walton et al. |
| 3,547,192 | A | 12/1970 | Claridge et al. |
| 3,547,193 | A | 12/1970 | Gill |
| 3,554,285 | A | 1/1971 | Meldau |
| 3,562,401 | A | 2/1971 | Long |
| 3,565,171 | A | 2/1971 | Closmann |
| 3,578,080 | A | 5/1971 | Closmann |
| 3,580,987 | A | 5/1971 | Priaroggia |
| 3,593,789 | A | 7/1971 | Prats |
| 3,595,082 | A | 7/1971 | Miller et al. |
| 3,599,714 | A | 8/1971 | Messman et al. |
| 3,605,890 | A | 9/1971 | Holm |
| 3,614,986 | A | 10/1971 | Gill |
| 3,617,471 | A | 11/1971 | Schlinger et al. |
| 3,618,663 | A | 11/1971 | Needham |
| 3,629,551 | A | 12/1971 | Ando |
| 3,661,423 | A | 5/1972 | Garret |
| 3,675,715 | A | 7/1972 | Speller, Jr. |
| 3,679,812 | A | 7/1972 | Owens |
| 3,680,633 | A | 8/1972 | Bennett |
| 3,700,280 | A | 10/1972 | Papadopoulos et al. |
| 3,757,860 | A | 9/1973 | Pritchett |
| 3,759,328 | A | 9/1973 | Ueber et al. |
| 3,759,574 | A | 9/1973 | Beard |
| 3,761,599 | A | 9/1973 | Beatty |
| 3,766,982 | A | 10/1973 | Justheim |
| 3,770,398 | A | 11/1973 | Abraham et al. |
| 3,779,602 | A | 12/1973 | Beard et al. |
| 3,794,113 | A | 2/1974 | Strange et al. |
| 3,794,116 | A | 2/1974 | Higgins |
| 3,804,169 | A | 4/1974 | Closmann |
| 3,804,172 | A | 4/1974 | Closmann et al. |
| 3,809,159 | A | 5/1974 | Young et al. |
| 3,812,913 | A | 5/1974 | Hardy et al. |
| 3,853,185 | A | 12/1974 | Dahl et al. |
| 3,881,551 | A | 5/1975 | Terry et al. |
| 3,882,941 | A | 5/1975 | Pelofsky |
| 3,892,270 | A | 7/1975 | Lindquist |
| 3,893,918 | A | 7/1975 | Favret, Jr. |
| 3,894,769 | A | 7/1975 | Tham et al. |
| 3,907,045 | A | 9/1975 | Dahl et al. |
| 3,922,148 | A | 11/1975 | Child |
| 3,924,680 | A | 12/1975 | Terry |
| 3,933,447 | A | 1/1976 | Pasini, III et al. |
| 3,941,421 | A | 3/1976 | Burton, III et al. |
| 3,943,160 | A | 3/1976 | Farmer, III et al. |
| 3,946,812 | A | 3/1976 | Gale et al. |
| 3,947,683 | A | 3/1976 | Schultz et al. |
| 3,948,319 | A | 4/1976 | Pritchett |
| 3,948,755 | A | 4/1976 | McCollum et al. |
| 3,950,029 | A | 4/1976 | Timmins |
| 3,952,802 | A | 4/1976 | Terry |
| 3,954,140 | A | 5/1976 | Hendrick |
| 3,958,636 | A | 5/1976 | Perkins |
| 3,972,372 | A | 8/1976 | Fisher et al. |
| 3,973,628 | A | 8/1976 | Colgate |
| 3,986,349 | A | 10/1976 | Egan |
| 3,986,556 | A | 10/1976 | Haynes |
| 3,986,557 | A | 10/1976 | Striegler et al. |
| 3,987,851 | A | 10/1976 | Tham |
| 3,992,474 | A | 11/1976 | Sobel |
| 3,993,132 | A | 11/1976 | Cram et al. |
| 3,994,340 | A | 11/1976 | Anderson et al. |
| 3,994,341 | A | 11/1976 | Anderson et al. |
| 3,999,607 | A | 12/1976 | Pennington et al. |
| 4,005,752 | A | 2/1977 | Cha |
| 4,006,778 | A | 2/1977 | Redford et al. |
| 4,008,762 | A | 2/1977 | Fisher et al. |
| 4,010,800 | A | 3/1977 | Terry |
| 4,014,575 | A | 3/1977 | French et al. |
| 4,016,239 | A | 4/1977 | Fenton |
| 4,018,280 | A | 4/1977 | Daviduk et al. |
| 4,019,575 | A | 4/1977 | Pisio et al. |
| 4,022,280 | A | 5/1977 | Stoddard et al. |
| 4,026,357 | A | 5/1977 | Redford |
| 4,029,360 | A | 6/1977 | French |
| 4,031,956 | A | 6/1977 | Terry |
| 4,037,655 | A | 7/1977 | Carpenter |
| 4,037,658 | A | 7/1977 | Anderson |
| 4,042,026 | A | 8/1977 | Pusch et al. |
| 4,043,393 | A | 8/1977 | Fisher et al. |
| 4,048,637 | A | 9/1977 | Jacomini |
| 4,049,053 | A | 9/1977 | Fisher et al. |
| 4,057,293 | A | 11/1977 | Garrett |
| 4,059,308 | A | 11/1977 | Pearson et al. |
| 4,064,943 | A | 12/1977 | Cavin |
| 4,065,183 | A | 12/1977 | Hill et al. |
| 4,067,390 | A | 1/1978 | Camacho et al. |
| 4,069,868 | A | 1/1978 | Terry |
| 4,076,761 | A | 2/1978 | Chang et al. |
| 4,077,471 | A | 3/1978 | Shupe et al. |
| 4,083,604 | A | 4/1978 | Bohn et al. |
| 4,084,637 | A | 4/1978 | Todd |
| 4,085,803 | A | 4/1978 | Butler |
| 4,087,130 | A | 5/1978 | Garrett |
| 4,089,372 | A | 5/1978 | Terry |
| 4,089,373 | A | 5/1978 | Reynolds et al. |
| 4,089,374 | A | 5/1978 | Terry |
| 4,091,869 | A | 5/1978 | Hoyer |
| 4,093,025 | A | 6/1978 | Terry |
| 4,093,026 | A | 6/1978 | Ridley |
| 4,096,163 | A | 6/1978 | Chang et al. |
| 4,099,567 | A | 7/1978 | Terry |
| 4,114,688 | A | 9/1978 | Terry |
| 4,119,349 | A | 10/1978 | Albulescu et al. |
| 4,125,159 | A | 11/1978 | Vann |
| 4,130,575 | A | 12/1978 | Jorn et al. |
| 4,133,825 | A | 1/1979 | Stroud et al. |
| 4,138,442 | A | 2/1979 | Chang et al. |
| 4,140,180 | A | 2/1979 | Bridges et al. |
| 4,140,181 | A | 2/1979 | Ridley et al. |
| 4,144,935 | A | 3/1979 | Bridges et al. |
| 4,148,359 | A | 4/1979 | Laumbach et al. |
| 4,151,068 | A | 4/1979 | McCollum et al. |
| 4,151,877 | A | 5/1979 | French |
| RE30,019 | E | 6/1979 | Lindquist |
| 4,158,467 | A | 6/1979 | Larson et al. |
| 4,162,707 | A | 7/1979 | Yan |
| 4,169,506 | A | 10/1979 | Berry |
| 4,183,405 | A | 1/1980 | Magnie |
| 4,184,548 | A | 1/1980 | Ginsburgh et al. |
| 4,185,692 | A | 1/1980 | Terry |
| 4,186,801 | A | 2/1980 | Madgavkar et al. |
| 4,193,451 | A | 3/1980 | Dauphine |
| 4,194,562 | A | 3/1980 | Bousaid et al. |
| 4,197,911 | A | 4/1980 | Anada |
| 4,199,024 | A | 4/1980 | Rose et al. |

(56) References Cited

U.S. PATENT DOCUMENTS

| | | | |
|---|---|---|---|
| 4,199,025 | A | 4/1980 | Carpenter |
| 4,216,079 | A | 8/1980 | Newcombe |
| 4,228,853 | A | 10/1980 | Harvey et al. |
| 4,228,854 | A | 10/1980 | Sacuta |
| 4,234,230 | A | 11/1980 | Weichman |
| 4,243,101 | A | 1/1981 | Grupping |
| 4,243,511 | A | 1/1981 | Allred |
| 4,248,306 | A | 2/1981 | Van Huisen et al. |
| 4,250,230 | A | 2/1981 | Terry |
| 4,250,962 | A | 2/1981 | Madgavkar et al. |
| 4,252,191 | A | 2/1981 | Pusch et al. |
| 4,256,945 | A | 3/1981 | Carter et al. |
| 4,258,955 | A | 3/1981 | Habib, Jr. |
| 4,260,192 | A | 4/1981 | Shafer |
| 4,265,307 | A | 5/1981 | Elkins |
| 4,273,188 | A | 6/1981 | Vogel et al. |
| 4,274,487 | A | 6/1981 | Hollingsworth et al. |
| 4,277,416 | A | 7/1981 | Grant |
| 4,282,587 | A | 8/1981 | Silverman |
| 4,285,547 | A | 8/1981 | Weichman |
| RE30,738 | E | 9/1981 | Bridges et al. |
| 4,299,086 | A | 11/1981 | Madgavkar et al. |
| 4,299,285 | A | 11/1981 | Tsai et al. |
| 4,303,126 | A | 12/1981 | Blevins |
| 4,305,463 | A | 12/1981 | Zakiewicz |
| 4,306,621 | A | 12/1981 | Boyd et al. |
| 4,324,292 | A | 4/1982 | Jacobs et al. |
| 4,344,483 | A | 8/1982 | Fisher et al. |
| 4,353,418 | A | 10/1982 | Hoekstra et al. |
| 4,359,687 | A | 11/1982 | Vinegar et al. |
| 4,363,361 | A | 12/1982 | Madgavkar et al. |
| 4,366,668 | A | 1/1983 | Madgavkar et al. |
| 4,366,864 | A | 1/1983 | Gibson et al. |
| 4,378,048 | A | 3/1983 | Madgavkar et al. |
| 4,380,930 | A | 4/1983 | Podhrasky et al. |
| 4,381,641 | A | 5/1983 | Madgavkar et al. |
| 4,382,469 | A | 5/1983 | Bell et al. |
| 4,384,613 | A | 5/1983 | Owen et al. |
| 4,384,614 | A | 5/1983 | Justheim |
| 4,385,661 | A | 5/1983 | Fox |
| 4,390,067 | A | 6/1983 | Willman |
| 4,390,973 | A | 6/1983 | Rietsch |
| 4,396,062 | A | 8/1983 | Iskander |
| 4,397,732 | A | 8/1983 | Hoover et al. |
| 4,398,151 | A | 8/1983 | Vinegar et al. |
| 4,399,866 | A | 8/1983 | Dearth |
| 4,401,099 | A | 8/1983 | Collier |
| 4,401,162 | A | 8/1983 | Osborne |
| 4,401,163 | A | 8/1983 | Elkins |
| 4,407,973 | A | 10/1983 | van Dijk et al. |
| 4,409,090 | A | 10/1983 | Hanson et al. |
| 4,410,042 | A | 10/1983 | Shu |
| 4,412,124 | A | 10/1983 | Kobayashi |
| 4,412,585 | A | 11/1983 | Bouck |
| 4,415,034 | A | 11/1983 | Bouck |
| 4,417,782 | A | 11/1983 | Clarke et al. |
| 4,418,752 | A | 12/1983 | Boyer et al. |
| 4,423,311 | A | 12/1983 | Varney, Sr. |
| 4,425,967 | A | 1/1984 | Hoekstra |
| 4,428,700 | A | 1/1984 | Lennemann |
| 4,429,745 | A | 2/1984 | Cook |
| 4,437,519 | A | 3/1984 | Cha et al. |
| 4,439,307 | A | 3/1984 | Jaquay et al. |
| 4,440,224 | A | 4/1984 | Kreinin et al. |
| 4,442,896 | A | 4/1984 | Reale et al. |
| 4,444,255 | A | 4/1984 | Geoffrey et al. |
| 4,444,258 | A | 4/1984 | Kalmar |
| 4,445,574 | A | 5/1984 | Vann |
| 4,446,917 | A | 5/1984 | Todd |
| 4,448,251 | A | 5/1984 | Stine |
| 4,449,594 | A | 5/1984 | Sparks |
| 4,452,491 | A | 6/1984 | Seglin et al. |
| 4,455,215 | A | 6/1984 | Jarrott et al. |
| 4,456,065 | A | 6/1984 | Heim et al. |
| 4,457,365 | A | 7/1984 | Kasevich et al. |
| 4,457,374 | A | 7/1984 | Hoekstra et al. |
| 4,458,757 | A | 7/1984 | Bock et al. |
| 4,458,767 | A | 7/1984 | Hoehn, Jr. |
| 4,460,044 | A | 7/1984 | Porter |
| 4,463,988 | A | 8/1984 | Bouck et al. |
| 4,474,236 | A | 10/1984 | Kellett |
| 4,474,238 | A | 10/1984 | Gentry et al. |
| 4,479,541 | A | 10/1984 | Wang |
| 4,485,868 | A | 12/1984 | Sresty et al. |
| 4,485,869 | A | 12/1984 | Sresty et al. |
| 4,487,257 | A | 12/1984 | Dauphine |
| 4,489,782 | A | 12/1984 | Perkins |
| 4,491,179 | A | 1/1985 | Pirson et al. |
| 4,498,531 | A | 2/1985 | Vrolyk |
| 4,498,535 | A | 2/1985 | Bridges |
| 4,499,209 | A | 2/1985 | Hoek et al. |
| 4,501,326 | A | 2/1985 | Edmunds |
| 4,501,445 | A | 2/1985 | Gregoli |
| 4,513,816 | A | 4/1985 | Hubert |
| 4,518,548 | A | 5/1985 | Yarbrough |
| 4,524,826 | A | 6/1985 | Savage |
| 4,524,827 | A | 6/1985 | Bridges et al. |
| 4,530,401 | A | 7/1985 | Hartman et al. |
| 4,537,252 | A | 8/1985 | Puri |
| 4,538,682 | A | 9/1985 | McManus et al. |
| 4,540,882 | A | 9/1985 | Vinegar et al. |
| 4,542,648 | A | 9/1985 | Vinegar et al. |
| 4,544,478 | A | 10/1985 | Kelley |
| 4,545,435 | A | 10/1985 | Bridges et al. |
| 4,549,396 | A | 10/1985 | Garwood et al. |
| 4,552,214 | A | 11/1985 | Forgac et al. |
| 4,570,715 | A | 2/1986 | Van Meurs et al. |
| 4,571,491 | A | 2/1986 | Vinegar et al. |
| 4,572,299 | A | 2/1986 | Vanegmond et al. |
| 4,573,530 | A | 3/1986 | Audeh et al. |
| 4,576,231 | A | 3/1986 | Dowling et al. |
| 4,577,503 | A | 3/1986 | Imaino et al. |
| 4,577,690 | A | 3/1986 | Medlin |
| 4,577,691 | A | 3/1986 | Huang et al. |
| 4,583,046 | A | 4/1986 | Vinegar et al. |
| 4,583,242 | A | 4/1986 | Vinegar et al. |
| 4,585,066 | A | 4/1986 | Moore et al. |
| 4,592,423 | A | 6/1986 | Savage et al. |
| 4,597,441 | A | 7/1986 | Ware et al. |
| 4,597,444 | A | 7/1986 | Hutchinson |
| 4,598,392 | A | 7/1986 | Pann |
| 4,598,770 | A | 7/1986 | Shu et al. |
| 4,598,772 | A | 7/1986 | Holmes |
| 4,605,489 | A | 8/1986 | Madgavkar |
| 4,605,680 | A | 8/1986 | Beuther et al. |
| 4,608,818 | A | 9/1986 | Goebel et al. |
| 4,609,041 | A | 9/1986 | Magda |
| 4,613,754 | A | 9/1986 | Vinegar et al. |
| 4,616,705 | A | 10/1986 | Stegemeier et al. |
| 4,623,401 | A | 11/1986 | Derbyshire et al. |
| 4,623,444 | A | 11/1986 | Che et al. |
| 4,626,665 | A | 12/1986 | Fort, III |
| 4,634,187 | A | 1/1987 | Huff et al. |
| 4,635,197 | A | 1/1987 | Vinegar et al. |
| 4,637,464 | A | 1/1987 | Forgac et al. |
| 4,640,352 | A | 2/1987 | Vanmeurs et al. |
| 4,640,353 | A | 2/1987 | Schuh |
| 4,643,256 | A | 2/1987 | Dilgren et al. |
| 4,644,283 | A | 2/1987 | Vinegar et al. |
| 4,645,906 | A | 2/1987 | Yagnik et al. |
| 4,651,825 | A | 3/1987 | Wilson |
| 4,658,215 | A | 4/1987 | Vinegar et al. |
| 4,662,437 | A | 5/1987 | Renfro et al. |
| 4,662,438 | A | 5/1987 | Taflove et al. |
| 4,662,439 | A | 5/1987 | Puri |
| 4,662,443 | A | 5/1987 | Puri et al. |
| 4,663,711 | A | 5/1987 | Vinegar et al. |
| 4,669,542 | A | 6/1987 | Venkatesan |
| 4,671,102 | A | 6/1987 | Vinegar et al. |
| 4,682,652 | A | 7/1987 | Huang et al. |
| 4,691,771 | A | 9/1987 | Ware et al. |
| 4,694,907 | A | 9/1987 | Stahl et al. |
| 4,695,713 | A | 9/1987 | Krumme |
| 4,696,345 | A | 9/1987 | Hsueh |

(56) References Cited

U.S. PATENT DOCUMENTS

| | | | |
|---|---|---|---|
| 4,698,149 | A | 10/1987 | Mitchell |
| 4,698,583 | A | 10/1987 | Sandberg |
| 4,701,587 | A | 10/1987 | Carter et al. |
| 4,704,514 | A | 11/1987 | Van Edmond et al. |
| 4,706,751 | A | 11/1987 | Gondouin |
| 4,716,960 | A | 1/1988 | Eastlund et al. |
| 4,717,814 | A | 1/1988 | Krumme |
| 4,719,423 | A | 1/1988 | Vinegar et al. |
| 4,728,892 | A | 3/1988 | Vinegar et al. |
| 4,730,162 | A | 3/1988 | Vinegar et al. |
| 4,733,057 | A | 3/1988 | Stanzel et al. |
| 4,734,115 | A | 3/1988 | Howard et al. |
| 4,743,854 | A | 5/1988 | Vinegar et al. |
| 4,744,245 | A | 5/1988 | White |
| 4,752,673 | A | 6/1988 | Krumme |
| 4,756,367 | A | 7/1988 | Puri et al. |
| 4,762,425 | A | 8/1988 | Shakkottai et al. |
| 4,766,958 | A | 8/1988 | Faecke |
| 4,769,602 | A | 9/1988 | Vinegar et al. |
| 4,769,606 | A | 9/1988 | Vinegar et al. |
| 4,772,634 | A | 9/1988 | Farooque |
| 4,776,638 | A | 10/1988 | Hahn |
| 4,778,586 | A | 10/1988 | Bain et al. |
| 4,785,163 | A | 11/1988 | Sandberg |
| 4,787,452 | A | 11/1988 | Jennings, Jr. |
| 4,793,409 | A | 12/1988 | Bridges et al. |
| 4,794,226 | A | 12/1988 | Derbyshire |
| 4,808,925 | A | 2/1989 | Baird |
| 4,814,587 | A | 3/1989 | Carter |
| 4,815,791 | A | 3/1989 | Schmidt et al. |
| 4,817,711 | A | 4/1989 | Jeambey |
| 4,818,370 | A | 4/1989 | Gregoli et al. |
| 4,821,798 | A | 4/1989 | Bridges et al. |
| 4,823,890 | A | 4/1989 | Lang |
| 4,827,761 | A | 5/1989 | Vinegar et al. |
| 4,828,031 | A | 5/1989 | Davis |
| 4,842,448 | A | 6/1989 | Koerner et al. |
| 4,848,460 | A | 7/1989 | Johnson, Jr. et al. |
| 4,848,924 | A | 7/1989 | Nuspl et al. |
| 4,849,611 | A | 7/1989 | Whitney et al. |
| 4,856,341 | A | 8/1989 | Vinegar et al. |
| 4,856,587 | A | 8/1989 | Nielson |
| 4,860,544 | A | 8/1989 | Krieg et al. |
| 4,866,983 | A | 9/1989 | Vinegar et al. |
| 4,883,582 | A | 11/1989 | McCants |
| 4,884,455 | A | 12/1989 | Vinegar et al. |
| 4,884,635 | A | 12/1989 | McKay et al. |
| 4,885,080 | A | 12/1989 | Brown et al. |
| 4,886,118 | A | 12/1989 | Van Meurs et al. |
| 4,893,504 | A | 1/1990 | OMeara, Jr. et al. |
| 4,895,206 | A | 1/1990 | Price |
| 4,912,971 | A | 4/1990 | Jeambey |
| 4,913,065 | A | 4/1990 | Hemsath |
| 4,926,941 | A | 5/1990 | Glandt et al. |
| 4,927,857 | A | 5/1990 | McShea, III et al. |
| 4,928,765 | A | 5/1990 | Nielson |
| 4,940,095 | A | 7/1990 | Newman |
| 4,974,425 | A | 12/1990 | Krieg et al. |
| 4,982,786 | A | 1/1991 | Jennings, Jr. |
| 4,983,319 | A | 1/1991 | Gregoli et al. |
| 4,984,594 | A | 1/1991 | Vinegar et al. |
| 4,985,313 | A | 1/1991 | Penneck et al. |
| 4,987,368 | A | 1/1991 | Vinegar |
| 4,994,093 | A | 2/1991 | Wetzel et al. |
| 5,008,085 | A | 4/1991 | Bain et al. |
| 5,011,329 | A | 4/1991 | Nelson et al. |
| 5,014,788 | A | 5/1991 | Puri et al. |
| 5,020,596 | A | 6/1991 | Hemsath |
| 5,027,896 | A | 7/1991 | Anderson |
| 5,032,042 | A | 7/1991 | Schuring et al. |
| 5,041,210 | A | 8/1991 | Merrill, Jr. et al. |
| 5,042,579 | A | 8/1991 | Glandt et al. |
| 5,043,668 | A | 8/1991 | Vail, III |
| 5,046,559 | A | 9/1991 | Glandt |
| 5,046,560 | A | 9/1991 | Teletzke et al. |
| 5,050,386 | A | 9/1991 | Krieg et al. |
| 5,054,551 | A | 10/1991 | Duerksen |
| 5,059,303 | A | 10/1991 | Taylor et al. |
| 5,060,287 | A | 10/1991 | Van Egmond |
| 5,060,726 | A | 10/1991 | Glandt et al. |
| 5,064,006 | A | 11/1991 | Waters et al. |
| 5,065,501 | A | 11/1991 | Henschen et al. |
| 5,065,818 | A | 11/1991 | Van Egmond |
| 5,066,852 | A | 11/1991 | Willbanks |
| 5,070,533 | A | 12/1991 | Bridges et al. |
| 5,073,625 | A | 12/1991 | Derbyshire |
| 5,082,054 | A | 1/1992 | Kiamanesh |
| 5,082,055 | A | 1/1992 | Hemsath |
| 5,085,276 | A | 2/1992 | Rivas et al. |
| 5,097,903 | A | 3/1992 | Wilensky |
| 5,099,918 | A | 3/1992 | Bridges et al. |
| 5,103,909 | A | 4/1992 | Morgenthaler et al. |
| 5,103,920 | A | 4/1992 | Patton |
| 5,109,928 | A | 5/1992 | McCants |
| 5,126,037 | A | 6/1992 | Showalter |
| 5,133,406 | A | 7/1992 | Puri |
| 5,145,003 | A | 9/1992 | Duerksen |
| 5,152,341 | A | 10/1992 | Kasevich |
| 5,168,927 | A | 12/1992 | Stegemeier et al. |
| 5,182,427 | A | 1/1993 | McGaffigan |
| 5,182,792 | A | 1/1993 | Goncalves |
| 5,189,283 | A | 2/1993 | Carl, Jr. et al. |
| 5,190,405 | A | 3/1993 | Vinegar et al. |
| 5,193,618 | A | 3/1993 | Loh et al. |
| 5,199,490 | A | 4/1993 | Surles et al. |
| 5,201,219 | A | 4/1993 | Bandurski et al. |
| 5,207,273 | A | 5/1993 | Cates et al. |
| 5,209,987 | A | 5/1993 | Penneck et al. |
| 5,211,230 | A | 5/1993 | Ostapovich et al. |
| 5,217,075 | A | 6/1993 | Wittrisch |
| 5,217,076 | A | 6/1993 | Masek |
| 5,226,961 | A | 7/1993 | Nahm et al. |
| 5,229,583 | A | 7/1993 | van Egmond et al. |
| 5,236,039 | A | 8/1993 | Edelstein et al. |
| 5,246,071 | A | 9/1993 | Chu |
| 5,255,740 | A | 10/1993 | Talley |
| 5,255,742 | A | 10/1993 | Mikus |
| 5,261,490 | A | 11/1993 | Ebinuma |
| 5,284,206 | A | 2/1994 | Surles et al. |
| 5,285,071 | A | 2/1994 | LaCount |
| 5,285,846 | A | 2/1994 | Mohn |
| 5,289,882 | A | 3/1994 | Moore |
| 5,295,763 | A | 3/1994 | Stenborg et al. |
| 5,297,626 | A | 3/1994 | Vinegar et al. |
| 5,305,239 | A | 4/1994 | Kinra |
| 5,305,829 | A | 4/1994 | Kumar |
| 5,306,640 | A | 4/1994 | Vinegar et al. |
| 5,316,664 | A | 5/1994 | Gregoli et al. |
| 5,318,116 | A | 6/1994 | Vinegar et al. |
| 5,318,709 | A | 6/1994 | Wuest et al. |
| 5,325,918 | A | 7/1994 | Berryman et al. |
| 5,332,036 | A | 7/1994 | Shirley et al. |
| 5,339,897 | A | 8/1994 | Leaute |
| 5,339,904 | A | 8/1994 | Jennings, Jr. |
| 5,340,467 | A | 8/1994 | Gregoli et al. |
| 5,349,859 | A | 9/1994 | Kleppe |
| 5,358,045 | A | 10/1994 | Sevigny et al. |
| 5,360,067 | A | 11/1994 | Meo, III |
| 5,363,094 | A | 11/1994 | Staron et al. |
| 5,366,012 | A | 11/1994 | Lohbeck |
| 5,377,756 | A | 1/1995 | Northrop et al. |
| 5,388,640 | A | 2/1995 | Puri et al. |
| 5,388,641 | A | 2/1995 | Yee et al. |
| 5,388,642 | A | 2/1995 | Puri et al. |
| 5,388,643 | A | 2/1995 | Yee et al. |
| 5,388,645 | A | 2/1995 | Puri et al. |
| 5,391,291 | A | 2/1995 | Winquist et al. |
| 5,392,854 | A | 2/1995 | Vinegar et al. |
| 5,400,430 | A | 3/1995 | Nenniger |
| 5,402,847 | A | 4/1995 | Wilson et al. |
| 5,404,952 | A | 4/1995 | Vinegar et al. |
| 5,409,071 | A | 4/1995 | Wellington et al. |
| 5,411,086 | A | 5/1995 | Burcham et al. |
| 5,411,089 | A | 5/1995 | Vinegar et al. |

(56) References Cited

U.S. PATENT DOCUMENTS

| | | | |
|---|---|---|---|
| 5,411,104 | A | 5/1995 | Stanley |
| 5,415,231 | A | 5/1995 | Northrop et al. |
| 5,431,224 | A | 7/1995 | Laali |
| 5,433,271 | A | 7/1995 | Vinegar et al. |
| 5,435,666 | A | 7/1995 | Hassett et al. |
| 5,437,506 | A | 8/1995 | Gray |
| 5,439,054 | A | 8/1995 | Chaback et al. |
| 5,454,666 | A | 10/1995 | Chaback et al. |
| 5,456,315 | A | 10/1995 | Kisman et al. |
| 5,491,969 | A | 2/1996 | Cohn et al. |
| 5,497,087 | A | 3/1996 | Vinegar et al. |
| 5,498,960 | A | 3/1996 | Vinegar et al. |
| 5,512,732 | A | 4/1996 | Yagnik et al. |
| 5,517,593 | A | 5/1996 | Nenniger et al. |
| 5,525,322 | A | 6/1996 | Willms |
| 5,541,517 | A | 7/1996 | Hartmann et al. |
| 5,545,803 | A | 8/1996 | Heath et al. |
| 5,553,189 | A | 9/1996 | Stegemeier et al. |
| 5,554,453 | A | 9/1996 | Steinfeld et al. |
| 5,566,755 | A | 10/1996 | Seidle et al. |
| 5,566,756 | A | 10/1996 | Chaback et al. |
| 5,571,403 | A | 11/1996 | Scott et al. |
| 5,579,575 | A | 12/1996 | Lamome et al. |
| 5,589,775 | A | 12/1996 | Kuckes |
| 5,621,844 | A | 4/1997 | Bridges |
| 5,621,845 | A | 4/1997 | Bridges et al. |
| 5,624,188 | A | 4/1997 | West |
| 5,632,336 | A | 5/1997 | Notz et al. |
| 5,652,389 | A | 7/1997 | Schaps et al. |
| 5,654,261 | A | 8/1997 | Smith |
| 5,656,239 | A | 8/1997 | Stegemeier et al. |
| RE35,696 | E | 12/1997 | Mikus |
| 5,713,415 | A | 2/1998 | Bridges |
| 5,723,423 | A | 3/1998 | Van Slyke |
| 5,751,895 | A | 5/1998 | Bridges |
| 5,759,022 | A | 6/1998 | Koppang et al. |
| 5,760,307 | A | 6/1998 | Latimer et al. |
| 5,769,569 | A | 6/1998 | Hosseini |
| 5,777,229 | A | 7/1998 | Geier et al. |
| 5,782,301 | A | 7/1998 | Neuroth et al. |
| 5,802,870 | A | 9/1998 | Arnold et al. |
| 5,826,653 | A | 10/1998 | Rynne et al. |
| 5,826,655 | A | 10/1998 | Snow et al. |
| 5,828,797 | A | 10/1998 | Minott et al. |
| 5,861,137 | A | 1/1999 | Edlund |
| 5,862,858 | A | 1/1999 | Wellington et al. |
| 5,868,202 | A | 2/1999 | Hsu |
| 5,879,110 | A | 3/1999 | Carter |
| 5,899,269 | A | 5/1999 | Wellington et al. |
| 5,899,958 | A | 5/1999 | Dowell et al. |
| 5,911,898 | A | 6/1999 | Jacobs et al. |
| 5,923,170 | A | 7/1999 | Kuckes |
| 5,926,437 | A | 7/1999 | Ortiz |
| 5,935,421 | A | 8/1999 | Brons et al. |
| 5,958,365 | A | 9/1999 | Liu |
| 5,968,349 | A | 10/1999 | Duyvesteyn et al. |
| 5,984,010 | A | 11/1999 | Pias et al. |
| 5,984,578 | A | 11/1999 | Hanesian et al. |
| 5,984,582 | A | 11/1999 | Schwert |
| 5,985,138 | A | 11/1999 | Humphreys |
| 5,992,522 | A | 11/1999 | Boyd et al. |
| 5,997,214 | A | 12/1999 | de Rouffignac et al. |
| 6,015,015 | A | 1/2000 | Luft et al. |
| 6,016,867 | A | 1/2000 | Gregoli et al. |
| 6,016,868 | A | 1/2000 | Gregoli et al. |
| 6,019,172 | A | 2/2000 | Wellington et al. |
| 6,022,834 | A | 2/2000 | Hsu et al. |
| 6,023,554 | A | 2/2000 | Vinegar et al. |
| 6,026,914 | A | 2/2000 | Adams et al. |
| 6,035,701 | A | 3/2000 | Lowry et al. |
| 6,039,121 | A | 3/2000 | Kisman |
| 6,049,508 | A | 4/2000 | Deflandre |
| 6,056,057 | A | 5/2000 | Vinegar et al. |
| 6,065,538 | A | 5/2000 | Reimers et al. |
| 6,078,868 | A | 6/2000 | Dubinsky |
| 6,079,499 | A | 6/2000 | Mikus et al. |
| 6,084,826 | A | 7/2000 | Leggett, III |
| 6,085,512 | A | 7/2000 | Agee et al. |
| 6,088,294 | A | 7/2000 | Leggett, III et al. |
| 6,094,048 | A | 7/2000 | Vinegar et al. |
| 6,099,208 | A | 8/2000 | McAlister |
| 6,102,122 | A | 8/2000 | de Rouffignac |
| 6,102,137 | A | 8/2000 | Ward et al. |
| 6,102,622 | A | 8/2000 | Vinegar et al. |
| 6,110,358 | A | 8/2000 | Aldous et al. |
| 6,112,808 | A | 9/2000 | Isted |
| 6,152,987 | A | 11/2000 | Ma et al. |
| 6,155,117 | A | 12/2000 | Stevens et al. |
| 6,172,124 | B1 | 1/2001 | Wolflick et al. |
| 6,173,775 | B1 | 1/2001 | Elias et al. |
| 6,192,748 | B1 | 2/2001 | Miller |
| 6,193,010 | B1 | 2/2001 | Minto |
| 6,196,350 | B1 | 3/2001 | Minto |
| 6,244,338 | B1 | 6/2001 | Mones |
| 6,257,334 | B1 | 7/2001 | Cyr et al. |
| 6,269,310 | B1 | 7/2001 | Washbourne |
| 6,269,881 | B1 | 8/2001 | Chou et al. |
| 6,283,230 | B1 | 9/2001 | Peters |
| 6,288,372 | B1 | 9/2001 | Sandberg et al. |
| 6,328,104 | B1 | 12/2001 | Graue |
| 6,353,706 | B1 | 3/2002 | Bridges |
| 6,354,373 | B1 | 3/2002 | Vercaemer et al. |
| 6,357,526 | B1 | 3/2002 | Abdel-Halim et al. |
| 6,388,947 | B1 | 5/2002 | Washbourne et al. |
| 6,412,559 | B1 | 7/2002 | Gunter et al. |
| 6,417,268 | B1 | 7/2002 | Zhang et al. |
| 6,422,318 | B1 | 7/2002 | Rider |
| 6,427,124 | B1 | 7/2002 | Dubinsky et al. |
| 6,429,784 | B1 | 8/2002 | Beique et al. |
| 6,439,308 | B1 | 8/2002 | Wang |
| 6,467,543 | B1 | 10/2002 | Talwani et al. |
| 6,485,232 | B1 | 11/2002 | Vinegar et al. |
| 6,499,536 | B1 | 12/2002 | Ellingsen |
| 6,516,891 | B1 | 2/2003 | Dallas |
| 6,540,018 | B1 | 4/2003 | Vinegar et al. |
| 6,581,684 | B2 | 6/2003 | Wellington et al. |
| 6,584,406 | B1 | 6/2003 | Harmon et al. |
| 6,585,046 | B2 | 7/2003 | Neuroth et al. |
| 6,588,266 | B2 | 7/2003 | Tubel et al. |
| 6,588,503 | B2 | 7/2003 | Karanikas et al. |
| 6,588,504 | B2 | 7/2003 | Wellington et al. |
| 6,591,906 | B2 | 7/2003 | Wellington et al. |
| 6,591,907 | B2 | 7/2003 | Zhang et al. |
| 6,607,033 | B2 | 8/2003 | Wellington et al. |
| 6,609,570 | B2 | 8/2003 | Wellington et al. |
| 6,679,332 | B2 | 1/2004 | Vinegar et al. |
| 6,684,948 | B1 | 2/2004 | Savage |
| 6,688,387 | B1 | 2/2004 | Wellington et al. |
| 6,698,515 | B2 | 3/2004 | Karanikas et al. |
| 6,702,016 | B2 | 3/2004 | de Rouffignac et al. |
| 6,708,758 | B2 | 3/2004 | de Rouffignac et al. |
| 6,712,135 | B2 | 3/2004 | Wellington et al. |
| 6,712,136 | B2 | 3/2004 | de Rouffignac et al. |
| 6,712,137 | B2 | 3/2004 | Vinegar et al. |
| 6,715,546 | B2 | 4/2004 | Vinegar et al. |
| 6,715,547 | B2 | 4/2004 | Vinegar et al. |
| 6,715,548 | B2 | 4/2004 | Wellington et al. |
| 6,715,550 | B2 | 4/2004 | Vinegar et al. |
| 6,719,047 | B2 | 4/2004 | Fowler et al. |
| 6,722,429 | B2 | 4/2004 | de Rouffignac et al. |
| 6,722,430 | B2 | 4/2004 | Vinegar et al. |
| 6,722,431 | B2 | 4/2004 | Karanikas et al. |
| 6,725,920 | B2 | 4/2004 | Zhang et al. |
| 6,725,928 | B2 | 4/2004 | Vinegar et al. |
| 6,729,395 | B2 | 5/2004 | Shahin, Jr. et al. |
| 6,729,396 | B2 | 5/2004 | Vinegar et al. |
| 6,729,397 | B2 | 5/2004 | Zhang et al. |
| 6,729,401 | B2 | 5/2004 | Vinegar et al. |
| 6,732,794 | B2 | 5/2004 | Wellington et al. |
| 6,732,795 | B2 | 5/2004 | de Rouffignac et al. |
| 6,732,796 | B2 | 5/2004 | Vinegar et al. |
| 6,736,215 | B2 | 5/2004 | Maher et al. |
| 6,739,393 | B2 | 5/2004 | Vinegar et al. |
| 6,739,394 | B2 | 5/2004 | Vinegar et al. |

(56) References Cited

U.S. PATENT DOCUMENTS

| | | | |
|---|---|---|---|
| 6,742,587 | B2 | 6/2004 | Vinegar et al. |
| 6,742,588 | B2 | 6/2004 | Wellington et al. |
| 6,742,589 | B2 | 6/2004 | Berchenko et al. |
| 6,742,593 | B2 | 6/2004 | Vinegar et al. |
| 6,745,831 | B2 | 6/2004 | de Rouffignac et al. |
| 6,745,832 | B2 | 6/2004 | Wellington et al. |
| 6,745,837 | B2 | 6/2004 | Wellington et al. |
| 6,749,021 | B2 | 6/2004 | Vinegar et al. |
| 6,752,210 | B2 | 6/2004 | de Rouffignac et al. |
| 6,755,251 | B2 | 6/2004 | Thomas et al. |
| 6,758,268 | B2 | 7/2004 | Vinegar et al. |
| 6,761,216 | B2 | 7/2004 | Vinegar et al. |
| 6,763,886 | B2 | 7/2004 | Schoeling et al. |
| 6,769,483 | B2 | 8/2004 | de Rouffignac et al. |
| 6,769,485 | B2 | 8/2004 | Vinegar et al. |
| 6,782,947 | B2 | 8/2004 | de Rouffignac et al. |
| 6,789,625 | B2 | 9/2004 | de Rouffignac et al. |
| 6,805,194 | B2 | 10/2004 | Davidson et al. |
| 6,805,195 | B2 | 10/2004 | Vinegar et al. |
| 6,820,688 | B2 | 11/2004 | Vinegar et al. |
| 6,854,534 | B2 | 2/2005 | Livingstone |
| 6,854,929 | B2 | 2/2005 | Vinegar et al. |
| 6,866,097 | B2 | 3/2005 | Vinegar et al. |
| 6,871,707 | B2 | 3/2005 | Karanikas et al. |
| 6,877,554 | B2 | 4/2005 | Stegemeier et al. |
| 6,877,555 | B2 | 4/2005 | Karanikas et al. |
| 6,880,633 | B2 | 4/2005 | Wellington et al. |
| 6,880,635 | B2 | 4/2005 | Vinegar et al. |
| 6,889,769 | B2 | 5/2005 | Wellington et al. |
| 6,896,053 | B2 | 5/2005 | Berchenko et al. |
| 6,902,003 | B2 | 6/2005 | Maher et al. |
| 6,902,004 | B2 | 6/2005 | de Rouffignac et al. |
| 6,910,536 | B2 | 6/2005 | Wellington et al. |
| 6,910,537 | B2 | 6/2005 | Brown et al. |
| 6,913,078 | B2 | 7/2005 | Shahin, Jr. et al. |
| 6,913,079 | B2 | 7/2005 | Tubel |
| 6,915,850 | B2 | 7/2005 | Vinegar et al. |
| 6,918,442 | B2 | 7/2005 | Wellington et al. |
| 6,918,443 | B2 | 7/2005 | Wellington et al. |
| 6,918,444 | B2 | 7/2005 | Passey |
| 6,923,257 | B2 | 8/2005 | Wellington et al. |
| 6,923,258 | B2 | 8/2005 | Wellington et al. |
| 6,929,067 | B2 | 8/2005 | Vinegar et al. |
| 6,932,155 | B2 | 8/2005 | Vinegar et al. |
| 6,942,032 | B2 | 9/2005 | La Rovere et al. |
| 6,942,037 | B1 | 9/2005 | Arnold |
| 6,948,562 | B2 | 9/2005 | Wellington et al. |
| 6,948,563 | B2 | 9/2005 | Wellington et al. |
| 6,951,247 | B2 | 10/2005 | de Rouffignac et al. |
| 6,951,250 | B2 | 10/2005 | Reddy et al. |
| 6,953,087 | B2 | 10/2005 | de Rouffignac et al. |
| 6,958,704 | B2 | 10/2005 | Vinegar et al. |
| 6,959,761 | B2 | 11/2005 | Berchenko et al. |
| 6,964,300 | B2 | 11/2005 | Vinegar et al. |
| 6,966,372 | B2 | 11/2005 | Wellington et al. |
| 6,966,374 | B2 | 11/2005 | Vinegar et al. |
| 6,969,123 | B2 | 11/2005 | Vinegar et al. |
| 6,973,967 | B2 | 12/2005 | Stegemeier et al. |
| 6,981,548 | B2 | 1/2006 | Wellington et al. |
| 6,981,553 | B2 | 1/2006 | Stegemeier et al. |
| 6,991,032 | B2 | 1/2006 | Berchenko et al. |
| 6,991,033 | B2 | 1/2006 | Wellington et al. |
| 6,991,036 | B2 | 1/2006 | Sumnu-Dindoruk et al. |
| 6,991,045 | B2 | 1/2006 | Vinegar et al. |
| 6,994,160 | B2 | 2/2006 | Wellington et al. |
| 6,994,168 | B2 | 2/2006 | Wellington et al. |
| 6,994,169 | B2 | 2/2006 | Zhang et al. |
| 6,995,646 | B1 | 2/2006 | Fromm et al. |
| 6,997,255 | B2 | 2/2006 | Wellington et al. |
| 6,997,518 | B2 | 2/2006 | Vinegar et al. |
| 7,004,247 | B2 | 2/2006 | Cole et al. |
| 7,004,251 | B2 | 2/2006 | Ward et al. |
| 7,011,154 | B2 | 3/2006 | Maher et al. |
| 7,013,972 | B2 | 3/2006 | Vinegar et al. |
| RE39,077 | E | 4/2006 | Eaton |
| 7,032,660 | B2 | 4/2006 | Vinegar et al. |
| 7,032,809 | B1 | 4/2006 | Hopkins |
| 7,036,583 | B2 | 5/2006 | de Rouffignac et al. |
| 7,040,397 | B2 | 5/2006 | de Rouffignac et al. |
| 7,040,398 | B2 | 5/2006 | Wellington et al. |
| 7,040,399 | B2 | 5/2006 | Wellington et al. |
| 7,040,400 | B2 | 5/2006 | de Rouffignac et al. |
| 7,048,051 | B2 | 5/2006 | McQueen |
| 7,051,807 | B2 | 5/2006 | Vinegar et al. |
| 7,051,808 | B1 | 5/2006 | Vinegar et al. |
| 7,051,811 | B2 | 5/2006 | de Rouffignac et al. |
| 7,055,600 | B2 | 6/2006 | Messier et al. |
| 7,055,602 | B2 | 6/2006 | Shpakoff et al. |
| 7,063,145 | B2 | 6/2006 | Veenstra et al. |
| 7,066,254 | B2 | 6/2006 | Vinegar et al. |
| 7,066,257 | B2 | 6/2006 | Wellington et al. |
| 7,073,578 | B2 | 7/2006 | Vinegar et al. |
| 7,077,198 | B2 | 7/2006 | Vinegar et al. |
| 7,077,199 | B2 | 7/2006 | Vinegar et al. |
| RE39,244 | E | 8/2006 | Eaton |
| 7,086,465 | B2 | 8/2006 | Wellington et al. |
| 7,086,468 | B2 | 8/2006 | de Rouffignac et al. |
| 7,090,013 | B2 | 8/2006 | Wellington et al. |
| 7,096,941 | B2 | 8/2006 | de Rouffignac et al. |
| 7,096,942 | B1 | 8/2006 | de Rouffignac et al. |
| 7,096,953 | B2 | 8/2006 | de Rouffignac et al. |
| 7,100,994 | B2 | 9/2006 | Vinegar et al. |
| 7,104,319 | B2 | 9/2006 | Vinegar et al. |
| 7,114,566 | B2 | 10/2006 | Vinegar et al. |
| 7,114,880 | B2 | 10/2006 | Carter |
| 7,121,341 | B2 | 10/2006 | Vinegar et al. |
| 7,121,342 | B2 | 10/2006 | Vinegar et al. |
| 7,128,150 | B2 | 10/2006 | Thomas et al. |
| 7,128,153 | B2 | 10/2006 | Vinegar et al. |
| 7,147,057 | B2 | 12/2006 | Steele et al. |
| 7,147,059 | B2 | 12/2006 | Vinegar et al. |
| 7,153,373 | B2 | 12/2006 | Maziasz et al. |
| 7,156,176 | B2 | 1/2007 | Vinegar et al. |
| 7,165,615 | B2 | 1/2007 | Vinegar et al. |
| 7,170,424 | B2 | 1/2007 | Vinegar et al. |
| 7,204,327 | B2 | 4/2007 | Livingstone |
| 7,219,734 | B2 | 5/2007 | Bai et al. |
| 7,225,866 | B2 | 6/2007 | Berchenko et al. |
| 7,259,688 | B2 | 8/2007 | Hirsch et al. |
| 7,320,364 | B2 | 1/2008 | Fairbanks |
| 7,331,385 | B2 | 2/2008 | Symington et al. |
| 7,353,872 | B2 | 4/2008 | Sandberg et al. |
| 7,357,180 | B2 | 4/2008 | Vinegar et al. |
| 7,360,588 | B2 | 4/2008 | Vinegar et al. |
| 7,370,704 | B2 | 5/2008 | Harris |
| 7,383,877 | B2 | 6/2008 | Vinegar et al. |
| 7,424,915 | B2 | 9/2008 | Vinegar |
| 7,426,959 | B2 | 9/2008 | Wang et al. |
| 7,431,076 | B2 | 10/2008 | Sandberg et al. |
| 7,435,037 | B2 | 10/2008 | McKinzie, II |
| 7,461,691 | B2 | 12/2008 | Vinegar et al. |
| 7,481,274 | B2 | 1/2009 | Vinegar et al. |
| 7,490,665 | B2 | 2/2009 | Sandberg et al. |
| 7,500,528 | B2 | 3/2009 | McKinzie et al. |
| 7,510,000 | B2 | 3/2009 | Pastor-Sanz et al. |
| 7,527,094 | B2 | 5/2009 | McKinzie et al. |
| 7,533,719 | B2 | 5/2009 | Hinson et al. |
| 7,540,324 | B2 | 6/2009 | de Rouffignac et al. |
| 7,546,873 | B2 | 6/2009 | Kim |
| 7,549,470 | B2 | 6/2009 | Vinegar et al. |
| 7,556,095 | B2 | 7/2009 | Vinegar |
| 7,556,096 | B2 | 7/2009 | Vinegar et al. |
| 7,559,367 | B2 | 7/2009 | Vinegar et al. |
| 7,559,368 | B2 | 7/2009 | Vinegar |
| 7,562,706 | B2 | 7/2009 | Li et al. |
| 7,562,707 | B2 | 7/2009 | Miller |
| 7,575,052 | B2 | 8/2009 | Sandberg et al. |
| 7,575,053 | B2 | 8/2009 | Vinegar et al. |
| 7,581,589 | B2 | 9/2009 | Roes et al. |
| 7,584,789 | B2 | 9/2009 | Mo et al. |
| 7,591,310 | B2 | 9/2009 | Minderhoud et al. |
| 7,597,147 | B2 | 10/2009 | Vitek et al. |
| 7,604,052 | B2 | 10/2009 | Roes et al. |
| 7,610,962 | B2 | 11/2009 | Fowler |

(56) References Cited

U.S. PATENT DOCUMENTS 7,631,689 B2 12/2009 Vinegar et al.
7,631,690 B2 12/2009 Vinegar et al.
7,635,023 B2 12/2009 Goldberg et al.
7,635,024 B2 12/2009 Karanikas et al.
7,635,025 B2 12/2009 Vinegar et al.
7,640,980 B2 1/2010 Vinegar et al.
7,644,765 B2 1/2010 Stegemeier et al.
7,673,681 B2 3/2010 Vinegar et al.
7,673,786 B2 3/2010 Menotti
7,677,310 B2 3/2010 Vinegar et al.
7,677,314 B2 3/2010 Hsu
7,681,647 B2 3/2010 Mudunuri et al.
7,683,296 B2 3/2010 Brady et al.
7,703,513 B2 4/2010 Vinegar et al.
7,717,171 B2 5/2010 Stegemeier et al.
7,730,945 B2 6/2010 Pieterson et al.
7,730,946 B2 6/2010 Vinegar et al.
7,730,947 B2 6/2010 Stegemeier et al.
7,735,935 B2 6/2010 Vinegar et al.
7,743,826 B2 6/2010 Harris
7,785,427 B2 8/2010 Maziasz et al.
7,793,722 B2 9/2010 Vinegar et al.
7,798,220 B2 9/2010 Vinegar et al.
7,798,221 B2 9/2010 Vinegar et al.
7,831,133 B2 11/2010 Vinegar et al.
7,831,134 B2 11/2010 Vinegar et al.
7,832,484 B2 11/2010 Nguyen et al.
7,841,401 B2 11/2010 Kuhlman et al.
7,841,408 B2 11/2010 Vinegar
7,841,425 B2 11/2010 Mansure et al.
7,845,411 B2 12/2010 Vinegar et al.
7,849,922 B2 12/2010 Vinegar et al.
7,860,377 B2 12/2010 Vinegar et al.
7,866,385 B2 1/2011 Lambirth
7,866,386 B2 1/2011 Beer
7,866,388 B2 1/2011 Bravo
7,931,086 B2 4/2011 Nguyen et al.
7,942,197 B2 5/2011 Fairbanks et al.
7,942,203 B2 5/2011 Vinegar et al.
7,950,453 B2 5/2011 Farmayan et al.
7,986,869 B2 7/2011 Vinegar et al.
8,027,571 B2 9/2011 Vinegar et al.
8,042,610 B2 10/2011 Harris et al.
8,070,840 B2 12/2011 Diaz et al.
8,083,813 B2 12/2011 Nair et al.
8,113,272 B2 2/2012 Vinegar
8,146,661 B2 4/2012 Bravo et al.
8,146,669 B2 4/2012 Mason
8,151,880 B2 4/2012 Roes et al.
8,162,043 B2 4/2012 Burnham et al.
8,162,059 B2 4/2012 Nguyen et al.
8,177,305 B2 5/2012 Burns et al.
8,191,630 B2 6/2012 Stegemeier et al.
8,196,658 B2 6/2012 Miller et al.
8,200,072 B2 6/2012 Vinegar et al.
8,220,539 B2 7/2012 Vinegar et al.
8,224,164 B2 7/2012 Sandberg et al.
8,224,165 B2 7/2012 Vinegar et al.
8,225,866 B2 7/2012 de Rouffignac
8,230,927 B2 7/2012 Fairbanks et al.
8,233,782 B2 7/2012 Vinegar et al.
8,238,730 B2 8/2012 Sandberg et al.
8,240,774 B2 8/2012 Vinegar et al.
8,261,832 B2 9/2012 Ryan
8,267,170 B2 9/2012 Fowler et al.
8,267,185 B2 9/2012 Ocampos et al.
8,276,661 B2 10/2012 Costello et al.
8,281,861 B2 10/2012 Nguyen et al.
8,327,932 B2 12/2012 Karanikas
8,355,623 B2 1/2013 Vinegar et al.
8,381,815 B2 2/2013 Karanikas et al.
8,434,555 B2 5/2013 Bos et al.
8,450,540 B2 5/2013 Roes et al.
8,459,359 B2 6/2013 Vinegar
8,485,252 B2 7/2013 de Rouffignac
8,485,256 B2 7/2013 Bass et al.
8,485,847 B2 7/2013 Tilley
8,502,120 B2 8/2013 Bass et al.
8,536,497 B2 9/2013 Kim
8,555,971 B2 10/2013 Vinegar et al.
8,562,078 B2 10/2013 Burns et al.
8,606,091 B2 12/2013 John et al.
8,627,887 B2 1/2014 Vinegar et al.
8,631,866 B2 1/2014 Nguyen
8,636,323 B2 1/2014 Prince-Wright et al.
8,662,175 B2 3/2014 Karanikas et al.
8,701,768 B2 4/2014 Marino et al.
8,701,769 B2 4/2014 Beer
2002/0027001 A1 3/2002 Wellington et al.
2002/0028070 A1 3/2002 Holen
2002/0033253 A1 3/2002 de Rouffignac et al.
2002/0036089 A1 3/2002 Vinegar et al.
2002/0038069 A1 3/2002 Wellington et al.
2002/0040779 A1 4/2002 Wellington et al.
2002/0040780 A1 4/2002 Wellington et al.
2002/0053431 A1 5/2002 Wellington et al.
2002/0076212 A1 6/2002 Zhang et al.
2002/0112890 A1 8/2002 Wentworth et al.
2002/0112987 A1 8/2002 Hou et al.
2002/0153141 A1 10/2002 Hartman et al.
2003/0029617 A1 2/2003 Brown et al.
2003/0066642 A1 4/2003 Wellington et al.
2003/0079877 A1 5/2003 Wellington et al.
2003/0085034 A1 5/2003 Wellington et al.
2003/0131989 A1 7/2003 Zakiewicz
2003/0146002 A1 8/2003 Vinegar et al.
2003/0157380 A1 8/2003 Assarabowski et al.
2003/0196789 A1 10/2003 Wellington et al.
2003/0201098 A1 10/2003 Karanikas et al.
2004/0035582 A1 2/2004 Zupanick
2004/0140096 A1 7/2004 Sandberg et al.
2004/0144540 A1 7/2004 Sandberg et al.
2004/0146288 A1 7/2004 Vinegar et al.
2004/0211554 A1* 10/2004 Vinegar et al. ..... 166/60
2005/0006097 A1 1/2005 Sandberg et al.
2005/0045325 A1 3/2005 Yu
2005/0269313 A1 12/2005 Vinegar et al.
2006/0052905 A1 3/2006 Pfingsten et al.
2006/0116430 A1 6/2006 Wentink
2006/0289536 A1 12/2006 Vinegar et al.
2007/0044957 A1 3/2007 Watson et al.
2007/0045267 A1 3/2007 Vinegar et al.
2007/0045268 A1 3/2007 Vinegar et al.
2007/0108201 A1 5/2007 Vinegar et al.
2007/0119098 A1 5/2007 Diaz et al.
2007/0127897 A1 6/2007 John et al.
2007/0131428 A1 6/2007 den Boestert et al.
2007/0133959 A1 6/2007 Vinegar et al.
2007/0133960 A1 6/2007 Vinegar et al.
2007/0137856 A1 6/2007 McKinzie et al.
2007/0137857 A1 6/2007 Vinegar et al.
2007/0144732 A1 6/2007 Kim et al.
2007/0193743 A1 8/2007 Harris et al.
2007/0246994 A1 10/2007 Kaminsky et al.
2008/0006410 A1 1/2008 Looney et al.
2008/0017380 A1 1/2008 Vinegar et al.
2008/0017416 A1 1/2008 Watson et al.
2008/0035346 A1 2/2008 Nair et al.
2008/0035347 A1 2/2008 Brady et al.
2008/0035705 A1 2/2008 Menotti
2008/0038144 A1 2/2008 Maziasz et al.
2008/0048668 A1 2/2008 Mashikian
2008/0078551 A1 4/2008 De Vault et al.
2008/0078552 A1 4/2008 Donnelly et al.
2008/0128134 A1 6/2008 Mudunuri et al.
2008/0135253 A1 6/2008 Vinegar et al.
2008/0135254 A1 6/2008 Vinegar et al.
2008/0142216 A1 6/2008 Vinegar et al.
2008/0142217 A1 6/2008 Pieterson et al.
2008/0173442 A1 7/2008 Vinegar et al.
2008/0173444 A1 7/2008 Stone et al.
2008/0174115 A1 7/2008 Lambirth
2008/0185147 A1 8/2008 Vinegar et al.
2008/0217003 A1 9/2008 Kuhlman et al.

(56) References Cited

U.S. PATENT DOCUMENTS

| | | | | |
|---|---|---|---|---|
| 2008/0217016 | A1 | 9/2008 | Stegemeier et al. | |
| 2008/0217321 | A1 | 9/2008 | Vinegar et al. | |
| 2008/0236831 | A1 | 10/2008 | Hsu et al. | |
| 2008/0277113 | A1 | 11/2008 | Stegemeier et al. | |
| 2008/0283241 | A1 | 11/2008 | Kaminsky et al. | |
| 2009/0014180 | A1 | 1/2009 | Stegemeier et al. | |
| 2009/0014181 | A1* | 1/2009 | Vinegar et al. | 166/302 |
| 2009/0038795 | A1 | 2/2009 | Kaminsky | |
| 2009/0071652 | A1 | 3/2009 | Vinegar et al. | |
| 2009/0078461 | A1 | 3/2009 | Mansure et al. | |
| 2009/0084547 | A1 | 4/2009 | Farmayan et al. | |
| 2009/0090158 | A1 | 4/2009 | Davidson et al. | |
| 2009/0090509 | A1 | 4/2009 | Vinegar et al. | |
| 2009/0095476 | A1 | 4/2009 | Nguyen et al. | |
| 2009/0095477 | A1 | 4/2009 | Nguyen et al. | |
| 2009/0095478 | A1 | 4/2009 | Karanikas et al. | |
| 2009/0095479 | A1 | 4/2009 | Karanikas et al. | |
| 2009/0095480 | A1 | 4/2009 | Vinegar et al. | |
| 2009/0101346 | A1 | 4/2009 | Vinegar et al. | |
| 2009/0120646 | A1 | 5/2009 | Kim et al. | |
| 2009/0126929 | A1 | 5/2009 | Vinegar | |
| 2009/0139716 | A1 | 6/2009 | Brock et al. | |
| 2009/0189617 | A1 | 7/2009 | Burns et al. | |
| 2009/0194269 | A1 | 8/2009 | Vinegar | |
| 2009/0194287 | A1 | 8/2009 | Nguyen et al. | |
| 2009/0194329 | A1 | 8/2009 | Guimerans et al. | |
| 2009/0194333 | A1 | 8/2009 | MacDonald | |
| 2009/0194524 | A1 | 8/2009 | Kim et al. | |
| 2009/0200023 | A1 | 8/2009 | Costello et al. | |
| 2009/0200025 | A1 | 8/2009 | Bravo et al. | |
| 2009/0200031 | A1 | 8/2009 | Miller | |
| 2009/0200290 | A1 | 8/2009 | Cardinal et al. | |
| 2009/0200854 | A1 | 8/2009 | Vinegar | |
| 2009/0228222 | A1 | 9/2009 | Fantoni | |
| 2009/0260811 | A1 | 10/2009 | Cui et al. | |
| 2009/0260824 | A1 | 10/2009 | Burns et al. | |
| 2009/0272526 | A1 | 11/2009 | Burns et al. | |
| 2009/0272535 | A1 | 11/2009 | Burns et al. | |
| 2009/0272536 | A1 | 11/2009 | Burns et al. | |
| 2009/0272578 | A1 | 11/2009 | McDonald | |
| 2009/0321417 | A1 | 12/2009 | Burns et al. | |
| 2010/0071903 | A1 | 3/2010 | Prince-Wright et al. | |
| 2010/0071904 | A1 | 3/2010 | Burns et al. | |
| 2010/0089584 | A1 | 4/2010 | Burns | |
| 2010/0089586 | A1 | 4/2010 | Stanecki | |
| 2010/0096137 | A1 | 4/2010 | Nguyen et al. | |
| 2010/0101783 | A1 | 4/2010 | Vinegar et al. | |
| 2010/0101784 | A1 | 4/2010 | Vinegar et al. | |
| 2010/0101794 | A1 | 4/2010 | Ryan | |
| 2010/0108310 | A1 | 5/2010 | Fowler et al. | |
| 2010/0108379 | A1 | 5/2010 | Edbury et al. | |
| 2010/0155070 | A1 | 6/2010 | Roes et al. | |
| 2010/0258265 | A1 | 10/2010 | Karanikas et al. | |
| 2010/0258290 | A1 | 10/2010 | Bass | |
| 2010/0258291 | A1 | 10/2010 | de St. Remey et al. | |
| 2010/0258309 | A1 | 10/2010 | Ayodele et al. | |
| 2010/0288497 | A1 | 11/2010 | Burnham et al. | |
| 2011/0042085 | A1 | 2/2011 | Diehl | |
| 2011/0108269 | A1 | 5/2011 | Van Den Berg et al. | |
| 2011/0132600 | A1 | 6/2011 | Kaminsky et al. | |
| 2011/0247802 | A1 | 10/2011 | Deeg et al. | |
| 2011/0247811 | A1 | 10/2011 | Beer | |
| 2011/0247814 | A1 | 10/2011 | Karanikas et al. | |
| 2011/0247819 | A1 | 10/2011 | Nguyen et al. | |
| 2011/0247820 | A1 | 10/2011 | Marino et al. | |
| 2011/0259590 | A1 | 10/2011 | Burnham et al. | |
| 2012/0018421 | A1 | 1/2012 | Parman et al. | |
| 2012/0205109 | A1 | 8/2012 | Burnham et al. | |
| 2013/0269935 | A1 | 10/2013 | Cao et al. | |

FOREIGN PATENT DOCUMENTS

| | | |
|---|---|---|
| CA | 1196594 | 11/1985 |
| CA | 1253555 | 5/1989 |
| CA | 1288043 | 8/1991 |
| CA | 2015460 | 10/1991 |
| EP | 107927 | 5/1984 |
| EP | 130671 | 9/1985 |
| EP | 0940558 | 9/1999 |
| GB | 156396 | 1/1921 |
| GB | 674082 | 7/1950 |
| GB | 1010023 | 11/1965 |
| GB | 1204405 | 9/1970 |
| GB | 1454324 | 11/1976 |
| SE | 121737 | 5/1948 |
| SE | 123136 | 11/1948 |
| SE | 123137 | 11/1948 |
| SE | 123138 | 11/1948 |
| SE | 126674 | 11/1949 |
| SU | 1836876 | 12/1990 |
| WO | 9506093 | 3/1995 |
| WO | 97/23924 | 7/1997 |
| WO | 9901640 | 1/1999 |
| WO | 00/19061 | 4/2000 |
| WO | 0181505 | 11/2001 |
| WO | 2008048448 | 4/2008 |

OTHER PUBLICATIONS

High-Pressure Pyrolysis of Colorado Oil Shale, Alan K. Burnham & Mary F. Singleton, Oct. 1982 (23 pages).

A Possible Mechanism of Alkene/Alkane Production in Oil Shale Retorting, A.K. Burnham, R.L. Ward, Nov. 26, 1980 (20 pages).

Enthalpy Relations for Eastern Oil Shale, David W. Camp, Nov. 1987 (13 pages).

Oil Shale Retorting: Part 3 A Correlation of Shale Oil 1-Alkene/n-Alkane Ratios With Yield, Coburn et al., Aug. 1, 1977 (18 pages).

The Composition of Green River Shale Oil, Glen L. Cook, et al., 1968 (12 pages).

Thermal Degradation of Green River Kerogen at 150o to 350o C Rate of Production Formation, J.J. Cummins & W.E. Robinson, 1972 (18 pages).

Retorting of Green River Oil Shale Under High-Pressure Hydrogen Atmospheres, LaRue et al., Jun. 1977 (38 pages).

Retorting and Combustion Processes in Surface Oil-Shale Retorts, A.E. Lewis & R.L. Braun, May 2, 1980 (12 pages).

Oil Shale Retorting Processes: A Technical Overview, Lewis et al., Mar. 1984 (18 pages).

Study of Gas Evolution During Oil Shale Pyrolysis by TQMS, Oh et al., Feb. 1988 (10 pages).

The Permittivity and Electrical Conductivity of Oil Shale, A.J. Piwinskii & A. Duba, Apr. 28, 1975 (12 pages).

Oil Degradation During Oil Shale Retorting, J.H. Raley & R.L. Braun, May 24, 1976 (14 pages).

Kinetic Analysis of California Oil Shale by Programmed Temperature Microphyrolysis, John G. Reynolds & Alan K. Burnham, Dec. 9, 1991 (14 pages).

Analysis of Oil Shale and Petroleum Source Rock Pyrolysis by Triple Quadrupole Mass Spectrometry: Comparisons of Gas Evolution at the Heating Rate of 10oC/Min., Reynolds et al. Oct. 5, 1990 (57 pages).

Fluidized-Bed Pyrolysis of Oil Shale, J.H. Richardson & E.B. Huss, Oct. 1981 (27 pages).

Retorting Kinetics for Oil Shale From Fluidized-Bed Pyrolysis, Richardson et al., Dec. 1981 (30 pages).

Recent Experimental Developments in Retorting Oil Shale at the Lawrence Livermore Laboratory, Albert J. Rothman, Aug. 1978 (32 pages).

The Lawrence Livermore Laboratory Oil Shale Retorts, Sandholtz et al. Sep. 18, 1978 (30 pages).

Operating Laboratory Oil Shale Retorts in an In-Situ Mode, W. A. Sandholtz et al., Aug. 18, 1977 (16 pages).

Some Relationships of Thermal Effects to Rubble-Bed Structure and Gas-Flow Patterns in Oil Shale Retorts, W. A. Sandholtz, Mar. 1980 (19 pages).

Assay Products from Green River Oil Shale, Singleton et al., Feb. 18, 1986 (213 pages).

Biomarkers in Oil Shale: Occurrence and Applications, Singleton et al., Oct. 1982 (28 pages).

(56) References Cited

OTHER PUBLICATIONS

Occurrence of Biomarkers in Green River Shale Oil, Singleton et al., Mar. 1983 (29 pages).
An Instrumentation Proposal for Retorts in the Demonstration Phase of Oil Shale Development, Clyde J. Sisemore, Apr. 19, 1977, (34 pages).
Pyrolysis Kinetics for Green River Oil Shale From the Saline Zone, Burnham et al., Feb. 1982 (33 pages).
SO2 Emissions from the Oxidation of Retorted Oil Shale, Taylor et al., Nov. 1981 (9 pages).
Nitric Oxide (NO) Reduction by Retorted Oil Shale, R.W. Taylor & C.J. Morris, Oct. 1983 (16 pages).
Coproduction of Oil and Electric Power from Colorado Oil Shale, P. Henrik Wallman, Sep. 24, 1991 (20 pages).
13C NMR Studies of Shale Oil, Raymond L. Ward & Alan K. Burnham, Aug. 1982 (22 pages).
Identification by 13C NMR of Carbon Types in Shale Oil and their Relationship to Pyrolysis Conditions, Raymond L. Ward & Alan K. Burnham, Sep. 1983 (27 pages).
A Laboratory Study of Green River Oil Shale Retorting Under Pressure in a Nitrogen Atmosphere, Wise et al., Sep. 1976 (24 pages).
Quantitative Analysis and Evolution of Sulfur-Containing Gases from Oil Shale Pyrolysis by Triple Quadrupole Mass Spectrometry, Wong et al., Nov. 1983 (34 pages).
Quantitative Analysis & Kinetics of Trace Sulfur Gas Species from Oil Shale Pyrolysis by Triple Quadrupole Mass Spectrometry (TQMS), Wong et al., Jul. 5-7, 1983 (34 pages).
Application of Self-Adaptive Detector System on a Triple Quadrupole MS/MS to High Expolsives and Sulfur-Containing Pyrolysis Gases from Oil Shale, Carla M. Wong & Richard W. Crawford, Oct. 1983 (17 pages).
An Evaluation of Triple Quadrupole MS/MS for On-Line Gas Analyses of Trace Sulfur Compounds from Oil Shale Processing, Wong et al., Jan. 1985 (30 pages).
General Model of Oil Shale Pyrolysis, Alan K. Burnham & Robert L. Braun, Nov. 1983 (22 pages).
Proposed Field Test of the Lins Mehtod Thermal Oil Recovery Process in Athabasca McMurray Tar Sands McMurray, Alberta; Husky Oil Company cody, Wyoming, circa 1960.
In Situ Measurement of Some Thermoporoelastic Parameters of a Granite, Berchenko et al., Poromechanics, A Tribute to Maurice Biot, 1998, p. 545-550.
Tar and Pitch, G. Collin and H. Hoeke. Ullmann's Encyclopedia of Industrial Chemistry, vol. A 26, 1995, p. 91-127.
Geology for Petroleum Exploration, Drilling, and Production. Hyne, Norman J. McGraw-Hill Book Company, 1984, p. 264.
Burnham, Alan, K. "Oil Shale Retorting Dependence of timing and composition on temperature and heating rate", Jan. 27, 1995, (23 pages).
Campbell, et al., "Kinetics of oil generation from Colorado Oil Shale" IPC Business Press, Fuel, 1978, (3 pages).
Canadian Office Action for Canadian Application No. 2,668,389 mailed Mar. 14, 2011, 3 pages.
Canadian Patent and Trademark Office, Office Action for Canadian Patent Application No. 2,668,385, mailed Dec. 3, 2010.
Australian Patent and Trademark Office, "Examiner's First Report" for Australian Patent Application No. 2008242797, mailed Nov. 24, 2010.
Rangel-German et al., "Electrical-Heating-Assisted Recovery for Heavy Oil", pp. 1-43, 2004.
Kovscek, Anthony R., "Reservoir Engineering analysis of Novel Thermal Oil Recovery Techniques applicable to Alaskan North Slope Heavy Oils", pp. 1-6 circa 2004.
Bosch et al. "Evaluation of Downhole Electric Impedance Heating Systems for Paraffin Control in Oil Wells," IEEE Transactions on Industrial Applications, 1991, vol. 28; pp. 190-194.
"McGee et al. "Electrical Heating with Horizontal Wells, The heat Transfer Problem," International Conference on Horizontal Well Tehcnology, Calgary, Alberta Canada, 1996; 14 pages" .
Hill et al., "The Characteristics of a Low Temperature in situ Shale Oil" American Institute of Mining, Metallurgical & Petroleum Engineers, 1967 (pp. 75-90).
Rouffignac, E. In Situ Resistive Heating of Oil Shale for Oil Production—A Summary of the Swedish Data, (4 pages), published prior to Oct. 2001.
SSAB report, "A Brief Description of the Ljungstrom Method for Shale Oil Production," 1950, (12 pages).
Salomonsson G., SSAB report, The Lungstrom in Situ-Method for Shale Oil Recovery, 1950 (28 pages).
"Swedish shale oil-Production method in Sweden," Organisation for European Economic Co-operation, 1952, (70 pages).
SSAB report, "Kvarn Torp" 1958, (36 pages).
SSAB report, "Kvarn Torp" 1951 (35 pages).
SSAB report, "Summary study of the shale oil works at Narkes Kvarntorp" (15 pages), published prior to Oct. 2001.
Vogel et al. "An Analog Computer for Studying Heat Transfrer during a Thermal Recovery Process," AIME Petroleum Transactions, 1955 (pp. 205-212).
SAAB report, "The Swedish Shale Oil Industry," 1948 (8 pages).
Gejrot et al., "The Shale Oil Industry in Sweden," Carlo Colombo Publishers-Rome, Proceedings of the Fourth World Petroleum Congress, 1955 (8 pages).
Hedback, T. J., The Swedish Shale as Raw Material for Production of Power, Oil and Gas, XIth Sectional Meeting World Power Conference, 1957 (9 pages).
SAAB, "Santa Cruz, California, Field Test of the Lins Method for the Recovery of Oil from Sand", 1955, vol. 1, (141 pages) English.
SAAB, "Santa Cruz, California, Field Test of the Lins Method for the Recovery of Oil from Sand-Figures", 1955 vol. 2, (146 pages) English.
Helander, R.E., "Santa Cruz, California, Field Test of Carbon Steel Burner Casings for the Lins Method of Oil Recovery", 1959 (38 pages) English.
Helander et al., Santa Cruz, California, Field Test of Fluidized Bed Burners for the Lins Method of Oil Recovery 1959, (86 pages) English.
"Lins Burner Test Results-English" 1959-1960, (148 pages).
SAAB, "Photos", (18 pages), published prior to Oct. 2001.
"IEEE Recommended Practice for Electrical Impedance, Induction, and Skin Effect Heating of Pipelines and Vessels," IEEE Std. 844-200, 2000; 6 pages.
Moreno, James B., et al., Sandia National Laboratories, "Methods and Energy Sources for Heating Subsurface Geological Formations, Task 1: Heat Delivery Systems," Nov. 20, 2002, pp. 1-166.
Some Effects of Pressure on Oil-Shale Retorting, Society of Petroleum Engineers Journal, J.H. Bae, Sep. 1969; pp. 287-292.
New in situ shale-oil recovery process uses hot natural gas; The Oil & Gas Journal; May 16, 1966, p. 151.
Evaluation of Downhole Electric Impedance Heating Systems for Paraffin Control in Oil Wells; Industry Applications Society 37th Annual Petroleum and Chemical Industry Conference; The Institute of Electrical and Electronics Engineers Inc., Bosch et al., Sep. 1990, pp. 223-227.
New System Stops Paraffin Build-up; Petroleum Engineer, Eastlund et al., Jan. 1989, (3 pages).
Oil Shale Retorting: Effects of Particle Size and Heating Rate on Oil Evolution and Intraparticle Oil Degradation; Campbell et al. In Situ 2(1), 1978, pp. 1-47.
The Potential for In Situ Retorting of Oil Shale in the Piceance Creek Basin of Northwestern Colorado; Dougan et al., Quarterly of the Colorado School of Mines, pp. 57-72, , 1970.
Retoring Oil Shale Underground—Problems & Possibilities; B.F. Grant, Qtly of Colorado School of Mines, pp. 39-46, 1960.
Molecular Mechanism of Oil Shale Pyrolysis in Nitrogen and Hydrogen Atmospheres, Hershkowitz et al.; Geochemistry and Chemistry of Oil Shales, American Chemical Society, May 1983 pp. 301-316.
The Characteristics of a Low Temperature in Situ Shale Oil; George Richard Hill & Paul Dougan, Quarterly of the Colorado School of Mines, 1967; pp. 75-90.
Direct Production of a Low Pour Point High Gravity Shale Oil; Hill et al., I & EC Product Research and Development, 6(1), Mar. 1967; pp. 52-59.

(56) References Cited

OTHER PUBLICATIONS

Refining of Swedish Shale Oil, L. Lundquist, pp. 621-627, 1951.
The Benefits of In Situ Upgrading Reactions to the Integrated Operations of the Orinoco Heavy-Oil Fields and Downstream Facilities, Myron Kuhlman, Society of Petroleum Engineers, Jun. 2000; pp. 1-14.
Monitoring Oil Shale Retorts by Off-Gas Alkene/Alkane Ratios, John H. Raley, Fuel, vol. 59, Jun. 1980, pp. 419-424.
The Shale Oil Question, Old and New Viewpoints, A Lecture in the Engineering Science Academy, Dr. Fredrik Ljungstrom, Feb. 23, 1950, published in Teknisk Trdskrift, Jan. 1951 p. 33-40.
Underground Shale Oil Pyrolysis According to the Ljungstroem Method; Svenska Skifferolje Aktiebolaget (Swedish Shale Oil Corp. ), IVA, vol. 24, 1953, No. 3, pp. 118-123.
Kinetics of Low-Temperature Pyrolysis of Oil Shale by the IITRI RF Process, Sresty et al.; 15th Oil Shale Symposium, Colorado School of Mines, Apr. 1982 pp. 1-13.
Bureau of Mines Oil-Shale Research, H.M. Thorne, Quarterly of the Colorado School of Mines, pp. 77-90, 1964.
Application of a Microretort to Problems in Shale Pyrolysis, A. W. Weitkamp & L.C. Gutberlet, Ind. Eng. Chem. Process Des. Develop. vol. 9, No. 3, 1970, pp. 386-395.
Oil Shale, Yen et al., Developments in Petroleum Science 5, 1976, pp. 187-189, 197-198.
The Composition of Green River Shale Oils, Glenn L. Cook, et al., United Nations Symposium on the Development and Utilization of Oil Shale Resources, 1968, pp. 1-23.
High-Pressure Pyrolysis of Green River Oil Shale, Burnham et al., Geochemistry and Chemistry of Oil Shales, American Chemical Society, 1983, pp. 335-351.
Geochemistry and Pyrolysis of Oil Shales, Tissot et al., Geochemistry and Chemistry of Oil Shales, American Chemical Society, 1983, pp. 1-11.
A Possible Mechanism of Alkene/Alkane Production, Burnham et al., Oil Shale, Tar Sands, and Related Materials, American Chemical Society, 1981, pp. 79-92.
The Ljungstroem In-Situ Method of Shale Oil Recovery, G. Salomonsson, Oil Shale and Cannel Coal, vol. 2, Proceedings of the Second Oil Shale and Cannel Coal Conference, Institute of Petroleum, 1951, London, pp. 260-280.
Developments in Technology for Green River Oil Shale, G.U. Dinneen, United Nations Symposium on the Development and Utilization of Oil Shale Resources, Laramie Petroleum Research Center, Bureau of Mines, 1968, pp. 1-20.
The Thermal and Structural Properties of a Hanna Basin Coal, R.E. Glass, Transactions of the ASME, vol. 106, Jun. 1984, pp. 266-271.
On the Mechanism of Kerogen Pyrolysis, Alan K. Burnham & James A. Happe, Jan. 10, 1984 (17 pages).
Comparison of Methods for Measuring Kerogen Pyrolysis Rates and Fitting Kinetic Parameters, Burnham et al., Mar. 23, 1987, (29 pages).
Further Comparison of Methods for Measuring Kerogen Pyrolysis Rates and Fitting Kinetic Parameters, Bumham et al., Sep. 1987, (16 pages).
Shale Oil Cracking Kinetics and Diagnostics, Bissell et al., Nov. 1983, (27 pages).
Mathematical Modeling of Modified In Situ and Aboveground Oil Shale Retorting, Robert L. Braun, Jan. 1981 (45 pages).
Progress Report on Computer Model for In Situ Oil Shale Retorting, R.L. Braun & R.C.Y. Chin, Jul. 14, 1977 (34 pages).
Chemical Kinetics and Oil Shale Process Design, Alan K. Burnham, Jul. 1993 (16 pages).
Reaction Kinetics and Diagnostics for Oil Shale Retorting, Alan K. Burnham, Oct. 19, 1981 (32 pages).
Reaction Kinetics Between Steam and Oil Shale Char, A.K. Burnham, Oct. 1978 (8 pages).
General Kinetic Model of Oil Shale Pyrolysis, Alan K. Burnham & Robert L. Braun, Dec. 1984 (25 pages).
Japanese Patent Office, translated Office Action for JP Application No. 2009-53350, mailed Sep. 15, 2012, 3 pages.
Chinese Communication for Chinese Application No. 200680044203.4, mailed Nov. 23, 2012, 9 pages.
Chinese Communication for Chinese Application No. 200780014228.4, mailed Dec. 5, 2012, 7 pages.
Great Britain Communication for Great Britian Application No. GB1003951.9, mailed Aug. 1, 2011. 5 pages.
Korean Communication for Korean Application No. 2008-7012458, mailed Jun. 24, 2013, 4 pages.
U.S. Patent and Trademark Office, Office Communication for U.S. Appl. No. 13/083,289; mailed May 17, 2013.
U.S. Patent and Trademark Office, Office Communication for U.S. Appl. No. 12/757,621; mailed Apr. 8, 2013.
U.S. Patent and Trademark Office, Office Communication for U.S. Appl. No. 12/757,621; mailed Jul. 1 2013.
U.S. Patent and Trademark Office, Office Communication for U.S. Appl. No. 12/757,621; mailed May 10, 2012, 4 pages.
U.S. Patent and Trademark Office, Office Communication for U.S. Appl. No. 12/757,621; mailed Oct. 24, 2012, 4 pages.
U.S. Patent and Trademark Office, Office Communication for U.S. Appl. No. 12/105,997; mailed Dec. 29, 2010.
U.S. Patent and Trademark Office, Office Communication for U.S. Appl. No. 12/105,997; mailed Jul. 18, 2011.
U.S. Patent and Trademark Office, Office Communication for U.S. Appl. No. 12/105,997; mailed Jun. 28, 2013.
U.S. Patent and Trademark Office, Office Communication for U.S. Appl. No. 12/105,974; mailed Nov. 29, 2012.
U.S. Patent and Trademark Office, Office Communication for U.S. Appl. No. 12/105,974; mailed Sep. 27, 2010.
U.S. Patent and Trademark Office, Office Communication for U.S. Appl. No. 12/105,974; mailed Feb. 10, 2011.
U.S. Patent and Trademark Office, Office Communication for U.S. Appl. No. 12/105,974; mailed Aug. 23, 2012.
U.S. Patent and Trademark Office, Office Communication for U.S. Appl. No. 12/105,974; mailed Feb. 11, 2013.
U.S. Patent and Trademark Office, Office Communication for U.S. Appl. No. 13/485,464; mailed Feb. 12, 2013.
U.S. Patent and Trademark Office, Office Communication for U.S. Appl. No. 12/576,845; mailed Jan. 19, 2012.
U.S. Patent and Trademark Office, Office Communication for U.S. Appl. No. 12/576,845; mailed Jul. 27, 2012.
U.S. Patent and Trademark Office, Office Communication for U.S. Appl. No. 12/329,942; mailed Mar. 18, 2011.
U.S. Patent and Trademark Office, Office Communication for U.S. Appl. No. 12/329,942; mailed Aug. 30, 2011.
U.S. Patent and Trademark Office, Office Communication for U.S. Appl. No. 12/767,572; mailed May 19, 2011.
U.S. Patent and Trademark Office, Office Communication for U.S. Appl. No. 12/767,572; mailed Dec. 22, 2010.
U.S. Patent and Trademark Office, Office Communication for U.S. Appl. No. 12/767,572; mailed Oct. 6, 2011.
U.S. Patent and Trademark Office, Office Communication for U.S. Appl. No. 12/767,572; Mar. 14, 2012.
Canadian Office Action for Canadian Application No. 2,668,392 mailed Mar. 2, 2011, 2 pages.
U.S. Patent and Trademark "Office Communication" for U.S. Appl. No. 13/644,294, mailed Oct. 31, 2013.
U.S. Patent and Trademark Office, Office Communication for U.S. Appl. No. 12/105,974; mailed Dec. 6, 2013.
U.S. Patent and Trademark Office, Office Communication for U.S. Appl. No. 12/757,621; mailed Dec. 6, 2013.
Canadian Communication for Canadian Patent Application No. 2,649,503, mailed Jul. 17, 2013, 2 pages.
U.S. Patent and Trademark Office, Office Communication for U.S. Appl. No. 13/083,289; mailed Dec. 24, 2013.
U.S. Patent and Trademark Office, Office Communication for U.S. Appl. No. 13/083,289; mailed Mar. 7, 2014.
United States Patent and Trademark "Office Communication" for U.S. Appl. No. 13/644,294, mailed Mar. 24, 2014.
U.S. Patent and Trademark Office, Office Communication for U.S. Appl. No. 12/105,974; mailed Mar. 27, 2014.
U.S. Patent and Trademark Office, Office Communication for U.S. Appl. No. 12/105,974; mailed Jul. 10, 2014.

(56) References Cited

OTHER PUBLICATIONS

U.S. Patent and Trademark Office, Office Communication for U.S. Appl. No. 12/105,974; mailed Aug. 1, 2014.
U.S. Patent and Trademark Office, Office Communication for U.S. Appl. No. 12/757,621; mailed Mar. 10, 2013.
U.S. Patent and Trademark Office, Office Communication for U.S. Appl. No. 13/083,289; mailed Sep. 10, 2014.
U.S. Patent and Trademark "Office Communication" for U.S. Appl. No. 13/644,294, mailed May 23, 2014.
U.S. Patent and Trademark "Office Communication" for U.S. Appl. No. 13/644,294, mailed Jul. 25, 2014.

* cited by examiner

METHODOLOGIES FOR TREATMENT OF HYDROCARBON FORMATIONS USING STAGED PYROLYZATION

PRIORITY CLAIM

This patent application claims priority to U.S. Provisional Patent No. 61/322,647 entitled "METHODOLOGIES FOR TREATING SUBSURFACE HYDROCARBON FORMATIONS" to Karanikas et al. filed on Apr. 9, 2010; and U.S. Provisional Patent No. 61/322,513 entitled "TREATMENT METHODOLOGIES FOR SUBSURFACE HYDROCARBON CONTAINING FORMATIONS" to Bass et al. filed on Apr. 9, 2010, all of which are incorporated by reference in their entirety.

RELATED PATENTS

This patent application incorporates by reference in its entirety each of U.S. Pat. No. 6,688,387 to Wellington et al.; U.S. Pat. No. 6,991,036 to Sumnu-Dindoruk et al.; U.S. Pat. No. 6,698,515 to Karanikas et al.; U.S. Pat. No. 6,880,633 to Wellington et al.; U.S. Pat. No. 6,782,947 to de Rouffignac et al.; U.S. Pat. No. 6,991,045 to Vinegar et al.; U.S. Pat. No. 7,073,578 to Vinegar et al.; U.S. Pat. No. 7,121,342 to Vinegar et al.; U.S. Pat. No. 7,320,364 to Fairbanks; U.S. Pat. No. 7,527,094 to McKinzie et al.; U.S. Pat. No. 7,584,789 to Mo et al.; U.S. Pat. No. 7,533,719 to Hinson et al.; U.S. Pat. No. 7,562,707 to Miller; U.S. Pat. No. 7,841,408 to Vinegar et al.; U.S. Pat. No. 7,866,388 to Bravo; and U.S. Pat. No. 8,281,861 to Nguyen et al.; and U.S. Patent Application Publication No. 2010-0071903 to Prince Wright et al.

BACKGROUND

1. Field of the Invention

The present invention relates generally to methods and systems for production of hydrocarbons, hydrogen, and/or other products from various subsurface formations such as hydrocarbon containing formations.

2. Description of Related Art

Hydrocarbons obtained from subterranean formations are often used as energy resources, as feedstocks, and as consumer products. Concerns over depletion of available hydrocarbon resources and concerns over declining overall quality of produced hydrocarbons have led to development of processes for more efficient recovery, processing and/or use of available hydrocarbon resources. In situ processes may be used to remove hydrocarbon materials from subterranean formations that were previously inaccessible and/or too expensive to extract using available methods. Chemical and/or physical properties of hydrocarbon material in a subterranean formation may need to be changed to allow hydrocarbon material to be more easily removed from the subterranean formation and/or increase the value of the hydrocarbon material. The chemical and physical changes may include in situ reactions that produce removable fluids, composition changes, solubility changes, density changes, phase changes, and/or viscosity changes of the hydrocarbon material in the formation.

Large deposits of heavy hydrocarbons (heavy oil and/or tar) contained in relatively permeable formations (for example, in tar sands) are found in North America, South America, Africa, and Asia. Tar can be surface-mined and upgraded to lighter hydrocarbons such as crude oil, naphtha, kerosene, and/or gas oil. Surface milling processes may further separate the bitumen from sand. The separated bitumen may be converted to light hydrocarbons using conventional refinery methods. Mining and upgrading tar sand is usually substantially more expensive than producing lighter hydrocarbons from conventional oil reservoirs.

In situ production of hydrocarbons from tar sand may be accomplished by heating and/or injecting fluids into the formation. U.S. Pat. No. 4,084,637 to Todd; U.S. Pat. No. 4,926,941 to Glandt et al.; U.S. Pat. No. 5,046,559 to Glandt, and U.S. Pat. No. 5,060,726 to Glandt, each of which are incorporated herein by reference, describe methods of producing viscous materials from subterranean formations that includes passing electrical current through the subterranean formation. Steam may be injected from the injector well into the formation to produce hydrocarbons.

Oil shale formations may be heated and/or retorted in situ to increase permeability in the formation and/or to convert the kerogen to hydrocarbons having an API gravity greater than 10°. In conventional processing of oil shale formations, portions of the oil shale formation containing kerogen are generally heated to temperatures above 370° C. to form low molecular weight hydrocarbons, carbon oxides, and/or molecular hydrogen. Some processes to produce bitumen from oil shale formations include heating the oil shale to a temperature above the natural temperature of the oil shale until some of the organic components of the oil shale are converted to bitumen and/or fluidizable material.

U.S. Pat. No. 3,515,213 to Prats, which is incorporated by reference herein, describes circulation of a fluid heated at a moderate temperature from one point within the formation to another for a relatively long period of time until a significant proportion of the organic components contained in the oil shale formation are converted to oil shale derived fluidizable materials.

U.S. Pat. No. 3,882,941 to Pelofsky, which is incorporate by reference herein, describes recovering hydrocarbons from oil shale deposits by introducing hot fluids into the deposits through wells and then shutting in the wells to allow kerogen in the deposits to be converted to bitumen which is then recovered through the wells after an extended period of soaking.

U.S. Pat. No. 7,011,154 to Maher et al., which is incorporated herein by reference herein, describes in situ treatment of a kerogen and liquid hydrocarbon containing formation using heat sources to produce pyrolyzed hydrocarbons. Maher also describes an in situ treatment of a kerogen and liquid hydrocarbon containing formation using a heat transfer fluid such as steam. In an embodiment, a method of treating a kerogen and liquid hydrocarbon containing formation may include injecting a heat transfer fluid into a formation. Heat from the heat transfer fluid may transfer to a selected section of the formation. The heat from the heat transfer fluid may pyrolyze a substantial portion of the hydrocarbons within the selected section of the formation. The produced gas mixture may include hydrocarbons with an average API gravity greater than about 25°.

As discussed above, there has been a significant amount of effort to produce hydrocarbons and/or bitumen from oil shale. At present, however, there are still many hydrocarbon containing formations that cannot be economically produced. Thus, there is a need for improved methods for heating of a hydrocarbon containing formation and production of hydrocarbons having desired characteristics from the hydrocarbon containing formation are needed.

SUMMARY

Embodiments described herein generally relate to systems and methods for treating a subsurface formation. In certain embodiments, the invention provides one or more systems and/or methods for treating a subsurface formation.

In certain embodiments, a method of treating a hydrocarbon containing formation includes providing heat from a plurality of heaters to a section of the hydrocarbon containing formation; controlling the heat from the plurality of heaters such that an average temperature in at least a majority of a first portion of the section is above a pyrolyzation temperature; providing heat from the plurality of heaters to a second portion substantially above the first portion of the section after heating the first portion for a selected time; controlling the heat from the plurality of heaters such the an average temperature in the second portion is sufficient to allow the second portion to expand into the first portion; and producing hydrocarbons from the formation.

In certain embodiments, a method of treating a hydrocarbon containing formation in situ includes providing heat from a plurality of heaters to a section of the hydrocarbon containing formation; allowing heat from the plurality of heaters to transfer to a first portion such that at least a majority of a first portion of the section at a depth of about 400 m below the surface is heated to a pyrolyzation temperature; and allowing heat from the plurality of heaters to transfer to a second portion at a depth of about 150 m from the surface of the formation and substantially above the first portion after heating the first portion for a selected time; wherein providing heat to the second portion after heating the first portion inhibits geomechanical expansion of the overburden above the second portion of the formation.

In further embodiments, features from specific embodiments may be combined with features from other embodiments. For example, features from one embodiment may be combined with features from any of the other embodiments.

In further embodiments, treating a subsurface formation is performed using any of the methods, heaters and/or systems described herein.

In further embodiments, additional features may be added to the specific embodiments described herein.

BRIEF DESCRIPTION OF THE DRAWINGS

Advantages of the present invention may become apparent to those skilled in the art with the benefit of the following detailed description and upon reference to the accompanying drawings in which.

Figure 1:
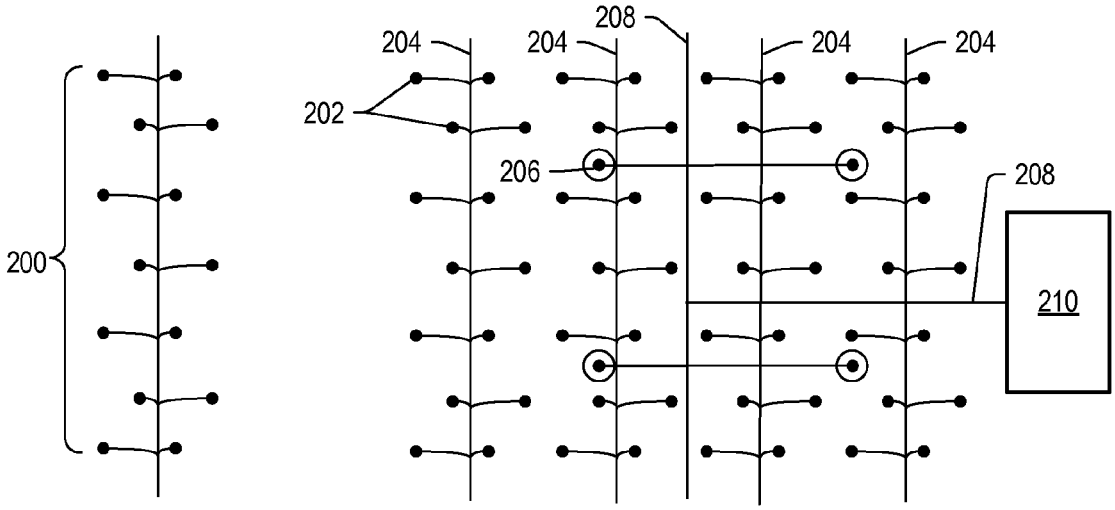
FIG. 1 depicts a schematic view of an embodiment of a portion of an in situ heat treatment system for treating a hydrocarbon containing formation.

While the invention is susceptible to various modifications and alternative forms, specific embodiments thereof are shown by way of example in the drawings and may herein be described in detail. The drawings may not be to scale. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION

The following description generally relates to systems and methods for treating hydrocarbons in the formations. Such formations may be treated to yield hydrocarbon products, hydrogen, and other products.

"API gravity" refers to API gravity at 15.5° C. (60° F.). API gravity is as determined by ASTM Method D6822 or ASTM Method D1298.

"ASTM" refers to American Standard Testing and Materials.

In the context of reduced heat output heating systems, apparatus, and methods, the term "automatically" means such systems, apparatus, and methods function in a certain way without the use of external control (for example, external controllers such as a controller with a temperature sensor and a feedback loop, PID controller, or predictive controller).

"Asphalt/bitumen" refers to a semi-solid, viscous material soluble in carbon disulfide. Asphalt/bitumen may be obtained from refining operations or produced from subsurface formations.

Boiling range distributions for the formation fluid and liquid streams described herein are as determined by ASTM Method D5307 or ASTM Method D2887. Content of hydrocarbon components in weight percent for paraffins, iso-paraffins, olefins, naphthenes and aromatics in the liquid streams is as determined by ASTM Method D6730. Content of aromatics in volume percent is as determined by ASTM Method D1319. Weight percent of hydrogen in hydrocarbons is as determined by ASTM Method D3343.

"Carbon number" refers to the number of carbon atoms in a molecule. A hydrocarbon fluid may include various hydrocarbons with different carbon numbers. The hydrocarbon fluid may be described by a carbon number distribution. Carbon numbers and/or carbon number distributions may be determined by true boiling point distribution and/or gas-liquid chromatography.

"Chemical stability" refers to the ability of a formation fluid to be transported without components in the formation fluid reacting to form polymers and/or compositions that plug pipelines, valves, and/or vessels.

"Condensable hydrocarbons" are hydrocarbons that condense at 25° C. and one atmosphere absolute pressure. Condensable hydrocarbons may include a mixture of hydrocarbons having carbon numbers greater than 4. "Non-condensable hydrocarbons" are hydrocarbons that do not condense at 25° C. and one atmosphere absolute pressure. Non-condensable hydrocarbons may include hydrocarbons having carbon numbers less than 5.

"Coring" is a process that generally includes drilling a hole into a formation and removing a substantially solid mass of the formation from the hole.

"Cracking" refers to a process involving decomposition and molecular recombination of organic compounds to produce a greater number of molecules than were initially present. In cracking, a series of reactions take place accompanied by a transfer of hydrogen atoms between molecules. For example, naphtha may undergo a thermal cracking reaction to form ethene and $H_2$.

"Diesel" refers to hydrocarbons with a boiling range distribution between 260° C. and 343° C. (500-650° F.) at 0.101 MPa. Diesel content is determined by ASTM Method D2887.

A "fluid" may be, but is not limited to, a gas, a liquid, an emulsion, a slurry, and/or a stream of solid particles that has flow characteristics similar to liquid flow.

"Fluid pressure" is a pressure generated by a fluid in a formation. "Lithostatic pressure" (sometimes referred to as "lithostatic stress") is a pressure in a formation equal to a weight per unit area of an overlying rock mass. "Hydrostatic pressure" is a pressure in a formation exerted by a column of water.

A "formation" includes one or more hydrocarbon containing layers, one or more non-hydrocarbon layers, an overburden, and/or an underburden. "Hydrocarbon layers" refer to layers in the formation that contain hydrocarbons. The hydrocarbon layers may contain non-hydrocarbon material and hydrocarbon material. The "overburden" and/or the "underburden" include one or more different types of impermeable materials. For example, the overburden and/or underburden may include rock, shale, mudstone, or wet/tight carbonate. In some embodiments of in situ heat treatment processes, the overburden and/or the underburden may include a hydrocarbon containing layer or hydrocarbon containing layers that are relatively impermeable and are not subjected to temperatures during in situ heat treatment processing that result in significant characteristic changes of the hydrocarbon containing layers of the overburden and/or the underburden. For example, the underburden may contain shale or mudstone, but the underburden is not allowed to heat to pyrolysis temperatures during the in situ heat treatment process. In some cases, the overburden and/or the underburden may be somewhat permeable.

"Formation fluids" refer to fluids present in a formation and may include pyrolyzation fluid, synthesis gas, mobilized hydrocarbons, and water (steam). Formation fluids may include hydrocarbon fluids as well as non-hydrocarbon fluids. The term "mobilized fluid" refers to fluids in a hydrocarbon containing formation that are able to flow as a result of thermal treatment of the formation. "Produced fluids" refer to fluids removed from the formation.

A "heat source" is any system for providing heat to at least a portion of a formation substantially by conductive and/or radiative heat transfer. For example, a heat source may include electrically conducting materials and/or electric heaters such as an insulated conductor, an elongated member, and/or a conductor disposed in a conduit. A heat source may also include systems that generate heat by burning a fuel external to or in a formation. The systems may be surface burners, downhole gas burners, flameless distributed combustors, and natural distributed combustors. In some embodiments, heat provided to or generated in one or more heat sources may be supplied by other sources of energy. The other sources of energy may directly heat a formation, or the energy may be applied to a transfer medium that directly or indirectly heats the formation. It is to be understood that one or more heat sources that are applying heat to a formation may use different sources of energy. Thus, for example, for a given formation some heat sources may supply heat from electrically conducting materials, electric resistance heaters, some heat sources may provide heat from combustion, and some heat sources may provide heat from one or more other energy sources (for example, chemical reactions, solar energy, wind energy, biomass, or other sources of renewable energy). A chemical reaction may include an exothermic reaction (for example, an oxidation reaction). A heat source may also include a electrically conducting material and/or a heater that provides heat to a zone proximate and/or surrounding a heating location such as a heater well.

A "heater" is any system or heat source for generating heat in a well or a near wellbore region. Heaters may be, but are not limited to, electric heaters, burners, combustors that react with material in or produced from a formation, and/or combinations thereof.

"Heavy hydrocarbons" are viscous hydrocarbon fluids. Heavy hydrocarbons may include highly viscous hydrocarbon fluids such as heavy oil, tar, and/or asphalt. Heavy hydrocarbons may include carbon and hydrogen, as well as smaller concentrations of sulfur, oxygen, and nitrogen. Additional elements may also be present in heavy hydrocarbons in trace amounts. Heavy hydrocarbons may be classified by API gravity. Heavy hydrocarbons generally have an API gravity below about 20°. Heavy oil, for example, generally has an API gravity of about 10-20°, whereas tar generally has an API gravity below about 10°. The viscosity of heavy hydrocarbons is generally greater than about 100 centipoise at 15° C. Heavy hydrocarbons may include aromatics or other complex ring hydrocarbons.

Heavy hydrocarbons may be found in a relatively permeable formation. The relatively permeable formation may include heavy hydrocarbons entrained in, for example, sand or carbonate. "Relatively permeable" is defined, with respect to formations or portions thereof, as an average permeability of 10 millidarcy or more (for example, 10 or 100 millidarcy). "Relatively low permeability" is defined, with respect to formations or portions thereof, as an average permeability of less than about 10 millidarcy. One darcy is equal to about 0.99 square micrometers. An impermeable layer generally has a permeability of less than about 0.1 millidarcy.

Certain types of formations that include heavy hydrocarbons may also include, but are not limited to, natural mineral waxes, or natural asphaltites. "Natural mineral waxes" typically occur in substantially tubular veins that may be several meters wide, several kilometers long, and hundreds of meters deep. "Natural asphaltites" include solid hydrocarbons of an aromatic composition and typically occur in large veins. In situ recovery of hydrocarbons from formations such as natural mineral waxes and natural asphaltites may include melting to form liquid hydrocarbons and/or solution mining of hydrocarbons from the formations.

"Hydrocarbons" are generally defined as molecules formed primarily by carbon and hydrogen atoms. Hydrocarbons may also include other elements such as, but not limited to, halogens, metallic elements, nitrogen, oxygen, and/or sulfur. Hydrocarbons may be, but are not limited to, kerogen, bitumen, pyrobitumen, oils, natural mineral waxes, and asphaltites. Hydrocarbons may be located in or adjacent to mineral matrices in the earth. Matrices may include, but are not limited to, sedimentary rock, sands, silicilytes, carbonates, diatomites, and other porous media. "Hydrocarbon fluids" are fluids that include hydrocarbons. Hydrocarbon fluids may include, entrain, or be entrained in non-hydrocarbon fluids such as hydrogen, nitrogen, carbon monoxide, carbon dioxide, hydrogen sulfide, water, and ammonia.

An "in situ conversion process" refers to a process of heating a hydrocarbon containing formation from heat sources to raise the temperature of at least a portion of the formation above a pyrolysis temperature so that pyrolyzation fluid is produced in the formation.

An "in situ heat treatment process" refers to a process of heating a hydrocarbon containing formation with heat sources to raise the temperature of at least a portion of the formation above a temperature that results in mobilized fluid, visbreaking, and/or pyrolysis of hydrocarbon containing material so that mobilized fluids, visbroken fluids, and/or pyrolyzation fluids are produced in the formation.

"Insulated conductor" refers to any elongated material that is able to conduct electricity and that is covered, in whole or in part, by an electrically insulating material.

"Karst" is a subsurface shaped by the dissolution of a soluble layer or layers of bedrock, usually carbonate rock such as limestone or dolomite. The dissolution may be caused by meteoric or acidic water. The Grosmont formation in Alberta, Canada is an example of a karst (or "karsted") carbonate formation.

"Kerogen" is a solid, insoluble hydrocarbon that has been converted by natural degradation and that principally contains carbon, hydrogen, nitrogen, oxygen, and sulfur. Coal and oil shale are typical examples of materials that contain kerogen. "Bitumen" is a non-crystalline solid or viscous hydrocarbon material that is substantially soluble in carbon disulfide. "Oil" is a fluid containing a mixture of condensable hydrocarbons.

"Kerosene" refers to hydrocarbons with a boiling range distribution between 204° C. and 260° C. at 0.101 MPa. Kerosene content is determined by ASTM Method D2887.

"Naphtha" refers to hydrocarbon components with a boiling range distribution between 38° C. and 200° C. at 0.101 MPa. Naphtha content is determined by ASTM Method D5307.

"Nitrogen compounds" refer to inorganic and organic compounds containing the element nitrogen. Examples of nitrogen compounds include, but are not limited to, ammonia and organonitrogen compounds. "Organonitrogen compounds" refer to hydrocarbons that contain at least one nitrogen atom. Non-limiting examples of organonitrogen compounds include, but are not limited to, amines, alkyl amines, aromatic amines, alkyl amides, aromatic amides, carbozoles, hydrogenated carbazoles, indoles pyridines, pyrazoles, pyrroles, and oxazoles.

"Nitrogen compound content" refers to an amount of nitrogen in an organic compound. Nitrogen content is as determined by ASTM Method D5762.

"Olefins" are molecules that include unsaturated hydrocarbons having one or more non-aromatic carbon-carbon double bonds.

"Oxygen containing compounds" refer to compounds containing the element oxygen. Examples of compounds containing oxygen include, but are not limited to, phenols, and/or carbon dioxide.

"P (peptization) value" or "P-value" refers to a numerical value, which represents the flocculation tendency of asphaltenes in a formation fluid. P-value is determined by ASTM method D7060.

"Perforations" include openings, slits, apertures, or holes in a wall of a conduit, tubular, pipe or other flow pathway that allow flow into or out of the conduit, tubular, pipe or other flow pathway.

"Periodic Table" refers to the Periodic Table as specified by the International Union of Pure and Applied Chemistry (IUPAC), November 2003. In the scope of this application, weight of a metal from the Periodic Table, weight of a compound of a metal from the Periodic Table, weight of an element from the Periodic Table, or weight of a compound of an element from the Periodic Table is calculated as the weight of metal or the weight of element. For example, if 0.1 grams of $MoO_3$ is used per gram of catalyst, the calculated weight of the molybdenum metal in the catalyst is 0.067 grams per gram of catalyst.

"Physical stability" refers to the ability of a formation fluid to not exhibit phase separation or flocculation during transportation of the fluid. Physical stability is determined by ASTM Method D7060.

"Pyrolysis" is the breaking of chemical bonds due to the application of heat. For example, pyrolysis may include transforming a compound into one or more other substances by heat alone. Heat may be transferred to a section of the formation to cause pyrolysis.

"Pyrolyzation fluids" or "pyrolysis products" refers to fluid produced substantially during pyrolysis of hydrocarbons. Fluid produced by pyrolysis reactions may mix with other fluids in a formation. The mixture would be considered pyrolyzation fluid or pyrolyzation product. As used herein, "pyrolysis zone" refers to a volume of a formation (for example, a relatively permeable formation such as a tar sands formation) that is reacted or reacting to form a pyrolyzation fluid.

"Residue" refers to hydrocarbons that have a boiling point above 537° C. (1000° F.).

"Rich layers" in a hydrocarbon containing formation are relatively thin layers (typically about 0.2 m to about 0.5 m thick). Rich layers generally have a richness of about 0.150 L/kg or greater. Some rich layers have a richness of about 0.170 L/kg or greater, of about 0.190 L/kg or greater, or of about 0.210 L/kg or greater. Lean layers of the formation have a richness of about 0.100 L/kg or less and are generally thicker than rich layers. The richness and locations of layers are determined, for example, by coring and subsequent Fischer assay of the core, density or neutron logging, or other logging methods. Rich layers may have a lower initial thermal conductivity than other layers of the formation. Typically, rich layers have a thermal conductivity 1.5 times to 3 times lower than the thermal conductivity of lean layers. In addition, rich layers have a higher thermal expansion coefficient than lean layers of the formation.

"Subsidence" is a downward movement of a portion of a formation relative to an initial elevation of the surface.

"Sulfur containing compounds" refer to inorganic and organic sulfur compounds. Examples of inorganic sulfur compounds include, but are not limited to, hydrogen sulfide and/or iron sulfides. Examples of organic sulfur compounds (organosulfur compounds) include, but are not limited to, carbon disulfide, mercaptans, thiophenes, hydrogenated benzothiophenes, benzothiophenes, dibenzothiophenes, hydrogenated dibenzothiophenes or mixtures thereof.

"Sulfur compound content" refers to an amount of sulfur in an organic compound in hydrocarbons. Sulfur content is as determined by ASTM Method D4294. ASTM Method D4294 may be used to determine forms of sulfur in an oil shale sample. Forms of sulfur in an oil shale sample includes, but is not limited to, pyritic sulfur, sulfate sulfur, and organic sulfur. Total sulfur content in oil shale is determined by ASTM Method D4239.

"Superposition of heat" refers to providing heat from two or more heat sources to a selected section of a formation such that the temperature of the formation at least at one location between the heat sources is influenced by the heat sources.

"Synthesis gas" is a mixture including hydrogen and carbon monoxide. Additional components of synthesis gas may include water, carbon dioxide, nitrogen, methane, and other gases. Synthesis gas may be generated by a variety of processes and feedstocks. Synthesis gas may be used for synthesizing a wide range of compounds.

"Tar" is a viscous hydrocarbon that generally has a viscosity greater than about 10,000 centipoise at 15° C. The specific gravity of tar generally is greater than 1.000. Tar may have an API gravity less than 10°.

A "tar sands formation" is a formation in which hydrocarbons are predominantly present in the form of heavy hydrocarbons and/or tar entrained in a mineral grain framework or other host lithology (for example, sand or carbonate). Examples of tar sands formations include formations such as the Athabasca formation, the Grosmont formation, and the Peace River formation, all three in Alberta, Canada; and the Faja formation in the Orinoco belt in Venezuela.

"Temperature limited heater" generally refers to a heater that regulates heat output (for example, reduces heat output) above a specified temperature without the use of external controls such as temperature controllers, power regulators, rectifiers, or other devices. Temperature limited heaters may be AC (alternating current) or modulated (for example, "chopped") DC (direct current) powered electrical resistance heaters.

"Thermal fracture" refers to fractures created in a formation caused by expansion or contraction of a formation and/or fluids in the formation, which is in turn caused by increasing/decreasing the temperature of the formation and/or fluids in the formation, and/or by increasing/decreasing a pressure of fluids in the formation due to heating.

"Thermal oxidation stability" refers to thermal oxidation stability of a liquid. Thermal oxidation stability is as determined by ASTM Method D3241.

"Thickness" of a layer refers to the thickness of a cross section of the layer, wherein the cross section is normal to a face of the layer.

"Time-varying current" refers to electrical current that produces skin effect electricity flow in a ferromagnetic conductor and has a magnitude that varies with time. Time-varying current includes both alternating current (AC) and modulated direct current (DC).

A "u-shaped wellbore" refers to a wellbore that extends from a first opening in the formation, through at least a portion of the formation, and out through a second opening in the formation. In this context, the wellbore may be only roughly in the shape of a "v" or "u", with the understanding that the "legs" of the "u" do not need to be parallel to each other, or perpendicular to the "bottom" of the "u" for the wellbore to be considered "u-shaped".

"Upgrade" refers to increasing the quality of hydrocarbons. For example, upgrading heavy hydrocarbons may result in an increase in the API gravity of the heavy hydrocarbons.

"Visbreaking" refers to the untangling of molecules in fluid during heat treatment and/or to the breaking of large molecules into smaller molecules during heat treatment, which results in a reduction of the viscosity of the fluid.

"Viscosity" refers to kinematic viscosity at 40° C. unless otherwise specified. Viscosity is as determined by ASTM Method D445.

"VGO" or "vacuum gas oil" refers to hydrocarbons with a boiling range distribution between 343° C. and 538° C. at 0.101 MPa. VGO content is determined by ASTM Method D5307.

"Wax" refers to a low melting organic mixture, or a compound of high molecular weight that is a solid at lower temperatures and a liquid at higher temperatures, and when in solid form can form a barrier to water. Examples of waxes include animal waxes, vegetable waxes, mineral waxes, petroleum waxes, and synthetic waxes.

The term "wellbore" refers to a hole in a formation made by drilling or insertion of a conduit into the formation. A wellbore may have a substantially circular cross section, or another cross-sectional shape. As used herein, the terms "well" and "opening," when referring to an opening in the formation may be used interchangeably with the term "wellbore."

A formation may be treated in various ways to produce many different products. Different stages or processes may be used to treat the formation during an in situ heat treatment process. In some embodiments, one or more sections of the formation are solution mined to remove soluble minerals from the sections. Solution mining minerals may be performed before, during, and/or after the in situ heat treatment process. In some embodiments, the average temperature of one or more sections being solution mined may be maintained below about 120° C.

In some embodiments, one or more sections of the formation are heated to remove water from the sections and/or to remove methane and other volatile hydrocarbons from the sections. In some embodiments, the average temperature may be raised from ambient temperature to temperatures below about 220° C. during removal of water and volatile hydrocarbons.

In some embodiments, one or more sections of the formation are heated to temperatures that allow for movement and/or visbreaking of hydrocarbons in the formation. In some embodiments, the average temperature of one or more sections of the formation are raised to mobilization temperatures of hydrocarbons in the sections (for example, to temperatures ranging from 100° C. to 250° C., from 120° C. to 240° C., or from 150° C. to 230° C.).

In some embodiments, one or more sections are heated to temperatures that allow for pyrolysis reactions in the formation. In some embodiments, the average temperature of one or more sections of the formation may be raised to pyrolysis temperatures of hydrocarbons in the sections (for example, temperatures ranging from 230° C. to 900° C., from 240° C. to 400° C. or from about 250° C. to 350° C.).

Heating the hydrocarbon containing formation with a plurality of heat sources may establish thermal gradients around the heat sources that raise the temperature of hydrocarbons in the formation to desired temperatures at desired heating rates. The rate of temperature increase through the mobilization temperature range and/or the pyrolysis temperature range for desired products may affect the quality and quantity of the formation fluids produced from the hydrocarbon containing formation. Slowly raising the temperature of the formation through the mobilization temperature range and/or pyrolysis temperature range may allow for the production of high quality, high API gravity hydrocarbons from the formation. Slowly raising the temperature of the formation through the mobilization temperature range and/or pyrolysis temperature range may allow for the removal of a large amount of the hydrocarbons present in the formation as hydrocarbon product.

In some in situ heat treatment embodiments, a portion of the formation is heated to a desired temperature instead of slowly raising the temperature through a temperature range. In some embodiments, the desired temperature is 300° C., 325° C., or 350° C. Other temperatures may be selected as the desired temperature.

Superposition of heat from heat sources allows the desired temperature to be relatively quickly and efficiently established in the formation. Energy input into the formation from the heat sources may be adjusted to maintain the temperature in the formation substantially at a desired temperature.

Mobilization and/or pyrolysis products may be produced from the formation through production wells. In some embodiments, the average temperature of one or more sections is raised to mobilization temperatures and hydrocarbons are produced from the production wells. The average temperature of one or more of the sections may be raised to pyrolysis temperatures after production due to mobilization decreases below a selected value. In some embodiments, the average temperature of one or more sections may be raised to pyrolysis temperatures without significant production before reaching pyrolysis temperatures. Formation fluids including pyrolysis products may be produced through the production wells.

In some embodiments, the average temperature of one or more sections may be raised to temperatures sufficient to allow synthesis gas production after mobilization and/or pyrolysis. In some embodiments, hydrocarbons may be raised to temperatures sufficient to allow synthesis gas production without significant production before reaching the temperatures sufficient to allow synthesis gas production. For example, synthesis gas may be produced in a temperature range from about 400° C. to about 1200° C., about 500° C. to about 1100° C., or about 550° C. to about 1000° C. A synthesis gas generating fluid (for example, steam and/or water) may be introduced into the sections to generate synthesis gas. Synthesis gas may be produced from production wells.

Solution mining, removal of volatile hydrocarbons and water, mobilizing hydrocarbons, pyrolyzing hydrocarbons, generating synthesis gas, and/or other processes may be performed during the in situ heat treatment process. In some embodiments, some processes may be performed after the in situ heat treatment process. Such processes may include, but are not limited to, recovering heat from treated sections, storing fluids (for example, water and/or hydrocarbons) in previously treated sections, and/or sequestering carbon dioxide in previously treated sections.

FIG. 1 depicts a schematic view of an embodiment of a portion of the in situ heat treatment system for treating the hydrocarbon containing formation. The in situ heat treatment system may include barrier wells 200. Barrier wells are used to form a barrier around a treatment area. The barrier inhibits fluid flow into and/or out of the treatment area. Barrier wells include, but are not limited to, dewatering wells, vacuum wells, capture wells, injection wells, grout wells, freeze wells, or combinations thereof. In some embodiments, barrier wells 200 are dewatering wells. Dewatering wells may remove liquid water and/or inhibit liquid water from entering a portion of the formation to be heated, or to the formation being heated. In the embodiment depicted in FIG. 1, the barrier wells 200 are shown extending only along one side of heat sources 202, but the barrier wells typically encircle all heat sources 202 used, or to be used, to heat a treatment area of the formation.

Heat sources 202 are placed in at least a portion of the formation. Heat sources 202 may include heaters such as insulated conductors, conductor-in-conduit heaters, surface burners, flameless distributed combustors, and/or natural distributed combustors. Heat sources 202 may also include other types of heaters. Heat sources 202 provide heat to at least a portion of the formation to heat hydrocarbons in the formation. Energy may be supplied to heat sources 202 through supply lines 204. Supply lines 204 may be structurally different depending on the type of heat source or heat sources used to heat the formation. Supply lines 204 for heat sources may transmit electricity for electric heaters, may transport fuel for combustors, or may transport heat exchange fluid that is circulated in the formation. In some embodiments, electricity for an in situ heat treatment process may be provided by a nuclear power plant or nuclear power plants. The use of nuclear power may allow for reduction or elimination of carbon dioxide emissions from the in situ heat treatment process.

When the formation is heated, the heat input into the formation may cause expansion of the formation and geomechanical motion. The heat sources may be turned on before, at the same time, or during a dewatering process. Computer simulations may model formation response to heating. The computer simulations may be used to develop a pattern and time sequence for activating heat sources in the formation so that geomechanical motion of the formation does not adversely affect the functionality of heat sources, production wells, and other equipment in the formation.

Heating the formation may cause an increase in permeability and/or porosity of the formation. Increases in permeability and/or porosity may result from a reduction of mass in the formation due to vaporization and removal of water, removal of hydrocarbons, and/or creation of fractures. Fluid may flow more easily in the heated portion of the formation because of the increased permeability and/or porosity of the formation. Fluid in the heated portion of the formation may move a considerable distance through the formation because of the increased permeability and/or porosity. The considerable distance may be over 1000 m depending on various factors, such as permeability of the formation, properties of the fluid, temperature of the formation, and pressure gradient allowing movement of the fluid. The ability of fluid to travel considerable distance in the formation allows production wells 206 to be spaced relatively far apart in the formation.

Production wells 206 are used to remove formation fluid from the formation. In some embodiments, production well 206 includes a heat source. The heat source in the production well may heat one or more portions of the formation at or near the production well. In some in situ heat treatment process embodiments, the amount of heat supplied to the formation from the production well per meter of the production well is less than the amount of heat applied to the formation from a heat source that heats the formation per meter of the heat source. Heat applied to the formation from the production well may increase formation permeability adjacent to the production well by vaporizing and removing liquid phase fluid adjacent to the production well and/or by increasing the permeability of the formation adjacent to the production well by formation of macro and/or micro fractures.

More than one heat source may be positioned in the production well. A heat source in a lower portion of the production well may be turned off when superposition of heat from adjacent heat sources heats the formation sufficiently to counteract benefits provided by heating the formation with the production well. In some embodiments, the heat source in an upper portion of the production well may remain on after the heat source in the lower portion of the production well is deactivated. The heat source in the upper portion of the well may inhibit condensation and reflux of formation fluid.

In some embodiments, the heat source in production well 206 allows for vapor phase removal of formation fluids from the formation. Providing heating at or through the production well may: (1) inhibit condensation and/or refluxing of production fluid when such production fluid is moving in the production well proximate the overburden, (2) increase heat input into the formation, (3) increase production rate from the production well as compared to a production well without a heat source, (4) inhibit condensation of high carbon number compounds ($C_6$ hydrocarbons and above) in the production well, and/or (5) increase formation permeability at or proximate the production well.

Subsurface pressure in the formation may correspond to the fluid pressure generated in the formation. As temperatures in the heated portion of the formation increase, the pressure in the heated portion may increase as a result of thermal expansion of in situ fluids, increased fluid generation and vaporization of water. Controlling rate of fluid removal from the formation may allow for control of pressure in the formation. Pressure in the formation may be determined at a number of different locations, such as near or at production wells, near or at heat sources, or at monitor wells.

In some hydrocarbon containing formations, production of hydrocarbons from the formation is inhibited until at least some hydrocarbons in the formation have been mobilized and/or pyrolyzed. Formation fluid may be produced from the formation when the formation fluid is of a selected quality. In some embodiments, the selected quality includes an API gravity of at least about 20°, 30°, or 40° Inhibiting production until at least some hydrocarbons are mobilized and/or pyrolyzed may increase conversion of heavy hydrocarbons to light hydrocarbons. Inhibiting initial production may minimize the production of heavy hydrocarbons from the formation. Production of substantial amounts of heavy hydrocarbons may require expensive equipment and/or reduce the life of production equipment.

In some hydrocarbon containing formations, hydrocarbons in the formation may be heated to mobilization and/or pyrolysis temperatures before substantial permeability has been generated in the heated portion of the formation. An initial lack of permeability may inhibit the transport of generated fluids to production wells 206. During initial heating, fluid pressure in the formation may increase proximate heat sources 202. The increased fluid pressure may be released, monitored, altered, and/or controlled through one or more heat sources 202. For example, selected heat sources 202 or separate pressure relief wells may include pressure relief valves that allow for removal of some fluid from the formation.

In some embodiments, pressure generated by expansion of mobilized fluids, pyrolysis fluids or other fluids generated in the formation may be allowed to increase because an open path to production wells 206 or any other pressure sink may not yet exist in the formation. The fluid pressure may be allowed to increase towards a lithostatic pressure. Fractures in the hydrocarbon containing formation may form when the fluid approaches minimal in situ stress. In some embodiments, the minimal in situ stress may equal to or approximate the lithostatic pressure of the hydrocarbon formation. For example, fractures may form from heat sources 202 to production wells 206 in the heated portion of the formation. The generation of fractures in the heated portion may relieve some of the pressure in the portion. Pressure in the formation may have to be maintained below a selected pressure to inhibit unwanted production, fracturing of the overburden or underburden, and/or coking of hydrocarbons in the formation.

After mobilization and/or pyrolysis temperatures are reached and production from the formation is allowed, pressure in the formation may be varied to alter and/or control a composition of produced formation fluid, to control a percentage of condensable fluid as compared to non-condensable fluid in the formation fluid, and/or to control an API gravity of formation fluid being produced. For example, decreasing pressure may result in production of a larger condensable fluid component. The condensable fluid component may contain a larger percentage of olefins.

In some in situ heat treatment process embodiments, pressure in the formation may be maintained high enough to promote production of formation fluid with an API gravity of greater than 20°. Maintaining increased pressure in the formation may inhibit formation subsidence during in situ heat treatment. Maintaining increased pressure may reduce or eliminate the need to compress formation fluids at the surface to transport the fluids in collection conduits to treatment facilities.

Maintaining increased pressure in a heated portion of the formation may surprisingly allow for production of large quantities of hydrocarbons of increased quality and of relatively low molecular weight. Pressure may be maintained so that formation fluid produced has a minimal amount of compounds above a selected carbon number. The selected carbon number may be at most 25, at most 20, at most 12, or at most 8. Some high carbon number compounds may be entrained in vapor in the formation and may be removed from the formation with the vapor. Maintaining increased pressure in the formation may inhibit entrainment of high carbon number compounds and/or multi-ring hydrocarbon compounds in the vapor. High carbon number compounds and/or multi-ring hydrocarbon compounds may remain in a liquid phase in the formation for significant time periods. The significant time periods may provide sufficient time for the compounds to pyrolyze to form lower carbon number compounds.

Generation of relatively low molecular weight hydrocarbons is believed to be due, in part, to autogenous generation and reaction of hydrogen in a portion of the hydrocarbon containing formation. For example, maintaining an increased pressure may force hydrogen generated during pyrolysis into the liquid phase within the formation. Heating the portion to a temperature in a pyrolysis temperature range may pyrolyze hydrocarbons in the formation to generate liquid phase pyrolyzation fluids. The generated liquid phase pyrolyzation fluids components may include double bonds and/or radicals. Hydrogen ($H_2$) in the liquid phase may reduce double bonds of the generated pyrolyzation fluids, thereby reducing a potential for polymerization or formation of long chain compounds from the generated pyrolyzation fluids. In addition, $H_2$ may also neutralize radicals in the generated pyrolyzation fluids. $H_2$ in the liquid phase may inhibit the generated pyrolyzation fluids from reacting with each other and/or with other compounds in the formation.

Formation fluid produced from production wells 206 may be transported through collection piping 208 to treatment facilities 210. Formation fluids may also be produced from heat sources 202. For example, fluid may be produced from heat sources 202 to control pressure in the formation adjacent to the heat sources. Fluid produced from heat sources 202 may be transported through tubing or piping to collection piping 208 or the produced fluid may be transported through tubing or piping directly to treatment facilities 210. Treatment facilities 210 may include separation units, reaction units, upgrading units, fuel cells, turbines, storage vessels, and/or other systems and units for processing produced formation fluids. The treatment facilities may form transportation fuel from at least a portion of the hydrocarbons produced from the formation. In some embodiments, the transportation fuel may be jet fuel, such as JP-8.

Oil shale formations may have a number of properties that depend on a composition of the hydrocarbons within the formation. Such properties may affect the composition and amount of products that are produced from the oil shale formation during an in situ heat treatment process (for example, an in situ conversion process). Properties of an oil shale formation may be used to determine if and/or how the oil shale formation is to be subjected to the in situ heat treatment process.

Kerogen is composed of organic matter that has been transformed due to a maturation process. The maturation process for kerogen may include two stages: a biochemical stage and a geochemical stage. The biochemical stage typically involves degradation of organic material by aerobic and/or anaerobic organisms. The geochemical stage typically involves conversion of organic matter due to temperature changes and significant pressures. During maturation, oil and gas may be produced as the organic matter of the kerogen is transformed. Kerogen may be classified into four distinct groups: Type I, Type II, Type III, and Type IV. Classification of kerogen type may depend upon precursor materials of the kerogen. The precursor materials transform over time into macerals. Macerals are microscopic structures that have different structures and properties depending on the precursor materials from which they are derived.

Type I kerogen may be classified as an alginite, since it is developed primarily from algal bodies. Type I kerogen may result from deposits made in lacustrine environments. Type II kerogen may develop from organic matter that was deposited in marine environments. Type III kerogen may generally include vitrinite macerals. Vitrinite is derived from cell walls and/or woody tissues (for example, stems, branches, leaves, and roots of plants). Type III kerogen may be present in most humic coals. Type III kerogen may develop from organic matter that was deposited in swamps. Type IV kerogen includes the inertinite maceral group. The inertinite maceral group is composed of plant material such as leaves, bark, and stems that have undergone oxidation during the early peat stages of burial diagenesis. Inertinite maceral is chemically similar to vitrinite, but has a high carbon and low hydrogen content.

Vitrinite reflectance may be used to assess the quality of fluids produced from certain kerogen containing formations. Formations that include kerogen may be assessed/selected for treatment based on a vitrinite reflectance of the kerogen. Vitrinite reflectance is often related to a hydrogen to carbon atomic ratio of a kerogen and an oxygen to carbon atomic ratio of the kerogen. Vitrinite reflectance of a hydrocarbon containing formation may indicate which fluids are producible from a formation upon heating. For example, a vitrinite reflectance of approximately 0.5% to approximately 1.5% may indicate that the kerogen will produce a large quantity of condensable fluids. A vitrinite reflectance of approximately 1.5% to 3.0% may indicate a kerogen having a H/C molar ratio between about 0.25 to about 0.9. Heating of a hydrocarbon formation having a vitrinite reflectance of approximately 1.5% to 3.0% may produce a significant amount (for example, a majority) of methane and hydrogen.

In some embodiments, hydrocarbon formations containing Type I kerogen have vitrinite reflectance less than 0.5% (for example, between 0.4% and 0.5%). Type I kerogen having a vitrinite reflectance less than 0.5% may contain a significant amount of amorphous organic matter. In some embodiments, kerogen having a vitrinite reflectance less than 0.5% may have relatively high total sulfur content (for example, a total sulfur content between 1.5% and about 2.0% by weight). In certain embodiments, a majority of the total sulfur content in the kerogen is organic sulfur compounds (for example, an organic sulfur content in the kerogen between 1.3% and 1.7% by weight). In some embodiments, hydrocarbon formations having a vitrinite reflectance less than 0.5% may contain a significant amount of calcite and a relatively low amount of dolomite.

In certain embodiments, Type I kerogen formations (for example, Jordan oil shale) may have a mineral content that includes about 85% to 90% by weight calcite (calcium carbonate), about 0.5% to 1.5% by weight dolomite, about 5% to 15% by weight fluorapatite, about 5% to 15% by weight quartz, less than 0.5% by weight clays and/or less than 0.5% by weight iron sulfides (pyrite). Such oil shale formations may have a porosity ranging from about 5% to about 7% and/or a bulk density from about 1.5 to about 2.5 g/cc. Oil shale formations containing primarily calcite may have an organic sulfur content ranging from about 1% to about 2% by weight and an H/C atomic ratio of about 1.4.

In some embodiments, hydrocarbon formations having a vitrinite reflectance less than 0.5% and/or a relatively high sulfur content may be treated using the in situ heat treatment process or an in situ conversion process at lower temperatures (for example, about 15° C. lower) relative to treating Type I kerogen having vitrinite reflectance of greater than 0.5% and/or an organic sulfur content of less than 1% by weight and/or Type II-IV kerogens using an in situ conversion process or retorting process. The ability to treat a hydrocarbon formation at lower temperatures may result in energy reductions and increased production of liquid hydrocarbons from the hydrocarbon formation.

In some embodiments, formation fluid produced from a hydrocarbon containing formation having a low vitrinite reflectance and/or high sulfur content using an in situ heat treatment process may have different characteristics than formation fluid produced from a hydrocarbon containing formation having a vitrinite reflectance of greater than 0.5% and/or a relatively low total sulfur content. The formation fluid produced from formations having a low vitrinite reflectance and/or high sulfur content may include sulfur compounds that can be removed under mild processing conditions.

The formation fluid produced from formations having a low vitrinite reflectance and/or high sulfur content may have an API gravity of about 38°, a hydrogen content of about 12% by weight, a total sulfur content of about 3.4% by weight, an oxygen content of about 0.6% by weight, a nitrogen content of about 0.3% by weight and a H/C ratio of about 1.8.

The produced formation fluid may be separated into a gas process stream and/or a liquid process stream using methods known in the art or as described herein. The liquid process stream may be separated into various distillate hydrocarbon fractions (for example, naphtha, kerosene, and vacuum gas oil fractions). In some embodiments, the naphtha fraction may contain at least 10% by weight thiophenes. The kerosene fraction may contain about 35% by weight thiophenes, about 1% by weight hydrogenated benzothiophenes, and about 4% by weight benzothiophenes. The vacuum gas oil fraction may contain about 10% by weight thiophenes, at least 1.5% by weight hydrogenated benzothiophenes, about 30% benzothiophenes, and about 3% by weight dibenzothiophenes. In some embodiments, the thiophenes may be separated from the produced formation fluid and used as a solvent in the in situ heat treatment process. In some embodiments, hydrocarbon fractions containing thiophenes may be used as solvation fluids in the in situ heat treatment process. In some embodiments, hydrocarbon fractions that include at least 10% by weight thiophenes may be removed from the formation fluid using mild hydrotreating conditions.

In some embodiments, amounts of ammonia and/or hydrogen sulfide produced from a hydrocarbon containing formation hydrogen may vary depending on the geology of the hydrocarbon containing formation. During an in situ heat treatment process, a hydrocarbon containing formation that has a high content of sulfur and/or nitrogen may produce a significant amount of ammonia and/or hydrogen sulfide and/or formation fluids that include a significant amount of ammonia and/or hydrogen sulfide. During heating, at least a portion of the ammonia may be oxidized to $NO_x$ compounds. The formation fluid may have to be treated to remove the ammonia, $NO_x$ and/or hydrogen sulfide prior to processing in a surface facility and/or transporting the formation fluid. Treatment of the formation fluid may include, but is not limited to, gas separation methods, adsorption methods or any known method to remove hydrogen sulfide, ammonia and/or $NO_x$ from the formation fluid. In some embodiments, the hydrocarbon containing formation includes a significant amount of compounds that off-gas ammonia and/or hydrogen sulfide such that the formation is deemed unacceptable for treatment.

The nitrogen content in the hydrocarbon containing formation may come from hydrocarbon compounds that contain nitrogen, inorganic compounds and/or ammonium feldspars (for example, buddingtonite ($NH_4AlSi_3O_8$)).

The sulfur content in the hydrocarbon containing formation may come from organic sulfur and/or inorganic compounds. Inorganic compounds include, but are not limited to, sulfates, pyrites, metal sulfides, and mixtures thereof. Treatment of formations containing significant amounts of total sulfur may result in release of unpredictable amounts of hydrogen sulfide. As shown in Table 1, formations having different amounts of total sulfur produce varying amounts of hydrogen sulfide, especially when the formations contain a significant amount of organosulfur compounds and/or sulfate compounds. For example, comparing sample 3 with sample 4 in Table 1, the different amounts of hydrogen sulfide produced do not directly correlate to the total sulfur present in the sulfur.

TABLE 1

| Sample No. | Total Sulfur, % wt. | $H_2S$ yield, % wt |
|---|---|---|
| 1 | 0.68 | 0.08 |
| 2 | 0.93 | 0.17 |
| 3 | 0.99 | 0.32 |
| 4 | 1.09 | 0.06 |
| 5 | 1.11 | 0.19 |
| 6 | 1.11 | 0.17 |
| 7 | 1.16 | 0.15 |
| 8 | 1.24 | 0.17 |
| 9 | 1.35 | 0.34 |
| 10 | 1.37 | 0.31 |
| 11 | 1.45 | 0.63 |
| 12 | 1.53 | 0.54 |
| 13 | 1.55 | 0.27 |
| 14 | 2.61 | 0.39 |

Treatment to remove unwanted gases produced during production of hydrocarbons from a formation may be expensive and/or inefficient. Many methods have been developed to reduce the amount of ammonia and/or hydrogen sulfide by adding solutions to hydrocarbon containing formations that neutralize or complex the nitrogen and/or sulfur in the formation. Methods to produce formation fluids having reduced amounts of undesired gases (for example, hydrogen sulfide, ammonia and/or $NO_x$ compounds are desired.

It has been found that the amount of hydrogen sulfide produced from a hydrocarbon containing formation correlates with the amount of pyritic sulfur in the formation. Table 2 is a tabulation of percent by weight pyritic sulfur in layers of a hydrocarbon containing formation that include pyritic sulfur and the percent by weight hydrogen sulfide produced from the layer upon heating. As shown in Table 2, the amount of hydrogen sulfide produced increases with the amount of pyritic sulfur in the layer.

TABLE 2

| Hydrocarbon Layer No. | Pyritic Sulfur, % wt | $H_2S$ % wt |
|---|---|---|
| 1 | 0.73 | 0.32 |
| 2 | 0.68 | 0.06 |
| 3 | 1.23 | 0.54 |
| 4 | 1.01 | 0.34 |
| 5 | 2.08 | 0.39 |
| 6 | 0.95 | 0.63 |
| 7 | 0.66 | 0.19 |
| 8 | 0.55 | 0.15 |
| 9 | 0.50 | 0.17 |
| 10 | 0.95 | 0.27 |
| 11 | 0.50 | 0.17 |
| 12 | 0.92 | 0.31 |
| 13 | 0.23 | 0.08 |
| 14 | 0.54 | 0.17 |

In some embodiments, a hydrocarbon containing formation is assessed using known methods (for example, Fischer Assay data and/or $^{34}S$ isotope data) to determine the total amount of inorganic sulfur compounds and/or total amount of inorganic nitrogen compounds in the formation. Based on the assessed amount of ammonia and/or metal sulfide (for example, pyrite) in a portion of the formation, heaters may be positioned in portions of the formation to selectively heat the formation while inhibiting the amount of hydrogen sulfide and/or ammonia produced during treatment. Such selective heating allows treatment of formations containing significant amounts of ammonia, pyrite and/or metal sulfides for production of hydrocarbons.

In some embodiments, heat is provided to a first portion of a hydrocarbon containing formation from one or more heaters and/or heat sources. In some embodiments, at least a portion of the heaters in the first section are substantially horizontal. Heat from heaters in the first section raise a temperature of the first section to above a mobilization temperature. During heating, a portion of the hydrocarbons in the first section may be mobilized. Hydrocarbons may be produced from the first section. In some embodiments, hydrocarbons in the first section are heated to a pyrolysis temperature and at least a portion of the hydrocarbons are pyrolyzed to form hydrocarbon gases.

A second section in the formation may include a significant amount of inorganic sulfur compounds and/or inorganic nitrogen compounds. In some embodiments, the second section may contain at least 0.1% by weight, at least 0.5% by weight, or at least 1% by weight pyrite. The second section may provide structural strength to the formation. Maintaining a second section below the pyrolysis and/or mobilization temperature of hydrocarbons may inhibit production of undesirable gases (for example, hydrogen sulfide and/or ammonia) from the second section. In some embodiments, the formation includes alternating layers of hydrocarbons, inorganic metal sulfides, and ammonia compounds having different concentrations. In some in situ conversion embodiments, columns of untreated portions of formation may remain in a formation that has undergone the in situ heat treatment process.

A second section of the formation adjacent to the first section may remain untreated by controlling an average temperature in the second portion below a pyrolysis and/or a mobilization temperature of hydrocarbons in the second section. In some embodiments, the average temperature of the second section may be less than 230° C. or from about 25° C. to 300° C. In some embodiments, the average temperature of the second section is below the decomposition temperature of the inorganic sulfur compounds (for example, pyrite). For example, the temperature in the second section may be less than about 300° C., less than about 230° C., or from about 25° C. to up to the decomposition temperature of the inorganic sulfur compound.

In some embodiments, an average temperature in the second section is maintained by positioning barrier wells between the first section and the second section and/or the second section and/or the third section of the formation.

In some embodiments, the untreated second section may be between the first section and a third section of the formation. Heat may be provided to the third section of the hydrocarbon containing formation. Heaters in the first section and third section may be substantially horizontal. Formation fluids may be produced from the third section of the formation. A processed formation may have a pattern with alternating treated sections and untreated sections. In some embodiments, the untreated second section may be adjacent to the first section of the formation that is subjected to pyrolysis.

In some embodiments, at least a portion of the heaters in the first section are substantially vertical and may extend into or through one or more sections of the formation (for example, through a first vertical section, a second vertical section and/or a third vertical section). The average temperature in the second section may be controlled by selectively controlling the heat produced from the portion of the heater in the second section. Heat from the second section of the heater may be controlled by blocking, turning down, and/or turning off the portion of the heater in the second section so that a minimal amount of heat or no heat is provided to the second section.

In some embodiments, formation fluid from the first section may be mobilized through the second section. The formation fluid may include gaseous hydrocarbons and/or mercury. The formation fluid may contact inorganic sulfur compounds (for example, pyrite) in the second section. Contact of the formation fluid with the inorganic sulfur compounds may remove at least a portion of the mercury from the formation fluid. Contact of the inorganic sulfur compounds may produce one or more mercury sulfides that precipitate from the formation fluid and remain in the second section.

In some embodiments, one or more portions of formation enriched in pyrite ($FeS_2$) are heated to a temperature under formation conditions such that at least a portion of the pyrite compounds are converted to troilite (FeS) and/or one or more pyrrhotite compounds ($FeS_x$, $1.0<x<1.23$) and gaseous sulfur. For example, the second section may be heated temperatures ranging from about 250° C. to about 750° C., from about 300° C. to about 600° C., or from about 400° C. to about 500° C. Troilite and/or pyrrhotite compounds may react with mercury entrained in gaseous hydrocarbons to form mercury sulfide more rapidly than pyrite under formation conditions (for example, under a hydrogen atmosphere and/or at a pH of less than 7).

The second section may be sufficient permeability to allow gaseous hydrocarbons to flow through the section. In some embodiments, the second section contains less hydrocarbons (hydrocarbon lean) than the first section (hydrocarbon rich). After heating the second section for a period of time to convert some of the pyrite to pyrrhotite, the hydrocarbon rich first section may be heated using an in situ heat treatment process. In some embodiments, hydrocarbons are mobilized and produced from the second section. Formation fluid containing mercury from the first section may be mobilized and moved through the second section of the formation containing pyrrhotite to a third section.

Contact of the mobilized formation fluid with the pyrrhotite may remove some or all of the mercury from the formation fluid. The contacted formation fluid may be produced from the formation. In some embodiments, the contacted formation fluid is produced from a heated third section of the formation. The contacted formation fluid may be substantially free of mercury or contain a minimal amount of mercury. In some embodiments, the contacted formation fluid has a mercury amount in the contacted formation of less than 10 ppb by weight.

Figure 2:
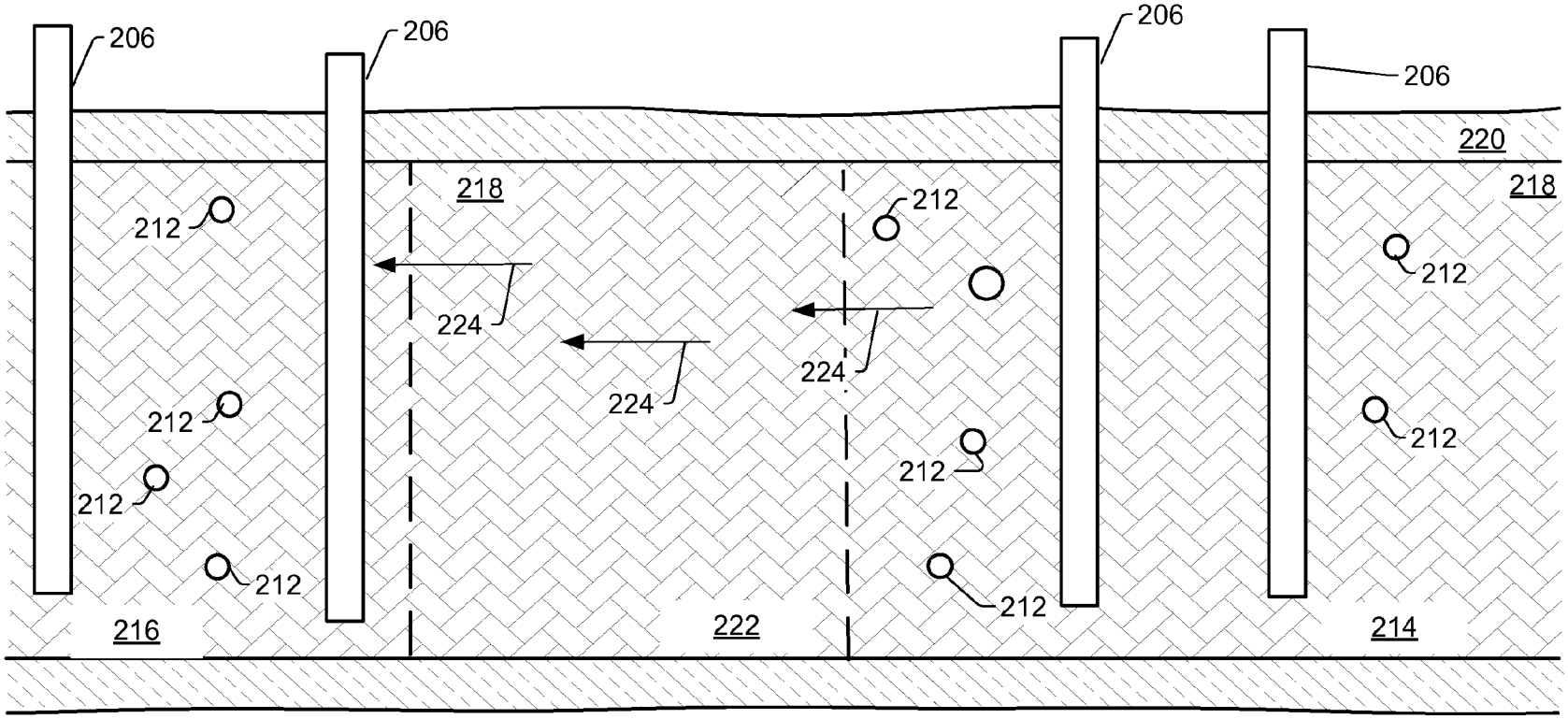
FIG. 2 depicts a representation of an embodiment of treating hydrocarbon formations containing sulfur and/or inorganic nitrogen compounds.
Figure 3:
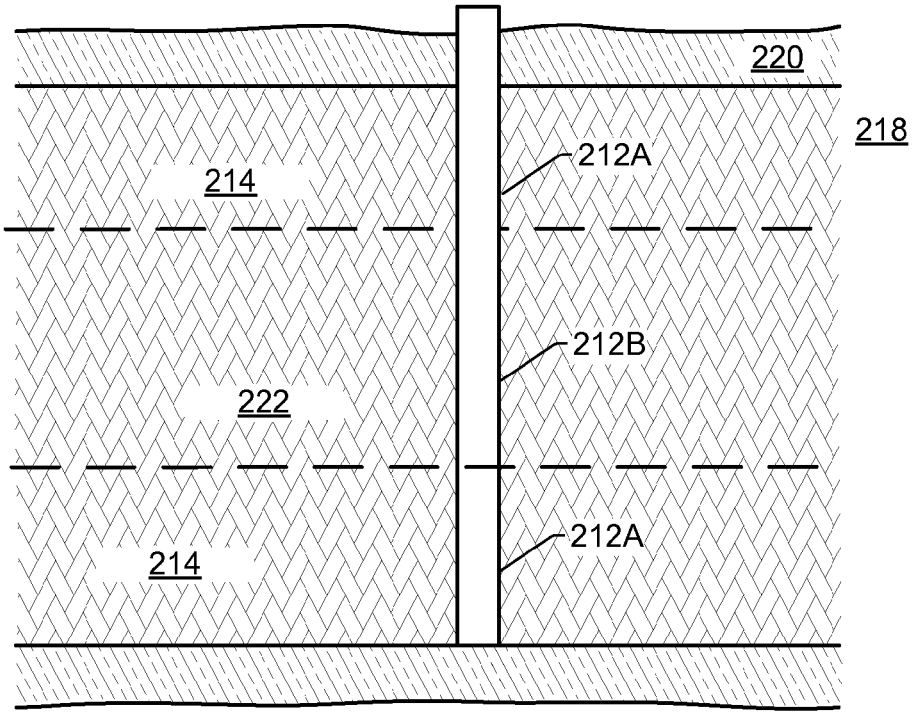
FIG. 3 depicts a representation of an embodiment of treating hydrocarbon formations containing inorganic compounds using selected heating.
Figure 4:
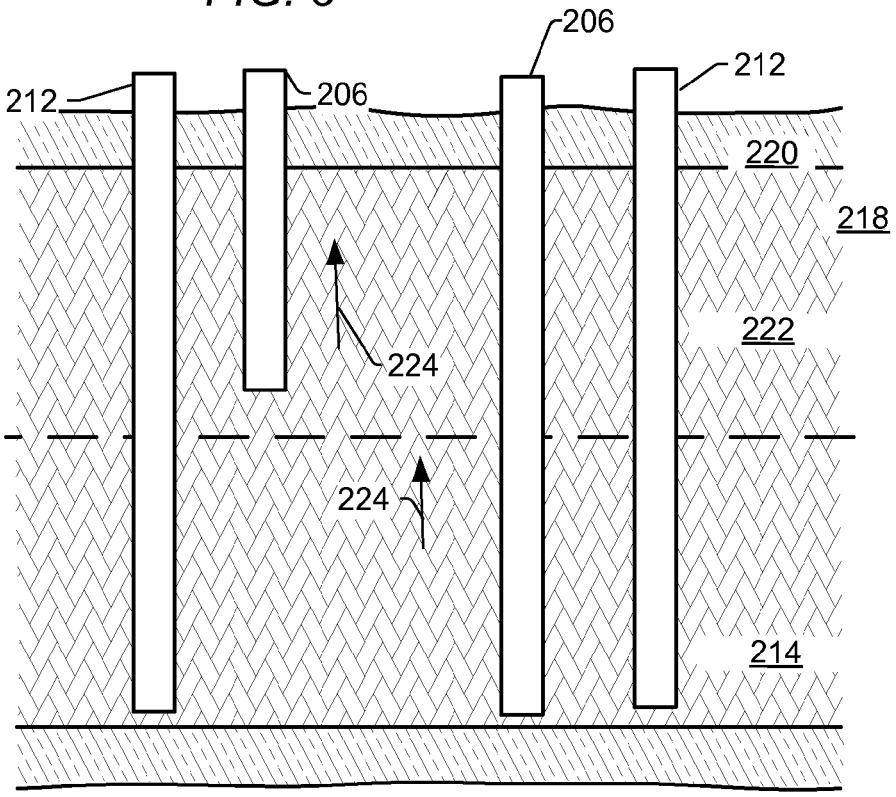
FIG. 4 depicts a representation of an embodiment of treating hydrocarbon formation using an in situ heat treatment process with subsurface removal of mercury from formation fluid.

FIGS. 2 through 4 depict representations of embodiments of treating hydrocarbon formations containing inorganic sulfur and/or inorganic nitrogen compounds. FIG. 2 is a representation of an embodiment of treating hydrocarbon formations containing sulfur and/or inorganic nitrogen compounds. FIG. 3 depicts a representation of an embodiment of treating hydrocarbon formations containing inorganic compounds using selected heating. FIG. 4 depicts a representation of an embodiment of treating hydrocarbon formation using an in situ heat treatment process with subsurface removal of mercury from formation fluid.

Heat from heaters 212 may heat portions of first section 214 and/or third section 216 of hydrocarbon layer 218. Hydrocarbon layer may be below overburden 220. As shown in FIG. 2, heaters in the first section and third section may be substantially horizontal. Heaters 212 may go in and out of the page. Untreated second section 222 is between first section 214 and third section 216. Although shown in a horizontal configuration, it should be understood that second section 222 may be, in some embodiments, substantially above first section 214 and substantially below third section 216 in the formation. Untreated second section 222 may include inorganic sulfur and/or inorganic nitrogen compounds. For example, second section 222 may include pyrite. Heat from heaters 212 may pyrolyze and/or mobilize a portion of hydrocarbons in first section 214 and/or third section 216. Hydrocarbons may be produced through productions wells 206 in first section 214 and/or third section 216.

As shown in FIG. 3, heater 212 is substantially vertical and extends through sections 214, 222. Heat from portions 212A of heater 212 may provide heat to first section 214 of hydrocarbon layer 218. Portion 212B of heater 212A may be inhibited from providing heat below a mobilization and/or a pyrolyzation temperature to second section 222. Hydrocarbons may be mobilized in first section 214 and third section 216, and produced from the formation using production well 206.

In some embodiments, hydrocarbons in first section 214 may include mercury and/or mercury compounds and second section 222 contains troilite and/or pyrite. Heat from heaters 212 may heat portions of first section 214 and/or third section 216 of hydrocarbon layer 218.

Hydrocarbons may be pyrolyzed and/or mobilized in first section 214. As shown in FIG. 2, hydrocarbons may move from first section 214 through untreated second section 222 towards third section 216 as shown by arrows 224. Pressure in heater wells may be adjusted to push gaseous hydrocarbons into second section 222. In some embodiments, a drive fluid, for example, carbon dioxide is used to drive the gaseous hydrocarbons towards second section 222. In certain embodiments, gaseous hydrocarbons are produced from the third section 216 and liquid hydrocarbons are produced from first section 214.

As shown in FIG. 4, heat from heaters 212 heats second section 222 to convert some of the inorganic sulfur in the second section to a form of inorganic sulfur reactive to mercury (for example, pyrite is converted to troilite). As shown, second section 222 is substantially above first section 214, but it should be understood that the second section and first section may be oriented in any manner. After heating second section 222, heat from heaters 212 may heat first section 214 and heat hydrocarbons to a mobilization temperature. Hydrocarbons gases may move from first section 214 through heated second section 222 and be produced from production wells 206 in the second section as shown by arrows 224. Pressure in heater wells may be adjusted to push hydrocarbons into second section 222. During production of hydrocarbons from first section 214, casing vents of the production wells 206 of the first section may be closed with production pumps running so that liquid hydrocarbons are produced through the tubing of the production wells. Such production may prevent any entrainment of liquid hydrocarbons in second section 222.

As the hydrocarbons flow through second section 222, contact of hydrocarbons with inorganic sulfur (for example, pyrite and/or troilite) in the second section may complex and/or react with mercury and/or mercury compounds. Contact of mercury and/or mercury compounds with pyrite may remove the mercury and/or mercury compounds from the hydrocarbons. In some embodiments, insoluble mercury sulfides are formed that precipitate from the hydrocarbons. Mercury free hydrocarbons may be produced through productions wells 206 in second sections 222 (as shown in FIG. 4 and/or third section 216 (as shown in FIG. 2)).

In some embodiments, a hydrocarbon containing formation is treated using an in situ heat treatment process to remove methane from the formation. The hydrocarbon containing formation may be an oil shale formation and/or contain coal. In some embodiments, a barrier is formed around the portion to be heated. In some embodiments, the hydrocarbon containing formation includes a coal containing layer (a deep coal seam) underneath a layer of oil shale. The coal containing layer may contain significantly more methane than the oil shale layer. For example, the coal containing layer may have a volume of methane that is five times greater than a volume of methane in the oil shale layer. Wellbores may be formed that extend through the oil shale layer into the coal containing layer.

Heat may be provided to the hydrocarbon containing formation from a plurality of heaters located in the formation. One or more of the heaters may be temperature limited heaters and or one or more insulated conductors (for example, a mineral insulated conductor). The heating may be controlled to allow treatment of the oil shale layer while maintaining a temperature of the coal containing layer below a pyrolysis temperature.

After treatment of the oil shale layer, heaters may be extended into the coal containing layer. The temperature in the coal containing layer may be maintained below a pyrolysis temperature of hydrocarbons in the formation. In some embodiments, the coal containing layer is maintained at a temperature from about 30° C. to 40° C. As the temperature of the coal containing layer increases, methane may be released from the formation. The methane may be produced from the coal containing layer. In some embodiments, hydrocarbons having a carbon number between 1 and 5 are released from the coal continuing layer of the formation and produced from the formation.

In certain embodiments, a temperature limited heater is utilized for heavy oil applications (for example, treatment of relatively permeable formations or tar sands formations). A temperature limited heater may provide a relatively low Curie temperature and/or phase transformation temperature range so that a maximum average operating temperature of the heater is less than 350° C., 300° C., 250° C., 225° C., 200° C., or 150° C. In an embodiment (for example, for a tar sands formation), a maximum temperature of the temperature limited heater is less than about 250° C. to inhibit olefin generation and production of other cracked products. In some embodiments, a maximum temperature of the temperature limited heater is above about 250° C. to produce lighter hydrocarbon products. In some embodiments, the maximum temperature of the heater may be at or less than about 500° C.

A heat source (heater) may heat a volume of formation adjacent to a production wellbore (a near production wellbore region) so that the temperature of fluid in the production wellbore and in the volume adjacent to the production wellbore is less than the temperature that causes degradation of the fluid. The heat source may be located in the production wellbore or near the production wellbore. In some embodiments, the heat source is a temperature limited heater. In some embodiments, two or more heat sources may supply heat to the volume. Heat from the heat source may reduce the viscosity of crude oil in or near the production wellbore. In some embodiments, heat from the heat source mobilizes fluids in or near the production wellbore and/or enhances the flow of fluids to the production wellbore. In some embodiments, reducing the viscosity of crude oil allows or enhances gas lifting of heavy oil (at most about 10° API gravity oil) or intermediate gravity oil (approximately 12° to 20° API gravity oil) from the production wellbore. In certain embodiments, the initial API gravity of oil in the formation is at most 10°, at most 20°, at most 25°, or at most 30°. In certain embodiments, the viscosity of oil in the formation is at least 0.05 Pa·s (50 cp). In some embodiments, the viscosity of oil in the formation is at least 0.10 Pa·s (100 cp), at least 0.15 Pa·s (150 cp), or at least at least 0.20 Pa·s (200 cp). Large amounts of natural gas may have to be utilized to provide gas lift of oil with viscosities above 0.05 Pa·s. Reducing the viscosity of oil at or near the production wellbore in the formation to a viscosity of 0.05 Pa·s (50 cp), 0.03 Pa·s (30 cp), 0.02 Pa·s (20 cp), 0.01 Pa·s (10 cp), or less (down to 0.001 Pa·s (1 cp) or lower) lowers the amount of natural gas or other fluid needed to lift oil from the formation. In some embodiments, reduced viscosity oil is produced by other methods such as pumping.

The rate of production of oil from the formation may be increased by raising the temperature at or near a production wellbore to reduce the viscosity of the oil in the formation in and adjacent to the production wellbore. In certain embodiments, the rate of production of oil from the formation is increased by 2 times, 3 times, 4 times, or greater over standard cold production with no external heating of the formation during production. Certain formations may be more economically viable for enhanced oil production using the heating of the near production wellbore region. Formations that have a cold production rate approximately between 0.05 $m^3$/(day per meter of wellbore length) and 0.20 $m^3$/(day per meter of wellbore length) may have significant improvements in production rate using heating to reduce the viscosity in the near production wellbore region. In some formations, production wells up to 775 m, up to 1000 m, or up to 1500 m in length are used. Thus, a significant increase in production is achievable in some formations. Heating the near production wellbore region may be used in formations where the cold production rate is not between 0.05 $m^3$/(day per meter of wellbore length) and 0.20 $m^3$/(day per meter of wellbore length), but heating such formations may not be as economically favorable. Higher cold production rates may not be significantly increased by heating the near wellbore region, while lower production rates may not be increased to an economically useful value.

Using the temperature limited heater to reduce the viscosity of oil at or near the production well inhibits problems associated with non-temperature limited heaters and heating the oil in the formation due to hot spots. One possible problem is that non-temperature limited heaters can cause coking of oil at or near the production well if the heater overheats the oil because the heaters are at too high a temperature. Higher temperatures in the production well may also cause brine to boil in the well, which may lead to scale formation in the well. Non-temperature limited heaters that reach higher temperatures may also cause damage to other wellbore components (for example, screens used for sand control, pumps, or valves). Hot spots may be caused by portions of the formation expanding against or collapsing on the heater. In some embodiments, the heater (either the temperature limited heater or another type of non-temperature limited heater) has sections that are lower because of sagging over long heater distances. These lower sections may sit in heavy oil or bitumen that collects in lower portions of the wellbore. At these lower sections, the heater may develop hot spots due to coking of the heavy oil or bitumen. A standard non-temperature limited heater may overheat at these hot spots, thus producing a non-uniform amount of heat along the length of the heater. Using the temperature limited heater may inhibit overheating of the heater at hot spots or lower sections and provide more uniform heating along the length of the wellbore.

In some embodiments, a hydrocarbon formation may be treated using an in situ heat treatment process based on assessment of the stability or product quality of the formation fluid produced from the formation. Asphaltenes may be produced through thermal cracking and condensation of hydrocarbons produced during a thermal conversion. The produced asphaltenes are a complex mixture of high molecular weight compounds containing polyaromatic rings and short side chains. The structure and/or aromaticity of the asphaltenes may affect the solubility of the asphaltenes in the produced formation fluids. During heating of the formation, at least a portion of the asphaltenes in the formation may react with other asphaltenes and form coke or higher molecular weight asphaltenes. Higher molecular weight asphaltenes may be less soluble in produced formation fluid that includes lower molecular weight compounds (for example, produced formation fluid that includes a significant amount of naphtha or kerosene). As formation fluids are converted to liquid hydrocarbons and the lower boiling hydrocarbons and/or gases are produced from the formation, the type of asphaltenes and/or solubility of the asphaltenes in the formation fluid may change. In conventional processing, as the formation is heated, the weight percent of asphaltenes and/or the H/C molar ratio of the asphaltenes may decrease relative to an initial weight percent of asphaltenes and/or the H/C molar ratio of the asphaltenes. In some instances, the asphaltene content may decrease due to the asphaltenes forming coke in the formation. In other instances, the H/C molar ratio may change depending on the type of asphaltene being produced in the formation.

In some embodiments, antioxidants (for example, sulfates) are provided to a hydrocarbon formation to inhibit formation of coke. Antioxidants may be added to a hydrocarbon containing formation during formation of wellbores. For example, antioxidants may be added to drilling mud during drilling operations. Addition of antioxidants to the hydrocarbon formation may inhibit production of radicals during heating of the hydrocarbon formation, thus inhibiting production of higher molecular compounds (for example, coke).

Produced formation fluid may be separated into a liquid stream and a gas stream. The separated liquid stream may be blended with other hydrocarbon fractions, blended with additives to stabilize the asphaltenes, distilled, deasphalted, and/or filtered to remove components (for example, asphaltenes) that contribute to the instability of the liquid hydrocarbon stream. These treatments, however, may require costly solvents and/or be inefficient. Methods to produce liquid hydrocarbon streams that have good product stability are desired.

Adjustment of the asphaltene content of the hydrocarbons in situ may produce liquid hydrocarbon streams that require little to no treatment to stabilize the product with regard to precipitation of asphaltenes. In some embodiments, an asphaltene content of the hydrocarbons produced during an in situ heat treatment process may be adjusted in the formation. Changing an aliphatic content of the hydrocarbons in the formation may cause subsurface deasphalting and/or solubilization of asphaltenes in the hydrocarbons. Subsurface deasphalting of the hydrocarbons may produce solids that precipitate from the formation fluid and remain in the formation.

In some embodiments, heat from a plurality of heaters may be provided to a section located in the formation. The heat may transfer from the heaters to heat a portion of the section. In some embodiments, the portion of the section may be heated to a selected temperature (for example, the portion may be heated to about 220° C., about 230° C., or about 240° C.). Hydrocarbons in the section may be mobilized and produced from the formation. A portion of the produced hydrocarbons may be assessed using P-value, H/C molar ratio, and/or a volume ratio of naphtha/kerosene to hydrocarbons having a boiling point of at least 520° C. in a portion of produced formation fluids, and the stability of the produced hydrocarbons may be determined Based on the assessed value, the asphaltene content, the asphaltenes H/C molar ratio of the hydrocarbons, and/or a volume ratio of naphtha/kerosene to heavy hydrocarbons in a portion of fluids in the formation may be adjusted.

In some embodiments, the asphaltene content of the hydrocarbons may be adjusted based on a selected P-value. If the P-value is greater than a selected value (for example, greater than 1.1 or greater than 1.5), the hydrocarbons produced from the formation may be have acceptable asphaltene stability and the asphaltene content is not adjusted. If the P-value of the portion of the hydrocarbons is less than the selected value, the asphaltene content of the hydrocarbons in the formation may be adjusted.

In some embodiments, assessing the asphaltene H/C molar ratio in produced hydrocarbons may indicate that the type of asphaltenes in the hydrocarbons in the formation is changing. Adjustment of the asphaltene content of the hydrocarbons in the formation based on the asphaltenes H/C molar ratio in at least a portion of the produced hydrocarbons or when the asphaltenes H/C molar ratio reaches a selected value may produce liquid hydrocarbons that are suitable for transportation or further processing. The asphaltene content may be adjusted when the asphaltene H/C molar ratio of at least a portion of the produced hydrocarbons is less than about 0.8, less than about 0.9, or less than about 1. An asphaltene H/C molar ratio of greater than 1 may indicate that the asphaltenes are soluble in the produced hydrocarbons. The asphaltene H/C molar ratio may be monitored over time and the asphaltene content may be adjusted at a rate to inhibit a net reduction of the assessed asphaltene H/C molar ratio over the monitored time period.

In some embodiments, a volume ratio of naphtha/kerosene to heavy hydrocarbons in the formation may be adjusted based on an assessed volume ratio of naphtha/kerosene to hydrocarbons having a boiling point of at least 520° C. in a portion of produced formation fluids. Adjustment of the volume ratio may allow a portion of the asphaltenes in the formation to precipitate from formation fluid and/or maintain the solubility of the asphaltenes in the produced hydrocarbons. An assessed value of a volume ratio of naphtha/kerosene to hydrocarbons having a boiling point of at least 520° C. of greater than 10 may indicate adjustment of the ratio is necessary. An assessed value of a volume ratio of naphtha/kerosene to hydrocarbons having a boiling point of at least 520° C. of from about 0 to about 10 may indicate that asphaltenes are sufficiently solubilized in the produced hydrocarbons. Solubilization of asphaltenes in hydrocarbons in the formation may inhibit a net reduction in a weight percentage of asphaltenes in hydrocarbons in the formation over time Inhibiting a net reduction of asphaltenes may allow production of hydrocarbons that require minimal or no treatment to inhibit asphaltenes from precipitating from the produce hydrocarbons during transportation and/or further processing.

In some embodiments, the manner in which a hydrocarbon formation is heated affects where in situ deasphalting fluid is produced. A formation may be heated by energizing heaters in the formation simultaneously, or approximately at the same time, to heat one or more sections of the formation to or near the same temperature. Simultaneously heating sections of the formation to or near the same temperature may produce hydrocarbons having a boiling point less than 260° C. throughout the heated formation. Mixing of hydrocarbons having a boiling point less than 260° C. with mobilized hydrocarbons present in the formation may reduce the solubility of asphaltenes in the mobilized hydrocarbons and force at least a portion of the asphaltenes to precipitate from the mobilized hydrocarbons in the heated formation. Production of the mixed hydrocarbons throughout the heated formation may lead to precipitation of asphaltenes at the surface, and thus cause problems in surface facilities and/or piping.

It has been unexpectedly found that heating the hydrocarbon formation in phases may allow in situ deasphalting fluid to be formed in selected sections (for example, lower sections of the formation) of the formation. Deasphalting hydrocarbons in lower sections of the formation may sequester undesirable asphaltenes in the formation. Thus, precipitation of asphaltenes from the produced hydrocarbons is reduced or avoided.

Figure 5:
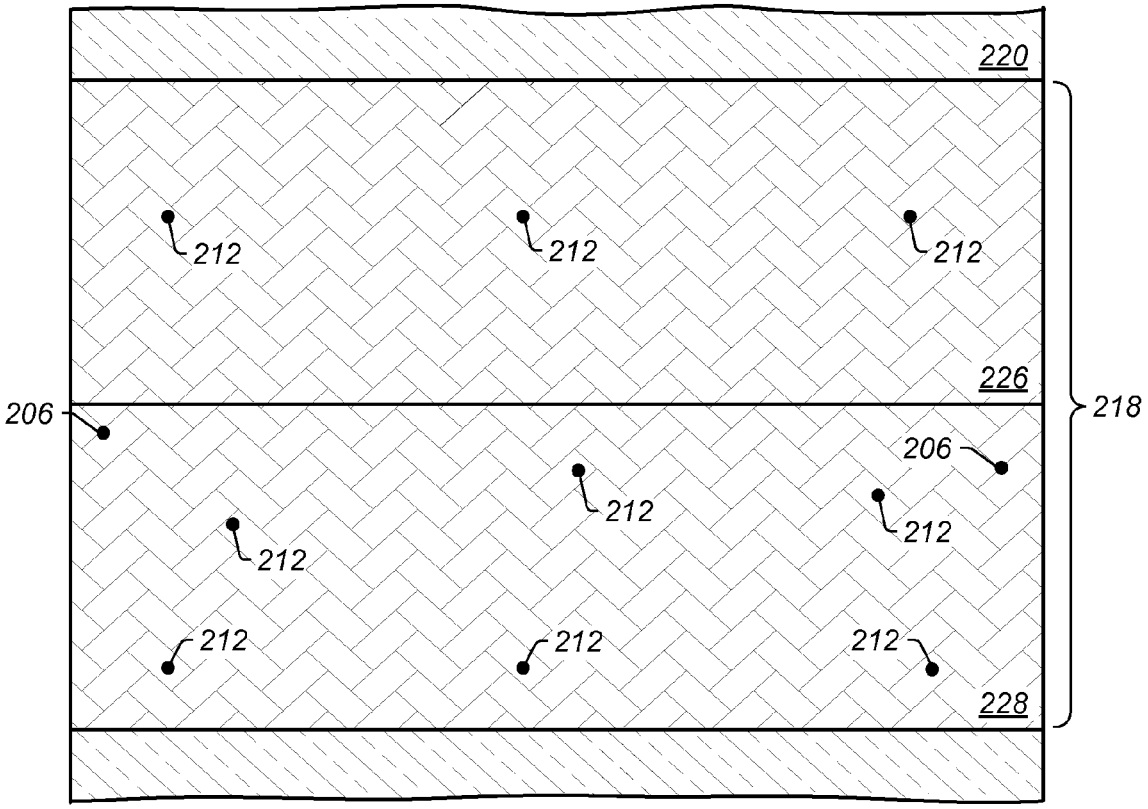
FIG. 5 depicts a representation of an embodiment of in situ deasphalting of hydrocarbons in a hydrocarbon formation heated in phases.

FIG. 5 is a representation of an embodiment of in situ deasphalting of hydrocarbons in a hydrocarbon formation heated in phases. Heaters 212 in hydrocarbon layer 218 may provide heat to one or more sections of the hydrocarbon layer. Heaters 212 may be substantially horizontal in the hydrocarbon layer. Heaters 212 may be arranged in any pattern to optimize heating of portions of first section 226 and/or portions of second section 228. Heaters may be turned on or off at different times to heat the sections of the formation in phases. For example, heaters in first section 226 may be turned on for a period of time to heat hydrocarbons in the first section. Heaters in portions of second section 228 may be turned on after the first section has been heated for a period of time. For example, heaters in second section 228 may be turned on, or begin heating, within about 9 months, about 24 months, or about 36 months from the time heaters 212 first section 226 begin heating.

The temperature in first section 226 may be raised to a pyrolysis temperature and pyrolysis of formation fluid in the first section may generate an in situ deasphalting fluid. The in situ deasphalting fluid may be a mixture of hydrocarbons having a boiling range distribution between −5° C. and about 300° C., or between −5° C. and about 260° C. In some embodiments, some of the in situ deasphalting fluid is produced (removed) from first section 226.

An average temperature in second section 228 may be lower than an average temperature in first section 226. Due to the lower temperature in second section 228, the in situ deasphalting fluid may drain into the second section. The temperature and pressure in second section 228 may be controlled such that substantially all of the in situ deasphalting fluid is present as a liquid in the second section. The in situ deasphalting fluid may contact hydrocarbons in second section 228 and cause asphaltenes to precipitate from the hydrocarbons in the section, thus removing asphaltenes from hydrocarbons in the second section. At least a portion of the deasphalted hydrocarbons may be produced from the formation through production wells 206 in an upper portion of second section 228.

Deasphalted hydrocarbons produced from the formation may be suitable for transportation, have a P-value greater than 1.5, and/or an asphaltene H/C molar ratio of at least 1. In some embodiments, the produced deasphalted hydrocarbons contain at least a portion of the in situ deasphalting fluid.

In some embodiments, the in situ deasphalting fluid mixes with mobilized hydrocarbons and changes the volume ratio of naphtha/kerosene to heavy hydrocarbons such that asphaltenes are solubilized in the mobilized hydrocarbons. At least a portion of the hydrocarbons containing solubilized asphaltenes may be produced from production wells 206.

During the heating process and production of hydrocarbons from the hydrocarbon formation, the volume ratio of naphtha/kerosene to heavy hydrocarbons may be monitored. Initially, the volume ratio may be constant and as asphaltenes are removed from the formation (for example, through in situ deasphalting or through production) the volume ratio increases. An increase in the volume ratio may indicate that the amount of asphaltenes is diminishing and that conditions for deasphalting and/or solubilizing asphaltenes are not favorable.

Hydrocarbons containing solubilized asphaltenes produced from the formation may be suitable for transportation, have a P-value greater than 1.5, and/or an asphaltene H/C molar ratio of at least 1. In some embodiments, the produced hydrocarbons containing solubilized asphaltenes contain at least a portion of the in situ deasphalting fluid.

In some embodiments, the asphaltene content, asphaltene H/C molar ratio, and/or volume ratio of naphtha/kerosene to heavy hydrocarbons may be adjusted by providing hydrocarbons to the formation. The hydrocarbons may include, but are not limited to, hydrocarbons having a boiling range distribution between 35° C. and 260° C., hydrocarbons having a boiling range distribution between 38° C. and 200° C. (naphtha), hydrocarbons having a boiling range distribution between 204° C. and 260° C. (kerosene), bitumen, or mixtures thereof. The hydrocarbons may be provided to the section through a production well, injection well, heater well, monitoring well, or combinations thereof.

Figure 6:
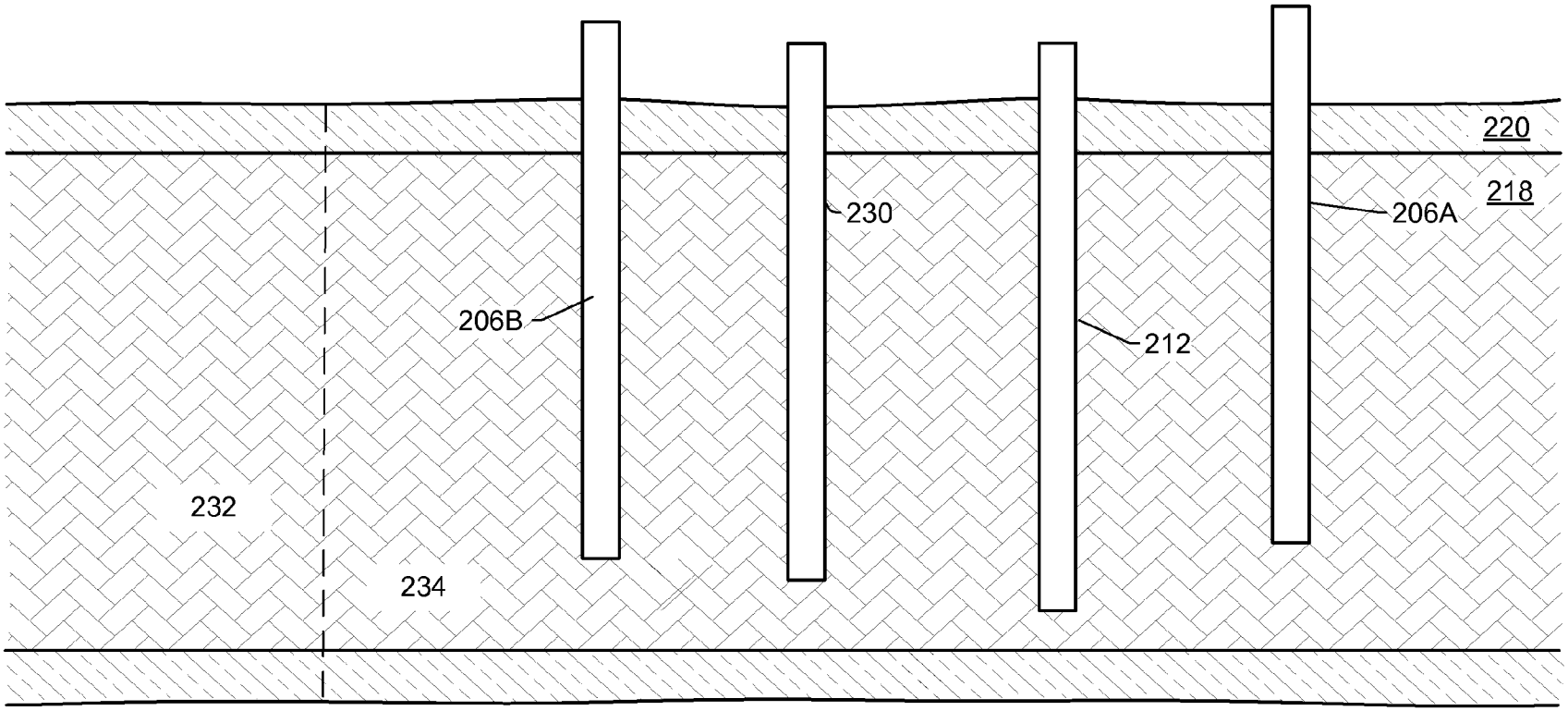
FIG. 6 depicts a representation of an embodiment of production and subsequent treating of a hydrocarbon formation to produce formation fluid.

In some embodiments, the hydrocarbons added to the formation may be produced from an in situ heat treatment process. FIG. 6 is a representation of an embodiment of production and subsequent treating of a hydrocarbon formation to produce formation fluid. Heat from heaters 212 in hydrocarbon layer 218 may mobilize heavy hydrocarbons and/or bitumen towards production well 206A. Hydrocarbons may be produced from production well 206A and may include liquid hydrocarbons having a boiling range distribution between 50° C. and 600° C. and/or bitumen.

Hydrocarbons used for in situ deasphalting may be injected into hydrocarbon layer 218 of the formation through injection well 230. Hydrocarbons may be injected at a sufficient pressure to allow mixing of the injected hydrocarbons with heavy hydrocarbons in hydrocarbon layer 218. Contact or mixing of hydrocarbons with heavy hydrocarbons in hydrocarbon layer 218 may remove at least a portion of the asphaltenes from the hydrocarbons in a section of the hydrocarbon layer. The resulting deasphalted hydrocarbons may be produced from the formation through production well 206B.

In some embodiment, contact or mixing of hydrocarbons with heavy hydrocarbons in hydrocarbon layer 218 may change the volume ratio of naphtha/kerosene to heavy hydrocarbons in the section such that the hydrocarbons produced from production well 206B are deemed suitable for transportation or processing as assessed by P-value, asphaltene H/C molar ratio, volume ratio of naphtha/kerosene to hydrocarbons having a boiling point greater than 520° C. or other methods known in the art to assess asphaltene stability.

In some embodiments, moving hydrocarbons from one section of the formation to another section of the formation may be used to adjust the asphaltene content and/or volume ratio of naphtha/kerosene to heavy hydrocarbons in the formation. In some embodiments, bitumen flows from section 232 into section 234 to change the volume ratio of naphtha/kerosene to heavy hydrocarbons to solubilize asphaltenes in the mobilized hydrocarbons present in section 234. Solubilization of asphaltenes may inhibit a net reduction in a weight percentage of asphaltenes over time. The produced mobilized hydrocarbons may have an acceptable volume ratio of naphtha/kerosene to hydrocarbons having a boiling point greater than 520° C. and are deemed suitable for transportation or processing as assessed by P-value, asphaltene H/C molar ratio, volume ratio of naphtha/kerosene to hydrocarbons having a boiling point greater than 520° C. or other methods known in the art to assess asphaltene stability.

In some embodiments, a section of the formation is heated to a temperature sufficient to pyrolyze at least a portion of the formation fluids and generate hydrocarbons having a boiling point less than 260° C. The generated hydrocarbons may act as an in situ deasphalting fluid. The generated hydrocarbons may move from a first section of the formation and mix with hydrocarbons in a second section of the formation. Mixing of hydrocarbons having a boiling point less than 260° C. with mobilized hydrocarbons present in the formation may reduce the solubility of asphaltenes in the mobilized hydrocarbons and force at least a portion of the asphaltenes to precipitate from the mobilized hydrocarbons.

The precipitated asphaltenes may remain in the formation when the deasphalted mobilized hydrocarbons are produced from the formation. In some embodiments, the precipitated asphaltenes may form solid material. The produced deasphalted hydrocarbons may have acceptable P-values (for example, P-value greater than 1 or 1.5) and/or asphaltene H/C molar ratios (asphaltene H/C molar ratio of at least 1). The deasphalted hydrocarbons may be produced from the formation. The produced deasphalted hydrocarbons have acceptable asphaltene stability and are suitable for transportation or further processing. The produced deasphalted hydrocarbons may require no or very little treatment to inhibit asphaltene precipitation from the hydrocarbon stream when further processed.

In some embodiments, hydrocarbons having a boiling point less than 260° C. may be generated in a first section of the formation and migrate through an upper portion of the first section to an upper portion of a second section. In the upper portion of the second section, the hydrocarbons having a boiling point less than 260° C. may contact hydrocarbons in the second section of the formation. Such contact may remove at least a portion of the asphaltene from the hydrocarbons in the upper portion of second section. At least a portion of the deasphalted hydrocarbons may be produced from the formation.

In some embodiments, formation fluid may be produced from productions wells in a lower portion of the second section which may allow at least a portion of hydrocarbons having a boiling point less than 260° C. to drain to and, in some embodiments, condense in the lower portion of the second section. Contact of the hydrocarbons having a boiling point less than 260° C. with mobilized hydrocarbons in the lower portion of the second section may cause asphaltenes to precipitate from the hydrocarbons in the second section, thus removing asphaltenes from hydrocarbons in the second section. At least a portion of the deasphalted hydrocarbons may be produced from production wells in a lower portion of the second section. In some embodiments, deasphalted hydrocarbons are produced from other sections of the formation.

In some embodiments, contact of hydrocarbons having a boiling point less than 260° C. with mobilized hydrocarbons in the upper and/or lower portion of the second section may rebalance the naphtha/kerosene to heavy hydrocarbons volume ratio and solubilize asphaltenes in the mobilized hydrocarbons in the section. Solubilization of asphaltenes may inhibit a net reduction in a weight percentage of asphaltenes over time and, thus produce a more stabile product. Mobilized hydrocarbons may be produced from the formation. The mobilized hydrocarbons produced from the second section may be exhibit more stabile properties than mobilized hydrocarbons produced from the first section.

Generation and migration of hydrocarbons having a boiling point less than 260° C. may be selectively controlled using operating conditions (for example, heating rate, average temperatures in the formation, and production rates) in the first, second and/or third sections.

Figure 7:
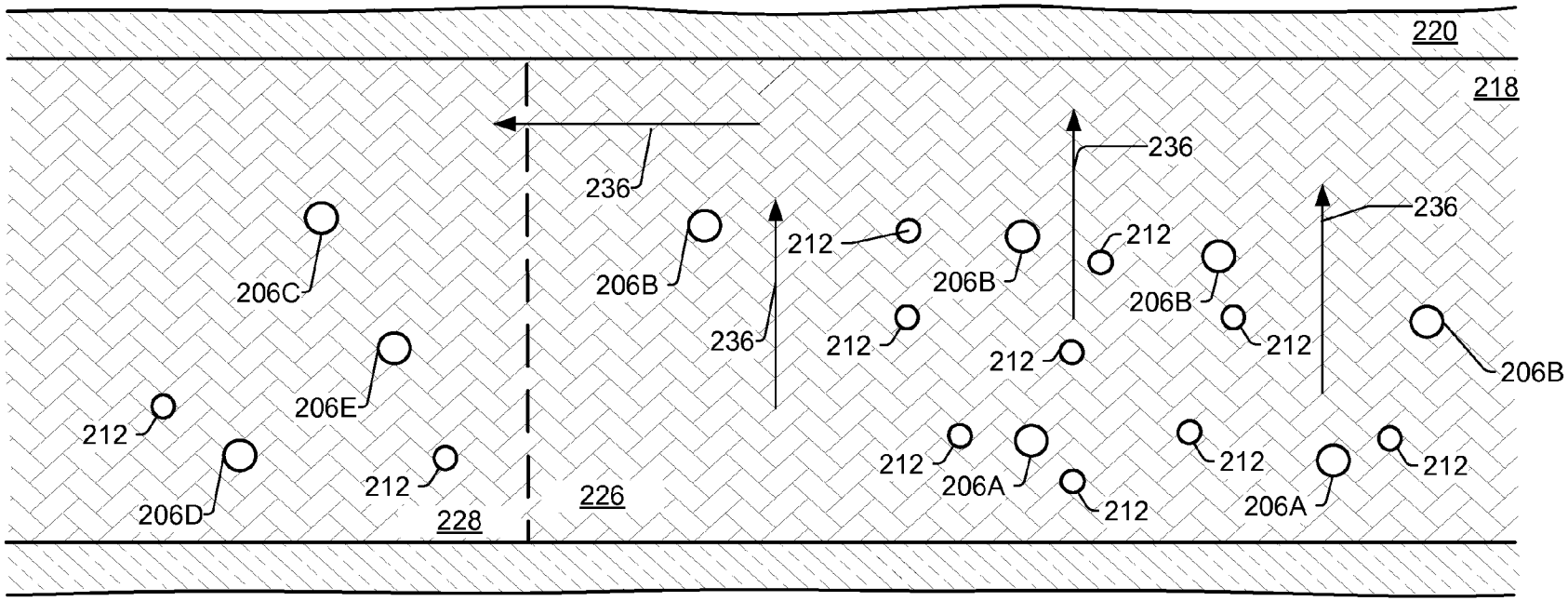
FIG. 7 depicts a representation of an embodiment of production of use of an in situ deasphalting fluid in treating a hydrocarbon formation.

FIG. 7 is a representation of an embodiment of production of in situ deasphalting fluid and use of the in situ deasphalting fluid in treating a hydrocarbon formation using an in situ heat treatment process. Heaters 212 in hydrocarbon layer 218 may provide heat to one or more sections of the hydrocarbon layer. Heaters 212 may be substantially horizontal in the hydrocarbon layer. Heaters 212 may be arranged in any pattern to optimize heating of portions of first section 226 and/or portions of second section 228. Bitumen and/or liquid hydrocarbons may be produced from a lower portion of first section 226 through production wells 206A. The temperature in the lower portion of first section 226 may be raised to a pyrolysis temperature and pyrolysis of formation fluid in the lower portion may generate an in situ deasphalting fluid. The in situ deasphalting fluid may be a mixture of hydrocarbons having a boiling range distribution between −5° C. and about 300° C., or between −5° C. and about 260° C.

In some embodiments, production well 206A and/or other wells in first section 226 may be shut in to allow the in situ deasphalting fluid to mix with hydrocarbons in the lower portion of the first section. The in situ deasphalting fluid may contact hydrocarbons in first section 226 and cause at least a portion of asphaltenes to precipitate from the hydrocarbons, thus removing the asphaltenes from the hydrocarbons in the formation. The deasphalted hydrocarbons may be mobilized and produced from the formation through production wells 206B in an upper portion of first section 226.

At least a portion of in situ deasphalting fluid vaporizes in the upper portion of first section 226 and move towards an upper portion of second section 228 as shown by arrows 236. An average temperature in second section 228 may be lower than an average temperature of first section 226. Due to the lower temperature in second section 228, the in situ deasphalting fluid may condense in the second section. The temperature and pressure in second section 228 may be controlled such that substantially all of the in situ deasphalting fluid is present as a liquid in the second section. The in situ deasphalting fluid may contact hydrocarbons in second section 228 and cause asphaltenes to precipitate from the hydrocarbons in the section, thus removing asphaltenes from hydrocarbons in the second section. At least a portion of the deasphalted hydrocarbons may be produced from the formation through production wells 206C in an upper portion of second section 228. In some embodiments, deasphalted hydrocarbons are moved to a third section of hydrocarbon layer 218 and produced from the third section.

In some embodiments, formation fluid may be produced from productions wells 206D in a lower portion of second section 228. Production of formation fluid from production wells 206D in the lower portion of second section 228 may allow at least a portion of the in situ deasphalting fluid to drain to the lower portion of the second section. Contact of the in situ deasphalting fluid with hydrocarbons in a lower portion of second section 228 may cause asphaltenes to precipitate from the hydrocarbons in the section, thus removing asphaltenes from hydrocarbons in the second section. At least a portion of the deasphalted hydrocarbons may be produced from production wells 206E in the middle portion of second section 228. In some embodiments, deasphalted hydrocarbons are not produced in second section 228, but flow or are moved towards a third section in hydrocarbon layer 218 and produced from the third section. The third section may be substantially below or substantially adjacent to second section 228.

Deasphalted hydrocarbons produced from the formation may be suitable for transportation, have a P-value greater than 1.5, and/or an asphaltene H/C molar ratio of at least 1. In some embodiments, the produced deasphalted hydrocarbons contain at least a portion of the in situ deasphalting fluid.

In some embodiments, the in situ deasphalting fluid mixes with mobilized hydrocarbons and changes the volume ratio of naphtha/kerosene to heavy hydrocarbons such that asphaltenes are solubilized in the mobilized hydrocarbons. At least a portion of the hydrocarbons containing solubilized asphaltenes may be produced from production wells 206E in a bottom portion of second section 228. In some embodiments, hydrocarbons containing solubilized asphaltenes are produced from a third section of the formation. Hydrocarbons containing solubilized asphaltenes produced from the formation may be suitable for transportation, have a P-value greater than 1.5, and/or an asphaltene H/C molar ratio of at least 1. In some embodiments, the produced hydrocarbons containing solubilized asphaltenes contain at least a portion of the in situ deasphalting fluid.

Fractures may be created by expansion of the heated portion of the formation matrix. Heating in shallow portions of a formation (for example, at a depth ranging from about 150 m to about 400 m) may cause expansion of the formation and create fractures in the overburden. Expansion in a formation may occur rapidly when the formation is heated at temperatures below pyrolysis temperatures. For example, the formation may be heated to an average temperature of up to about 200° C. Expansion in the formation is generally much slower when the formation is heated at average temperatures ranging from about 200° C. to about 350° C. At temperatures above pyrolysis temperatures (for example, temperatures ranging from about 230° C. to about 900° C., from about 240° C. to about 400° C. or from about 250° C. to about 350° C.), there may be little or no expansion in the formation. In some formations, there may be compaction of the formation above pyrolysis temperatures.

In some embodiments, a formation includes an upper layer and lower layer with similar formation matrixes that have different initial porosities. For example, the lower layer may have sufficient initial porosity such that the thermal expansion of the upper layer is minimal or substantially none whereas the upper layer may not have sufficient initial porosity so the upper layer expands when heated.

In some embodiments, a hydrocarbon formation is heated in stages using an in situ heat treatment process to allow production of formation fluids from a shallow portion of the formation. Heating layers of a hydrocarbon formation in stages may control thermal expansion of the formation and inhibit overburden fracturing. Heating an upper layer of the formation after significant pyrolysis of a lower layer of the formation occurs may reduce, inhibit, and/or accommodate the effects of pressure in the formation, thus inhibiting fracturing of the overburden. Staged heating of layers of a hydrocarbon formation may allow production of hydrocarbons from shallow portions of the formation that otherwise could not be produced due to fracturing of the overburden.

Figure 8A:
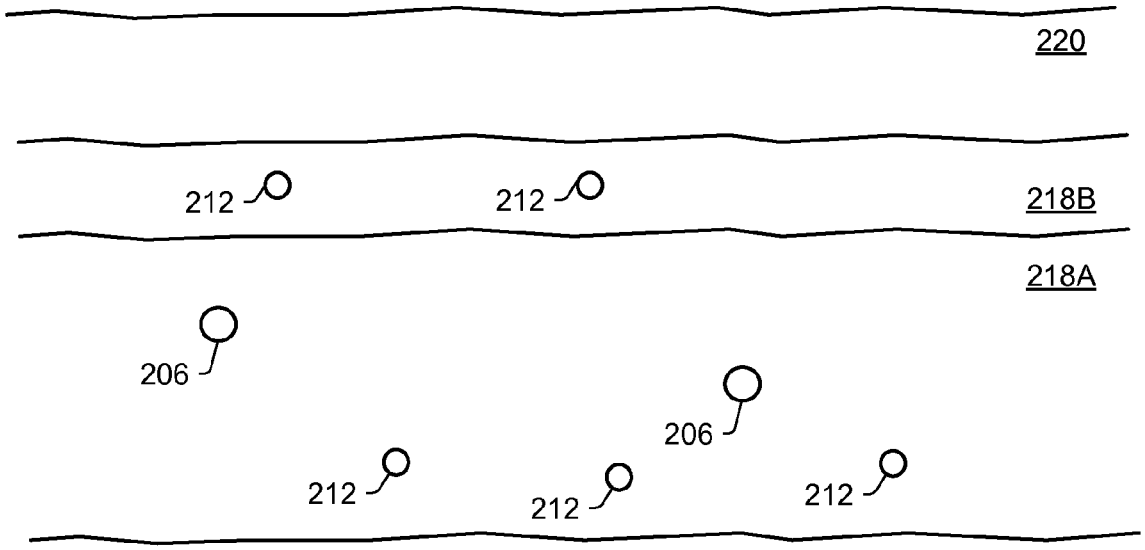
FIGS. 8A and 8B depict side view representations of an embodiment of heating a hydrocarbon containing formation in stages.
Figure 8B:
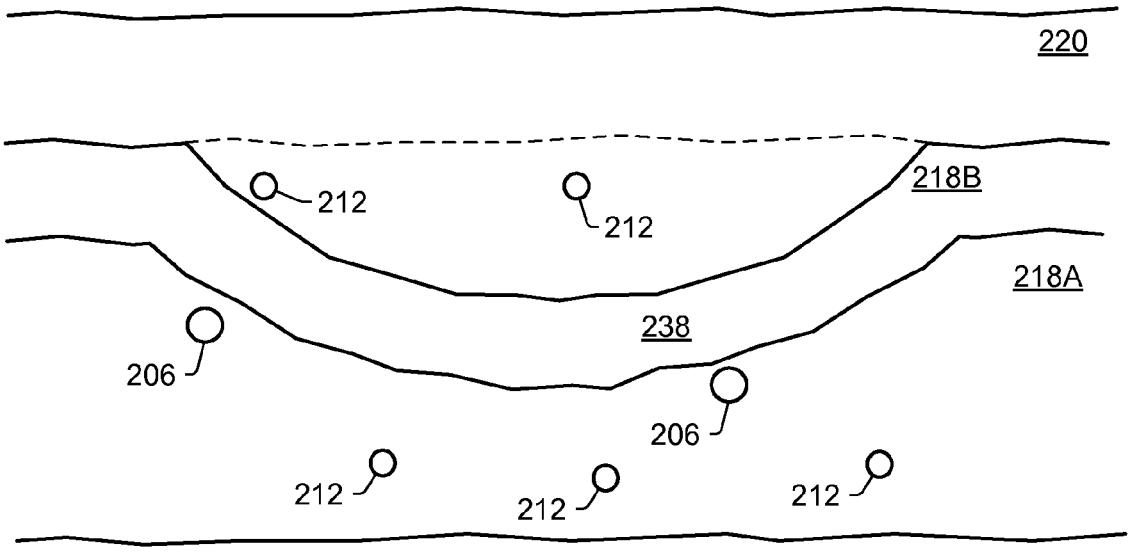

FIGS. 8A and 8B depict representations of an embodiment of heating a hydrocarbon containing formation in stages. Heating lower layer 218A prior to heating upper layer 218B may reduce and/or control the effects of thermal expansion in the formation during a selected period of time. FIG. 8A depicts hydrocarbon layer having lower layer 218A and upper layer 218B. Lower layer 218A may be heated a selected period of time to create permeability and/or porosity in the lower layer to allow thermal expansion of upper layer 218B into lower layer 218A. In some embodiments, a lower layer of the formation is heated above a pyrolyzation temperature. In some embodiments, a lower layer of the formation is heated an average temperature during in situ heat treatment of the formation ranging from at least 230° C. or from about 230° C. to about 370° C. During the selected period of time, some (and some cases significant amount of) thermal expansion may take place in lower layer 218A.

Heating of lower layer 218A prior to heating upper layer 218B may control expansion of the upper layer and inhibit fracturing of overburden 220. Heating of the lower layer 218A at temperatures greater than pyrolyzation temperatures may create sufficient permeability and/or porosity in lower layer 218A that upon heating upper layer 218B fluids and/or materials in the upper layer may thermally expand and flow into the lower layer. Sufficient permeability and/or porosity in lower layer 218A may be created to allow pressure generated during heating of upper layer 218B to be released into the lower layer and not the overburden, and thus, fracturing of the overburden may be prevented/inhibited.

The depth of lower layer 218A and upper layer 218B in the formation may be selected to maximize expansion of the upper layer into the lower layer. For example, a depth of lower layer 218A may be at least from about 400 m to about 750 m from the surface of the formation. A depth of upper layer 218B may be about 150 m to about 400 m from the surface of the formation. In some embodiments, lower layer 218A of the formation may have different thermal conductivities and/or different thermal expansion coefficients than layer 218B. Fluid from lower layer 218A may be produced from the lower layer using production wells 206. Hydrocarbons produced from lower layer 218A prior to heating upper layer 218B may include mobilized and/or pyrolyzed hydrocarbons.

The depth of layers in the formation may be determined by simulation, calculation, or any suitable method for estimating the extent of expansion that will occur in a layer when the layer is heated to a selected average temperature. The amount of expansion caused by heating of the formation may be estimated based on factors such as, but not limited to, measured or estimated richness of layers in the formation, thermal conductivity of layers in the formation, thermal expansion coefficients (for example, a linear thermal expansion coefficient) of layers in the formation, formation stresses, and expected temperature of layers in the formation. Simulations may also take into effect strength characteristics of a rock matrix.

In certain embodiments, heaters 212 in lower layer 218A may be turned on for a selected period of time. Heaters 212 in lower layer 218A and upper layer 218B may be vertical or horizontal heaters. After heating lower layer 218A for a period of time, heaters 212 in upper layer 218B may be turned on. In some embodiments, heaters 212 in lower layer 218A are vertical heaters that are raised to upper layer 218B after the lower layer is heated for a selected period of time. Any pattern or number of heaters may be used to heat the layers.

Heaters 212 in upper layer 218B may be turned on at, or near, the completion of heating of lower layer 218A. For example, heaters 212 in upper layer 218B may be turned on, or begin heating, within about 9 months, about 24 months, or about 36 months from the time heaters 212 in lower layer 218A begin heating. Heaters 212 in upper layer 218B may be turned on after a selected amount of pyrolyzation, and/or hydrocarbon production has occurred in lower layer 218A. In one embodiment, heaters 212 in upper layer 218B are turned on after sufficient permeability in lower layer 218A is created and/or pyrolyzation of lower layer 218A has been completed. Treatment of lower layer 218A may sufficient when the layer lower layer is sufficiently compacted as determined using optic fiber techniques (for example, real-time compaction imaging) or radioactive bullets, when average temperature of the formation is at least 230° C., or greater than 260° C., and/or when production of at least 10%, at least 20%, or at least 30% of the expected volume of hydrocarbons has occurred.

Upper layer 218B may be heated by heaters 212 at a rate sufficient to allow expansion of the upper layer into lower layer 218A and thus inhibit fracturing of the overburden. Portion 238 of upper layer 218B may sag into lower layer 218A as shown in 8B. Upon heating, sagged portion 238 of upper layer 218B may expand back to the surface (for example, return to the flat shape depicted in FIG. 8A). Allowing the upper layer to sag into the lower layer and expand back to the surface may inhibit or lower tensile stress in the overburden that may result in surface fissures. Heaters 212 may heat upper layer 218B to an average temperature from about 200° C. to about 370° C. for a selected amount of time.

After and/or during of treatment of upper layer 218B, fluids from the upper and lower layer may be produced from the lower layer using production well 206. Hydrocarbons produced from production well 206 may include pyrolyzed hydrocarbons from the upper layer. In some embodiments, fluids are produced from upper layer 218B.

In some embodiments, a formation containing dolomite and hydrocarbons is treated using an in situ heat treatment process. Hydrocarbons may be mobilized and produced from the formation. During treating of a formation containing dolomite, the dolomite may decompose to form magnesium oxide, carbon dioxide, calcium oxide and water ($MgCO_3.CaCO_3$)→$CaCO_3$+MgO+$CO_2$. Calcium carbonate may further decompose to calcium oxide and carbon dioxide (CaO and $CO_2$). During treating, the dolomite may decompose and form intermediate compounds. Upon heating, the intermediate compounds may decompose to form additional magnesium oxide, carbon dioxide and water.

In certain embodiments, during or after treating a formation with an in situ heat treatment process, carbon dioxide and/or steam is introduced into the formation. The carbon dioxide and/or steam may be introduced at high pressures. The carbon dioxide and/or steam may react with magnesium compounds and calcium compounds in the formation to generate dolomite or other mineral compounds in situ. For example, magnesium carbonate compounds and/or calcium carbonate compounds may be formed in addition to dolomite. Formation conditions may be controlled so that the carbon dioxide, water and magnesium oxide react to form dolomite and/or other mineral compounds. The generated minerals may solidify and form a barrier to a flow of formation fluid into or out of the formation. The generation of dolomite and/or other mineral compounds may allow for economical treatment and/or disposal of carbon dioxide and water produced during treatment of a formation. In some embodiments, carbon dioxide produced from formations may be stored and injected in the formation with steam at high pressure. In some embodiments, the steam includes calcium compounds and/or magnesium compounds.

In some embodiments, a drive process (or steam injection, for example, SAGD, cyclic steam soak, or another steam recovery process) and/or in situ heat treatment process are used to treat the formation and produce hydrocarbons from the formation. Treating the formation using the drive process and/or in situ heat treatment process may not treat the formation uniformly. Variations in the properties of the formation (for example, fluid injectivities, permeabilities, and/or porosities) may result in insufficient heat to raise the temperature of one or more portions of the formation to mobilize and move hydrocarbons due to channeling of the heat (for example, channeling of steam) in the formation. In some embodiments, the formation has portions that have been heated to a temperature of at most 200° C. or at most 100° C. After the drive process and/or in situ heat treatment process is completed, the formation may have portions that have lower amounts of hydrocarbons produced (more hydrocarbons remaining) than other parts of the formation.

In some embodiments, a formation that has been previously treated may be assessed to determine one or more portions of the formation that have not been heated to a sufficient temperature using a drive process and/or an in situ heat treatment process. Coring, logging techniques, and/or seismic imaging may be used to assess hydrocarbons remaining in the formation and assess the location of one or more of the portions. The untreated portions may contain at least 50%, at least 60%, at least 80% or at least 90% of the initial hydrocarbons. In some embodiments, the portions with more hydrocarbons remaining are large portions of the formation. In some embodiments, the amount of hydrocarbons remaining in untreated portions is significantly higher than treated portions of the formation. For example, an untreated portion may have a recovery of at most about 10% of the hydrocarbons in place and a treated portion may have a recovery of at least about 50% of the hydrocarbons in place.

In some embodiments, heaters are placed in the untreated portions to provide heat to the portion. Heat from the heaters may raise the temperature in the untreated portion to an average temperature of at least about 200° C. to mobilize hydrocarbons in the untreated portion.

In certain embodiments, a drive fluid may be injected in the untreated portion after the average temperature of the portion has been raised using an in situ heat treatment process. Injection of a drive fluid may mobilize hydrocarbons in the untreated portion toward one or more productions wells in the formation. In some embodiments, the drive fluid is injected in the untreated portion to raise the temperature of the portion.

Figure 9:
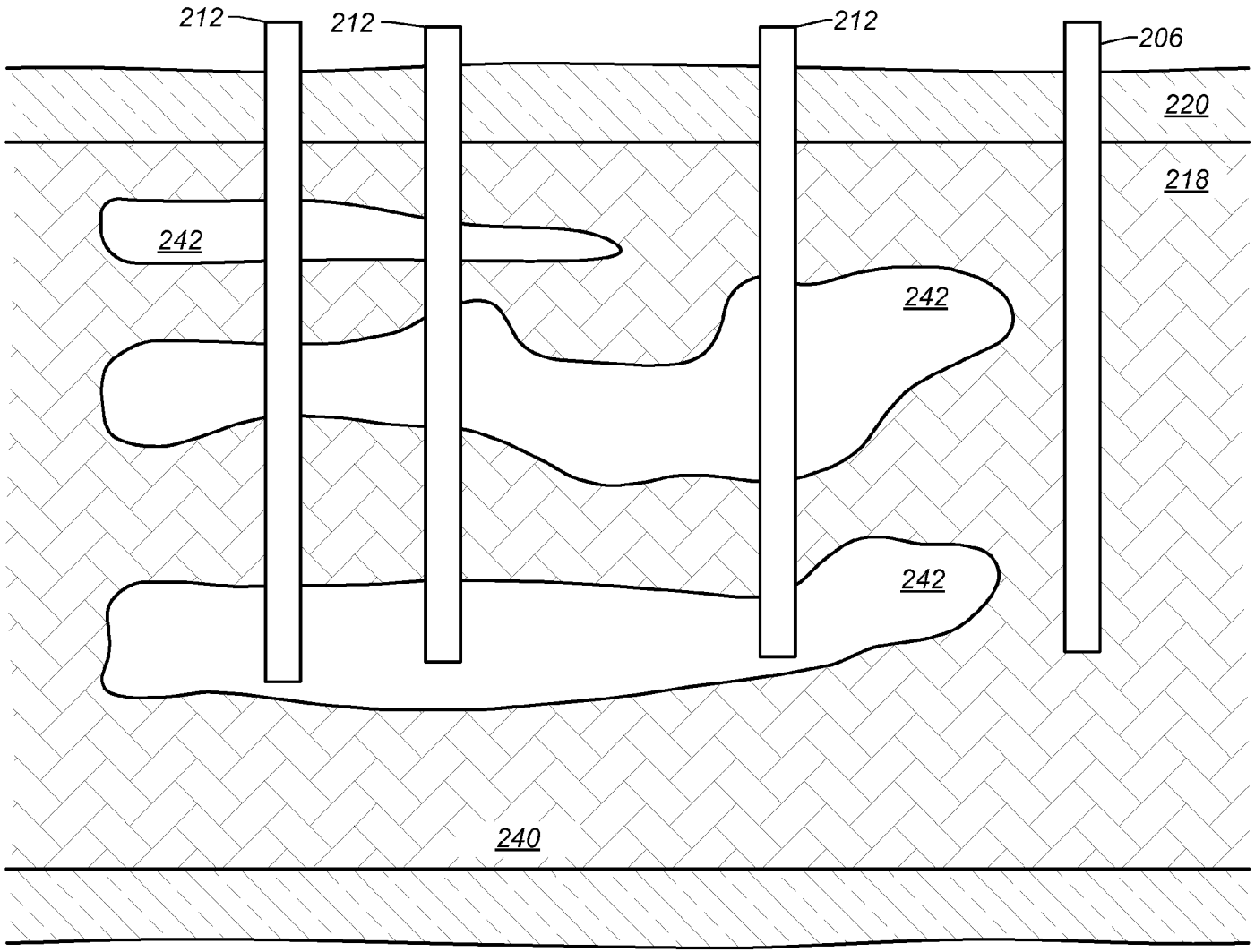
FIG. 9 depicts a side view representation of an embodiment of treating a tar sands formation after treatment of the formation using a steam injection process and/or an in situ heat treatment process.
Figure 10:
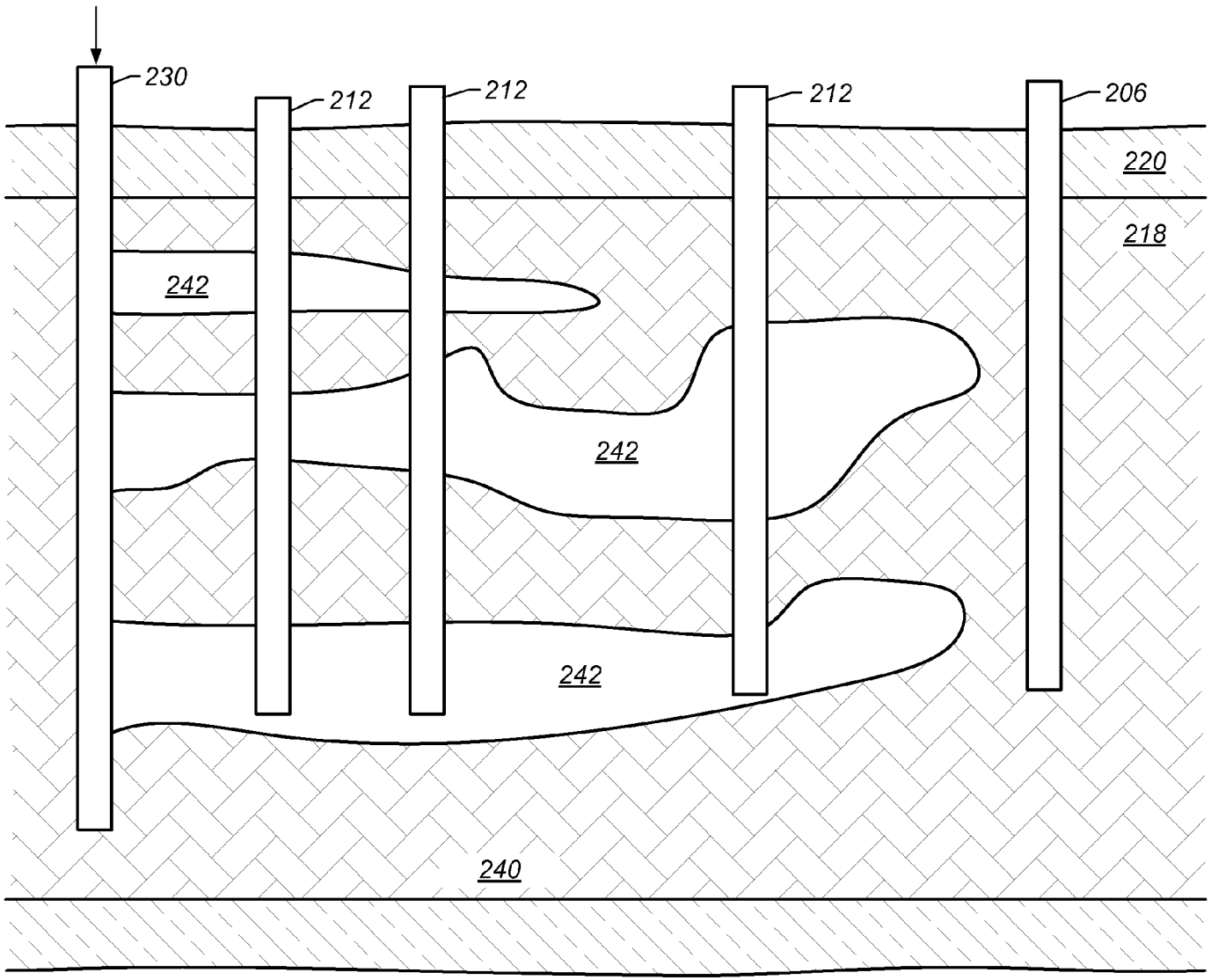
FIG. 10 depicts a side view representation of another embodiment of treating a tar sands formation after treatment of the formation using a steam injection process and/or an in situ heat treatment process.

FIGS. 9 and 10 depict side view representations of embodiments of treating a tar sands formation after treatment of the formation using a steam injection process and/or an in situ heat treatment process. Hydrocarbon layer 218 may have been previously treated using a steam injection process and/or an in situ heat treatment process. Portion 240 of hydrocarbon layer 218 may have had measurable amounts of hydrocarbons removed by a steam injection process and/or an in situ heat treatment process. Portions 242 in hydrocarbon layer 218 may have been near treated portions (for example, portion 240) however, an average temperature in portions 242 was not sufficient to heat the portions and mobilize hydrocarbons in the portions. Thus, portion 242 remains untreated and may have a greater amount of hydrocarbons remaining than portions 240 following treatment with the steam injection process and/or an in situ heat treatment process. In some embodiments, hydrocarbon layer 218 includes two or more portions 242 with more hydrocarbons remaining than portions 240.

Heaters 212 may be placed in untreated portions 242 to provide additional heat to these portions. Heat from heaters 212 may raise an average temperature in portions 242 to mobilized hydrocarbons in the portions. Hydrocarbons mobilized from portions 242 may be produced from the production well 206.

In some embodiments, a drive fluid is provided to untreated portions 242 after heating with heaters 212. As shown in FIG. 10, injection well 230 is used to inject a drive fluid (for example, steam and/or hot carbon dioxide) into hydrocarbon layer 218 below overburden 220. The drive fluid moves mobilized hydrocarbons in portions 242 towards production well 206. In some embodiments, the drive fluid is provided to untreated portions 242 prior to heating with heaters 212 and/or heaters 212 are not necessary.

In some embodiments, formation fluid produced from hydrocarbon containing formations using an in situ heat treatment process may have an API gravity of at least 20°, at least 25°, at least 30°, at least 35° or at least 40°. In certain embodiments, the in situ heat treatment process provides substantially uniform heating of the hydrocarbon containing formation. Due to the substantially uniform heating the formation fluid produced from a hydrocarbon containing formation may contain lower amounts of halogenated compounds (for example, chlorides and fluorides) arsenic or compounds of arsenic, ammonium carbonate and/or ammonium bicarbonate as compared to formation fluids produced from conventional processing (for example, surface retorting or subsurface retorting). The produced formation fluid may contain non-hydrocarbon gases, hydrocarbons, or mixtures thereof. The hydrocarbons may have a carbon number ranging from 5 to 30.

Hydrocarbon containing formations (for example, oil shale formations and/or tar sands formations) may contain significant amounts of bitumen entrained in the mineral matrix of the formation and/or a significant amounts of bitumen in shallow layers of the formation. Heating hydrocarbon formations containing entrained bitumen to high temperatures may produce of non-condensable hydrocarbons and non-hydrocarbon gases instead of liquid hydrocarbons and/or bitumen. Heating shallow formation layers containing bitumen may also result in a significant amount of gaseous products produced from the formation. Methods and/or systems of heating hydrocarbon formations having entrained bitumen at lower temperatures that convert portions of the formation to bitumen and/or lower molecular weight hydrocarbons and/or increases permeability in the hydrocarbon containing formation to produce liquid hydrocarbons and/or bitumen are desired.

In some embodiments, an oil shale formation is heated using an in situ heat treatment process using a plurality of heaters. Heat from the heaters is allowed to heat portions of the oil shale formation to an average temperature that allows conversion of at least a portion of kerogen in the formation to bitumen, other hydrocarbons. Heating of the formation may create permeability in the oil shale to mobilize the bitumen and/or other hydrocarbons entrained in the kerogen. The oil shale formation may include at least 20%, at least 30% or at least 50% bitumen. The oil shale formation may be heated to an average temperature ranging from about 250° C. to about 350° C., from about 260° C. to about 340° C., or from about 270° C. to about 330° C. Heating at temperatures at or below pyrolysis temperatures may inhibit production of hydrocarbon gases and/or non-hydrocarbon gases, convert portions of the kerogen to bitumen and/or increase permeability in the mineral matrix such that the bitumen is released from the mineral matrix. The bitumen may be mobilized towards production wells and produced through production wells and/or heater wells in the oil shale formation. The produced bitumen may be processed to produce commercial products.

In some embodiments, production rates from two or more production wells located in a treatment area of a hydrocarbon containing formation are controlled to produce bitumen and/or liquid hydrocarbons having selected qualities. In some embodiments, the hydrocarbon containing formation is an oil shale formation. Selective control of operating conditions (for example, heating rate, average temperatures in the formation, and production rates) may allow production of bitumen from a first production well located in the first portion of the hydrocarbon containing formation and production of liquid hydrocarbons from one or more second production wells located in another portion of the hydrocarbon containing formation. In some embodiments, the liquid hydrocarbons produced from the second production wells contain none or substantially no bitumen. Selected qualities of the liquid hydrocarbons include, but are not limited to, boiling point distribution and/or API gravity. Production of bitumen using the methods described herein from a first production well while producing mobilized and/or visbroken hydrocarbons from second production wells in a portion of the hydrocarbon formation that is at a lower temperature than other portions may inhibit coking in the second production wells. Furthermore, quality of the mobilized and/or visbroken hydrocarbons produced from the second production wells is of higher quality relative to producing hydrocarbons from a single production well since all or most of the bitumen is produced from the first production well.

In some embodiments, heat provided from heaters to the first portion of the hydrocarbon formation may be sufficient to pyrolyze hydrocarbons and/or kerogen to form an in situ drive fluid (for example, pyrolyzation fluids that contain a significant amount of gases or vaporized liquids) near heaters positioned in the first portion of the formation. In some embodiments, the heaters may be positioned around the production wells in the first portion. Pyrolysis of kerogen, bitumen, and/or hydrocarbons may produce carbon dioxide, $C_1$-$C_4$ hydrocarbons, $C_5$-$C_{25}$ hydrocarbons, and/or hydrogen. Pressure in one or more heater wellbores in the first portion may be controlled (for example, increased) such that the in situ drive fluid moves bitumen towards one or more production wells in the first portion. Bitumen may be produced from one or more productions wells in the first portion of the formation. In some embodiments, the production wells are heater wells and/or contain heaters. Providing heat to a production well or producing through a heater well may inhibit the bitumen from solidifying during production.

Bitumen produced from oil shale formations may have more hydrogen, more straight chain hydrocarbons, more hydrocarbons that contain heteroatoms (for example, sulfur, oxygen and/or nitrogen atoms), less metals and be more viscous than bitumen produced from a tar sands formation. Since the bitumen produced from an oil shale formation may be different from bitumen produced from a tar sands formation, the products produced from oil shale bitumen may have different and/or better properties than products produced from tar sands bitumen. In some embodiments, hydrocarbons separated from bitumen produced from an oil shale formation has a boiling range distribution between 343° C. and 538° C. at 0.101 MPa, a low metal content and/or a high nitrogen content which makes the hydrocarbons suitable for use as feed for refinery processes (for example, feed for a catalytic and/or thermal cracking unit to produce naphtha). Vacuum gas oil (VGO) made from bitumen produced from oil shale may have more hydrogen relative to heavy oil used in conventional processing. Other products (for example, organic sulfur compounds, organic oxygen compounds, and/or organic sulfur compounds) separated from oil shale bitumen may have commercial value or be used as solvation fluids during an in situ heat treatment process.

Figure 11:
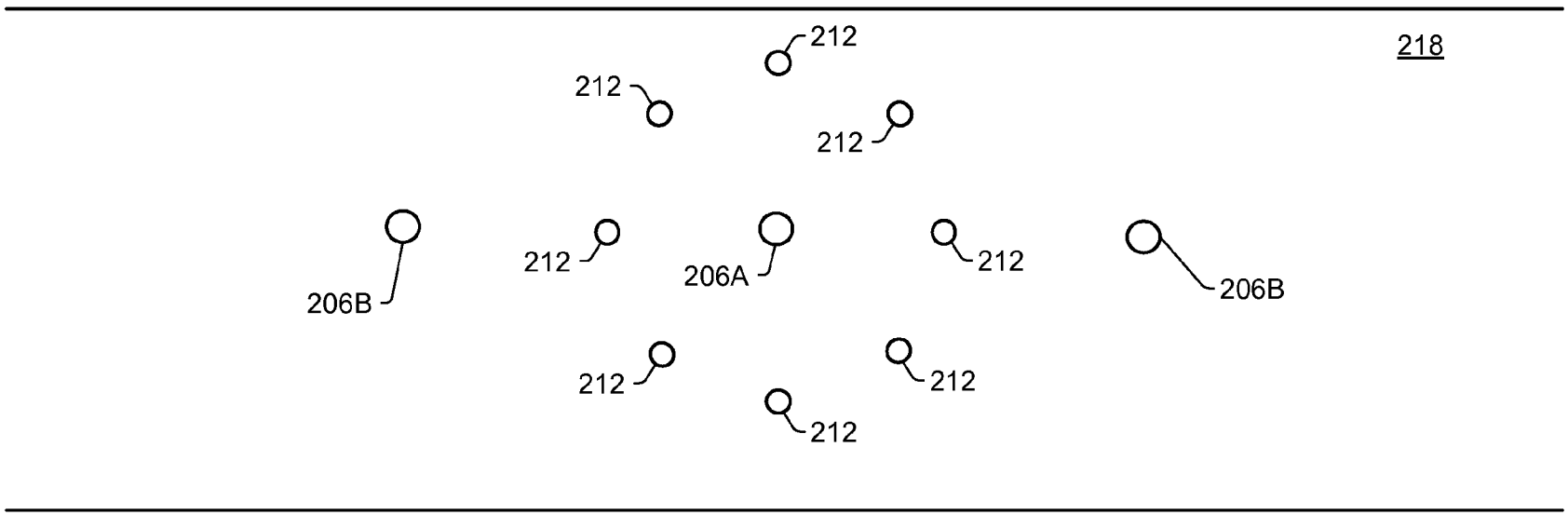
FIG. 11 depicts a top view representation of an embodiment of treatment of a hydrocarbon containing formation using an in situ heat treatment process and production of bitumen.
Figure 12:
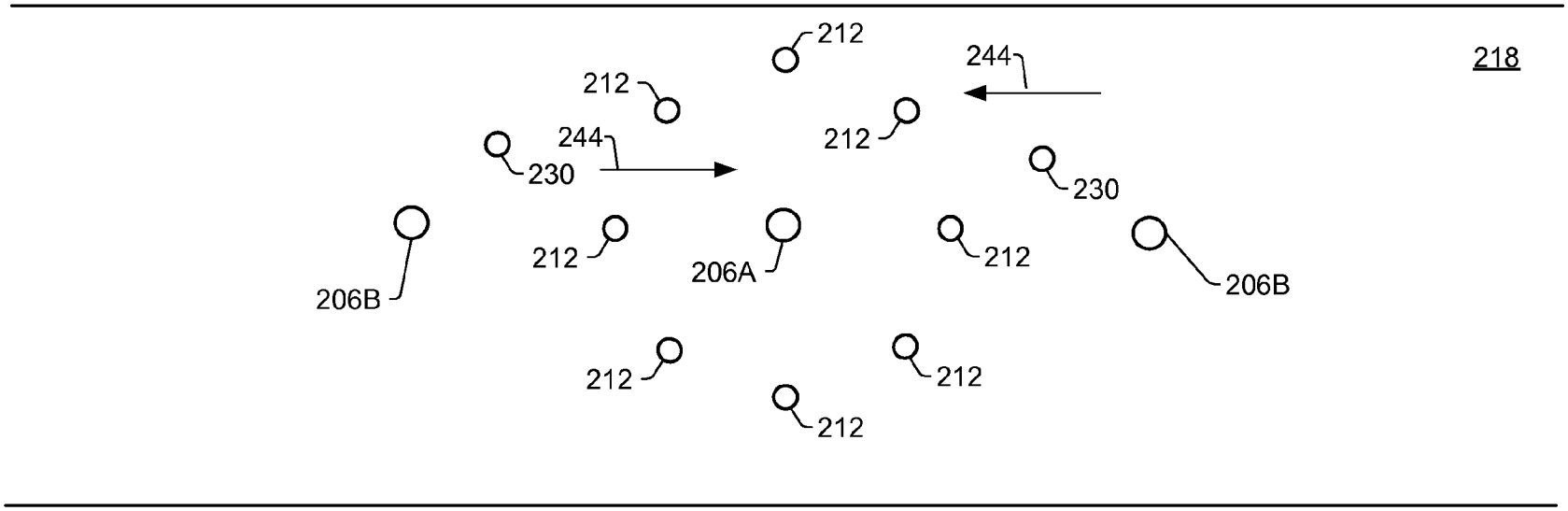
FIG. 12 depicts a top view representation of embodiment of treatment of a hydrocarbon containing formation using an in situ heat treatment process to produce liquid hydrocarbons and/or bitumen.

FIGS. 11 and 12 depict a top view representation of embodiments of treatment of a hydrocarbon containing formation using an in situ heat treatment process. In some embodiments, the hydrocarbon containing formation is an oil shale formation. Heaters 212 may be positioned in heater wells in portions of hydrocarbon layer 218 between first production well 206A and second productions wells 206B. Heaters 212 may surround first production well 206A. In some embodiments, heaters 212 and/or production wells 206A, 206B may be positioned substantially vertical in hydrocarbon layer 218. Patterns of heater wells, such as triangles, squares, rectangles, hexagons, and/or octagons may be used. In certain embodiments, portions of hydrocarbon layer 218 that include heaters 212 and production wells 206 may be surrounded by one or more perimeter barriers, either naturally occurring (for example, overburden and/or underburden) or installed (for example, barrier wells). Selective amounts of heat may be provided to portions of the treatment area as a function of the quality of formation fluid to be produced from the first and/or second production wells. Amounts of heat may be provided by varying the number and/or density of heaters in the portions. The number and spacing of heaters may be adjusted to obtain the formation fluid with the desired qualities from first production well 206A and second production wells 206B. In some embodiments, heaters 212 are spaced about 1.5 m from first production well 206A.

Heaters 212 provide heat to a first portion of hydrocarbon layer 218 between heaters 212 and first production well 206A. An average temperature in the first portion between heaters 212 and production well 206A may range from about 200° C. to about 250° C. or from about 220° C. to about 240° C. The mobilized bitumen may be produced from production well 206A. In some embodiments, production well 206A is a heater well. In some embodiments, bitumen is produced from heaters 212 surrounding production well 206A.

The produced bitumen may be treated at facilities at the production site and/or transported to other treatment facilities. In some embodiments, the temperature and pressure in the portion between heaters 212 and production well 206A is sufficient to allow bitumen entrained in the kerogen to flow out of the kerogen and move towards first production well 206A. The temperature and pressure in first production well 206A may be controlled to reduce the viscosity of the bitumen to allow the bitumen to be produced as a liquid.

Heat provided from heaters 212 may heat a second portion of hydrocarbon layer 218 proximate heaters 212 to an average temperature ranging from about 250° C. to about 300° C. or from about 270° C. to about 280° C. The average temperature in the second portion proximate heaters 212 may be sufficient to pyrolyze kerogen, visbreak bitumen, and/or mobilize hydrocarbons in the portion to generate formation fluid. The generated formation fluid may include some gaseous hydrocarbons, liquid mobilized, visbroken, and/or pyrolyzed hydrocarbons and/or bitumen. Maintaining the average temperature in the second portion proximate heaters 212 in a range from about 250° C. to about 280° C. may promote production of liquid hydrocarbons and bitumen instead of production of hydrocarbon gases near the heaters.

The pressure in portions of hydrocarbon layer 218 may be controlled to be below the lithostatic pressure of the portions near the heaters and/or production wells. The average temperature and pressure may be controlled in the portions proximate the heaters and/or production wells such that the permeability of the portions is substantially uniform. A substantially uniform permeability may inhibit channeling of the formation fluid through the portions. Having a substantially uniform permeable portion may inhibit channeling of the bitumen, mobilized hydrocarbons and/or visbroken hydrocarbons in the portion.

At least some of the formation fluid generated proximate heaters 212 may move towards second production wells 206B positioned in a third portion of hydrocarbon layer 218. Mobilized and/or visbroken hydrocarbon may be produced from second production wells 206B. Average temperatures in the third portion of hydrocarbon layer 218 proximate second production wells 206B may be less than average temperatures in the second portions near heaters 212 and/or the first portion between heaters 212 and first production wells 206A. In some embodiments, mobilized and/or visbroken hydrocarbons are cold produced from second production wells 206B. Temperature and pressure in the third portions proximate second production wells 206B may be controlled to produce mobilized and/or visbroken hydrocarbons having selected properties. In certain embodiments, hydrocarbons produced from second production wells 206B may contain a minimal amount of bitumen or hydrocarbons having a boiling point greater than 538° C. The hydrocarbons produced from production wells 206B may have an API gravity of at least 35°. In some embodiments, a majority of the hydrocarbons produced from second production wells 206B have a boiling range distribution between 343° C. and 538° C. at 0.101 MPa.

Producing mobilized and/or visbroken hydrocarbons from second production wells 206B in the third portion at a lower temperature than the first and/or second portions may inhibit coking in the second production wells and/or improve product quality of the produced mobilized and/or visbroken liquid hydrocarbons.

In some embodiments, a drive fluid is injected and/or created in the hydrocarbon containing formation to allow mobilization of bitumen and/or heavier hydrocarbons in the formation towards first production well 206A. The drive fluid may include formation fluid recovered and/or generated from the in situ heat treatment process. For example, the drive fluid may include, but is not limited to, carbon dioxide, $C_1$-$C_7$ hydrocarbons and/or steam recovered and/or generated from pyrolysis of hydrocarbons from the in situ heat treatment of the oil shale formation.

In some embodiments, heat provided to portions between heaters 212 and first production well 206A is sufficient to pyrolyze hydrocarbons and/or kerogen and generate the drive fluid in situ (for example, pyrolyzation fluids that are gases). Pressure in one or more heater wellbores may be controlled such that in situ drive fluid moves bitumen between second production wells 206B and first production well 206A towards the first production well 206A as shown by arrows 244 in FIG. 12. In some embodiments, the in situ drive fluid creates a barrier (gas cap) in the portion between heaters 212 and second production wells 206B to inhibit bitumen or heavy hydrocarbons from migrating towards the second production wells, thus allowing higher quality liquid hydrocarbons to be produced from second production wells 206B.

In some embodiments, the drive fluid and/or solvation fluid is injected in hydrocarbon layer 218 through second production wells 206B, heaters 212, or one or more injection wells 230 (shown in FIG. 12), and move bitumen in portions between second production wells 206B and first production well 206A towards the first production well. In some embodiments, the pressure in one or more of the wellbores is increased by introducing the drive fluid through the wellbore under pressure such that the drive fluid drives at least a portion of the bitumen towards first production well 206A. In some embodiments, an average temperature of the portion of the formation the solvation fluid is injected ranges from about 200° C. to about 300° C. The average temperature in the portion between heaters 212 and first production well 206A may be sufficient to pyrolyze kerogen, and/or thermally visbreak at least some the bitumen and/or solvation fluid as it moves through the portion. The driven fluid and/or solvated fluid may be cooled as it is moves towards first production well 206A. Cooling of the fluid as it approaches first production well 206A may inhibit coking of fluids in or proximate the first production well. Bitumen and/or heavy hydrocarbons containing bitumen from portions between second production wells 206B and first production well 206A may be produced from first production well 206A. In some embodiments, the formation fluid produced from first production well 206A includes solvation fluid and/or drive fluid.

In some embodiments, hydrocarbons containing heteroatoms (for example, nitrogen, sulfur and/or oxygen) are separated from the produced bitumen and used as a solvation fluid. Production and recycling of a solvation fluid containing heteroatoms may remove unwanted compounds from the bitumen. In some embodiments, organic nitrogen compounds produced from the in situ conversion process is used as a solvation fluid. The organic nitrogen compounds may be injected into a formation having a high concentration of sulfur containing compounds. The organic nitrogen compounds may react and/or complex with the sulfur or sulfur compounds and form compounds that have chemical characteristics that facilitate removal of the sulfur from the formation fluid.

In certain embodiments, high molecular organonitrogen compounds may be used as solvation fluids. The high molecular weight organonitrogen compounds may be produced from an in situ heat treatment process, injected in the formation, produced from the formation, and re-injected in the formation. Heating of the high molecular weight organonitrogen compounds in the formation may reduce the molecular weight of the organonitrogen compounds and form lower molecular weight organonitrogen compounds. Formation of lower molecular weight organonitrogen compounds may facilitate removal of nitrogen compounds from liquid hydrocarbons and/or formation fluid in surface treatment facilities.

In an embodiment, a blend made from hydrocarbon mixtures produced from an in situ heat treatment process is used as a solvation fluid. The blend may include about 20% by weight light hydrocarbons (or blending agent) or greater (for example, about 50% by weight or about 80% by weight light hydrocarbons) and about 80% by weight heavy hydrocarbons or less (for example, about 50% by weight or about 20% by weight heavy hydrocarbons). The weight percentage of light hydrocarbons and heavy hydrocarbons may vary depending on, for example, a weight distribution (or API gravity) of light and heavy hydrocarbons, an aromatic content of the hydrocarbons, a relative stability of the blend, or a desired API gravity of the blend. For example, the weight percentage of light hydrocarbons in the blend may be at most 50% by weight or at most 20% by weight. In certain embodiments, the weight percentage of light hydrocarbons may be selected to mix the least amount of light hydrocarbons with heavy hydrocarbons that produces a blend with a desired density or viscosity. In some embodiments, the hydrocarbons have an aromatic content of at least 1% by weight, at least 5% by weight, at least 10% by weight, at least 20% by weight, or at least 25% by weight.

In some embodiments, polymers and/or monomers may be used as solvation fluids. Polymers and/or monomers may solvate and/or drive hydrocarbons to allow mobilization of the hydrocarbons towards one or more production wells. The polymer and/or monomer may reduce the mobility of a water phase in pores of the hydrocarbon containing formation. The reduction of water mobility may allow the hydrocarbons to be more easily mobilized through the hydrocarbon containing formation. Polymers that may be used include, but are not limited to, polyacrylamides, partially hydrolyzed polyacrylamide, polyacrylates, ethylenic copolymers, biopolymers, carboxymethylcellulose, polyvinyl alcohol, polystyrene sulfonates, polyvinylpyrrolidone, AMPS (2-acrylamide-2-methyl propane sulfonate), or combinations thereof. Examples of ethylenic copolymers include copolymers of acrylic acid and acrylamide, acrylic acid and lauryl acrylate, lauryl acrylate and acrylamide. Examples of biopolymers include xanthan gum and guar gum. In some embodiments, polymers may be crosslinked in situ in the hydrocarbon containing formation. In other embodiments, polymers may be generated in situ in the hydrocarbon containing formation. Polymers and polymer preparations for use in oil recovery are described in U.S. Pat. No. 6,439,308 to Wang; U.S. Pat. No. 6,417,268 to Zhang et al.; U.S. Pat. No. 5,654,261 to Smith; U.S. Pat. No. 5,284,206 to Surles et al.; U.S. Pat. No. 5,199,490 to Surles et al.; and U.S. Pat. No. 5,103,909 to Morgenthaler et al., each of which is incorporated by reference as if fully set forth herein.

In some embodiments, the solvation fluid includes one or more nonionic additives (for example, alcohols, ethoxylated alcohols, nonionic surfactants, and/or sugar based esters). In some embodiments, the solvation fluid includes one or more anionic surfactants (for example, sulfates, sulfonates, ethoxylated sulfates, and/or phosphates).

In some embodiments, the solvation fluid includes carbon disulfide. Hydrogen sulfide, in addition to other sulfur compounds produced from the formation, may be converted to carbon disulfide using known methods. Suitable methods may include oxidizing sulfur compounds to sulfur and/or sulfur dioxide, and reacting sulfur and/or sulfur dioxide with carbon and/or a carbon containing compound to form carbon disulfide. The conversion of the sulfur compounds to carbon disulfide and the use of the carbon disulfide for oil recovery are described in U.S. Pat. No. 7,426,959 to Wang et al., which is incorporated by reference as if fully set forth herein. The carbon disulfide may be introduced as a solvation fluid.

In some embodiments, the solvation fluid is a hydrocarbon compound that is capable of donating a hydrogen atom to the formation fluids. In some embodiments, the solvation fluid is capable of donating hydrogen to at least a portion of the formation fluid, thus forming a mixture of solvating fluid and dehydrogenated solvating fluid mixture. The solvating fluid/dehydrogenated solvating fluid mixture may enhance solvation and/or dissolution of a greater portion of the formation fluids as compared to the initial solvation fluid. Examples of such hydrogen donating solvating fluids include, but are not limited to, tetralin, alkyl substituted tetralin, tetrahydroquinoline, alkyl substituted hydroquinoline, 1,2-dihydronaphthalene, a distillate cut having at least 40% by weight naphthenic aromatic compounds, or mixtures thereof. In some embodiments, the hydrogen donating hydrocarbon compound is tetralin.

A non-restrictive example is set forth below.

Experimental

Examples of Subsurface Deasphalting.

Figure 13:
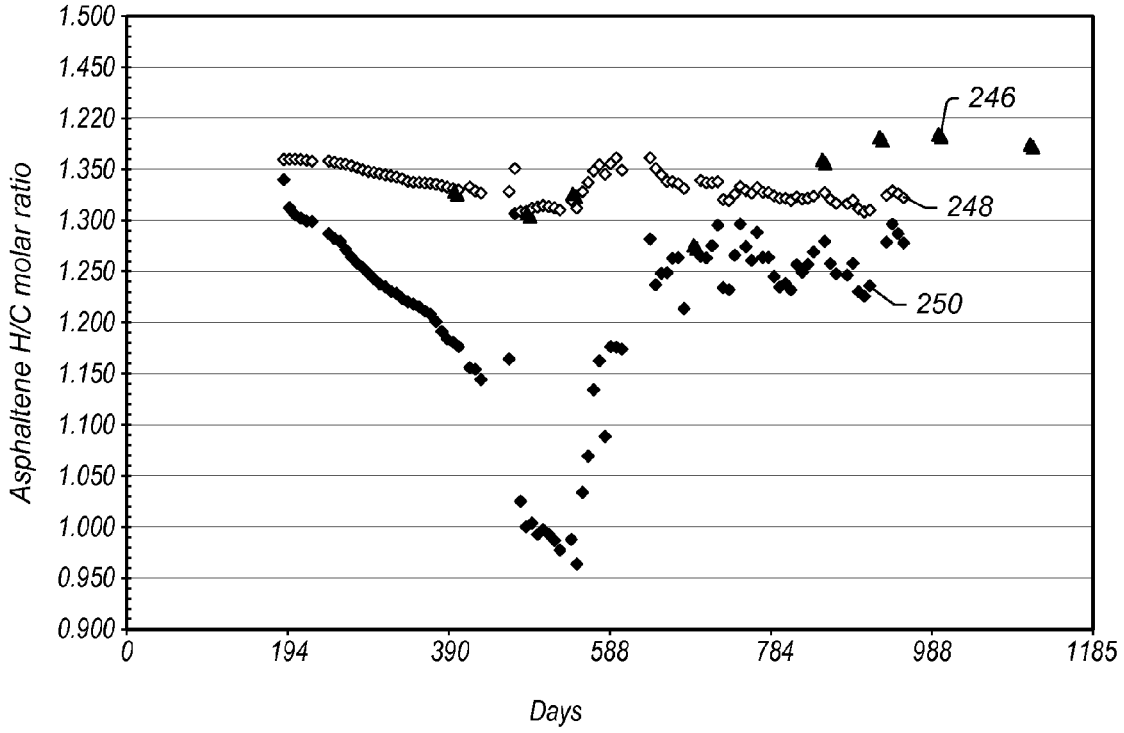
FIG. 13 is a graphical representation of asphaltene H/C molar ratios of hydrocarbons having a boiling point greater than 520° C. versus time (days).

STARS® simulations including a PVT/kinetic model were used to assess the subsurface deasphalting of formation fluid. FIG. 13 is a graphical representation of asphaltene H/C molar ratios of hydrocarbons having a boiling point greater than 520° C. versus time (days). Data 246 represents predicted asphaltene H/C molar ratios for hydrocarbons having a boiling point greater than 520° C. obtained from a formation heated by an in situ heat treatment process. As shown from data 246, the asphaltene H/C molar ratios of hydrocarbons having a boiling point greater than 520° C. changes over time. Specifically, it is predicted that the asphaltene H/C molar ratio falls below 1 after heating for a period of time. Data 248 represents predicted asphaltene H/C molar ratios for hydrocarbons having a boiling point greater than 520° C. of hydrocarbons during treatment of the formation using an in situ heat treatment process under deasphalting conditions as described by the equation:

$$SR(\mathrm{H/C})\text{“deasphalted”} = SR(\mathrm{H/C})_{from\ STARS@SC} + .22 * \left[\frac{vol(\text{naphtha/kerosene})_{in\ liquid\ phase}}{vol\ SR}\right]_{from\ STARS@RC} \quad \text{EQN. 1}$$

where SR is hydrocarbons having a boiling point greater than 520° C., SC surface conditions and RC is reservoir conditions.

Data 250 represents measured asphaltene H/C molar ratios for hydrocarbons having a boiling point greater than 520° C. after treating of the formation using an in situ heat treatment process and subsurface deasphalting conditions. As shown in FIG. 13, the asphaltene content of hydrocarbon in the formation may be adjusted to maintain an asphaltene H/C molar ratio above 1 by varying the volume of naphtha/kerosene and/or volume of hydrocarbons having a boiling point greater than 520° C.

Subsurface Deasphalting Phased Heating.

Figure 14:
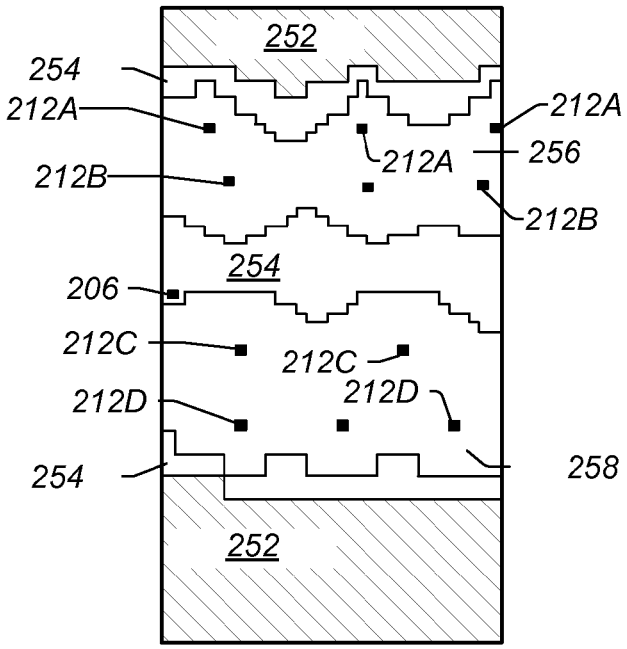
FIG. 14 depicts a representation of the heater pattern and temperatures of various sections of the formation for phased heating.
Figure 15:
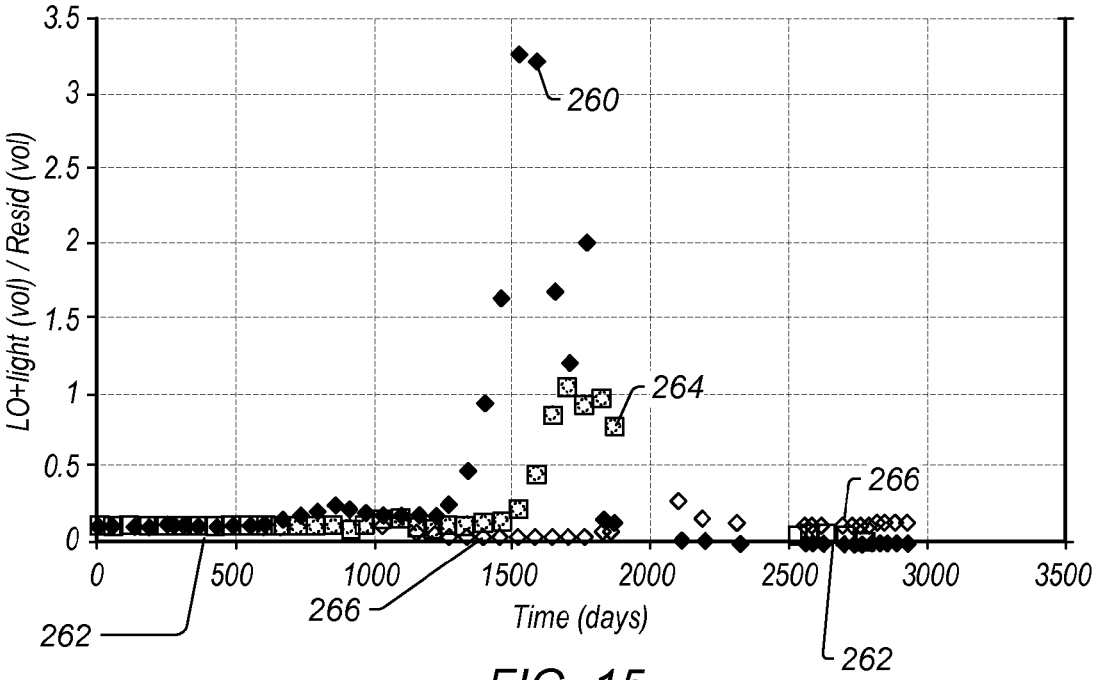
FIG. 15 is a graphical representation of time of heating versus volume ratio of naphtha/kerosene to heavy hydrocarbons.

A symmetry element model was used to simulate the response of a typical intermediate pattern in a hydrocarbon formation (Grosmont). The model was built on a P50 Horizontal Highway subsurface realization, honoring hydrology and capturing most probable water mobility scenario. FIG. 14 depicts a representation of the heater pattern and temperatures of various sections of the formation for phased heating. Heaters 212A were turned on for 275 days, heaters 212B were turned on for 40 days, heaters 212C were off, and heaters 212D were turned on for 2 days. Sections 252 had the lowest temperature as compared to the other sections. Sections 254 had a temperature greater than sections 252. Sections 256 and 258 had temperatures greater than sections 252 and 254. FIG. 15 depicts time of heating versus the volume ratio of naphtha/kerosene to heavy hydrocarbons. Data 260 represent the volume of liquid hydrocarbons near production well 206, data 262 represent the volume of liquid hydrocarbons near heaters 212A in section 256, data 264 represent the volume of liquid hydrocarbons near heaters 212C in section 258, and data 266 represent the volume of liquid hydrocarbons between heaters 212B and 212C in section 254. As shown in FIG. 15, the volume ratio of naphtha/kerosene to heavy hydrocarbons in all layers was about the same until about 1500 days. The volume ratio of naphtha/kerosene to heavy hydrocarbons near production well 206 increased after about 1300 days. After about 1500 days, the volume ratio of naphtha/kerosene to heavy hydrocarbons increased near production well 206 and for the section 260, while the volume ratio of naphtha/kerosene to heavy hydrocarbons in section 258 and the section between heaters 212B and 212C in section 254 remained relatively constant. Since the volume ratio of naphtha/kerosene to heavy hydrocarbons increased in section 260, an increase in in situ deasphalting in the section as compared to sections above section 260 was predicted. As such, hydrocarbons produced from production well 206 positioned above section 260 would contain hydrocarbons that have chemical and physical stability (for example, the produced hydrocarbons would be predicted to have a P-value of greater than 1).

Comparative Example Subsurface Simultaneous Heating.

Figure 16:
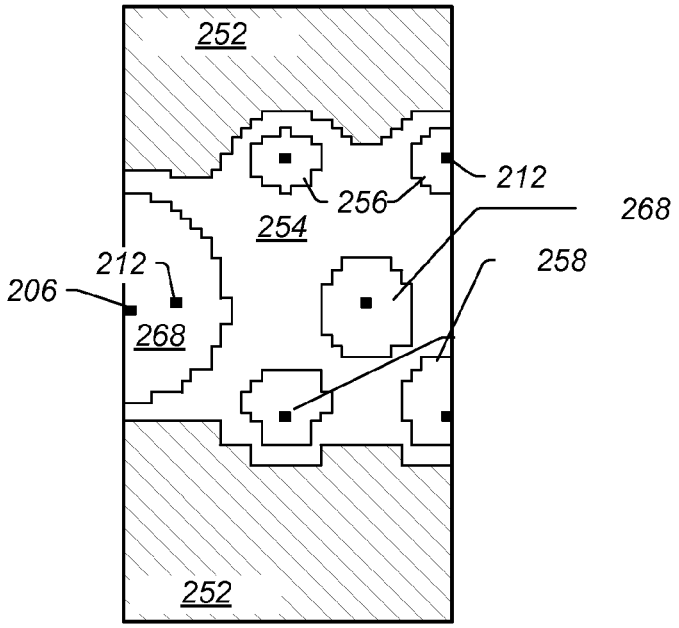
FIG. 16 depicts a representation of the heater pattern and temperatures of various sections of the formation.
Figure 17:
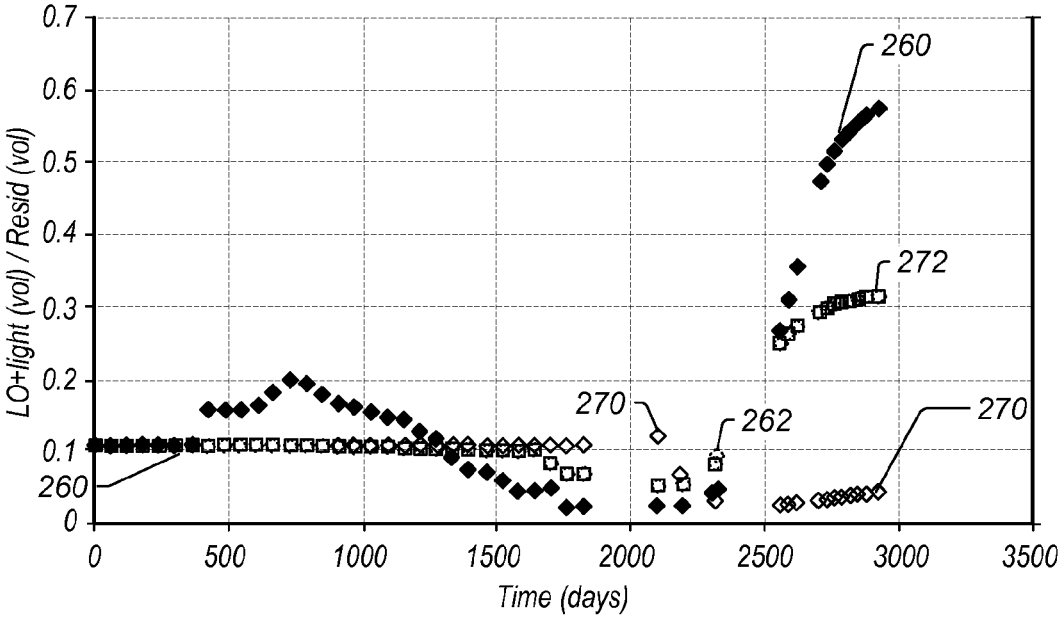
FIG. 17 is a graphical representation of time of heating versus volume ratio of naphtha/kerosene to heavy hydrocarbons.

A symmetry element model was used to simulate the response of a typical intermediate pattern in a hydrocarbon formation (Grosmont). The model was built on a P50 Horizontal Highway subsurface realization, honoring hydrology and capturing most probable water mobility scenario. FIG. 16 depicts a representation of the heater pattern and temperatures of various sections of the formation. Heaters 212 were turned on at the same time. Sections 256, 258, and 268 had temperatures that are greater than sections 254 and section 252. Section 254 had a temperature greater than section 252. FIG. 17 depicts time of heating versus the volume ratio of naphtha/kerosene to heavy hydrocarbons. Data 260 represent the volume ratio of naphtha/kerosene to heavy hydrocarbons near production well 206, data 262 represent the volume ratio of naphtha/kerosene to heavy hydrocarbons in sections 268, data 270 represent the volume ratio of naphtha/kerosene to heavy hydrocarbons in sections 256, data 272 represent the volume ratio of naphtha/kerosene to heavy hydrocarbons in sections 258. As shown in FIG. 17, the volume ratio of naphtha/kerosene to heavy hydrocarbons was about the same for all layers during the heating period. As such, in situ deasphalting may occur in all layers, and hydrocarbons produced from these sections would exhibit poor chemical and physical stability (for example, the produced hydrocarbons would be predicted to have a P-value of less than 1).

It is to be understood the invention is not limited to particular systems described which may, of course, vary. It is also to be understood that the terminology used herein is for the purpose of describing particular embodiments only, and is not intended to be limiting. As used in this specification, the singular forms "a", "an" and "the" include plural referents unless the content clearly indicates otherwise. Thus, for example, reference to "a core" includes a combination of two or more cores and reference to "a material" includes mixtures of materials.

In this patent, certain U.S. patents, U.S. patent applications, and other materials (for example, articles) have been incorporated by reference. The text of such U.S. patents, U.S. patent applications, and other materials is, however, only incorporated by reference to the extent that no conflict exists between such text and the other statements and drawings set forth herein. In the event of such conflict, then any such conflicting text in such incorporated by reference U.S. patents, U.S. patent applications, and other materials is specifically not incorporated by reference in this patent.

Further modifications and alternative embodiments of various aspects of the invention may be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims. In addition, it is to be understood that features described herein independently may, in certain embodiments, be combined.

What is claimed is:

1. A method of treating a hydrocarbon containing formation, comprising:

providing heat from a first set of heaters to a first layer of the hydrocarbon containing formation;

controlling the heat from the first set of heaters such that an average temperature in at least a majority of the first layer is above a pyrolyzation temperature;

providing heat from a second set of heaters to a second layer of the hydrocarbon formation substantially above the first layer of the hydrocarbon formation after providing heat from the first set of heaters to the first layer for a selected time;

controlling the heat from the second set of heaters such that an average temperature in the second layer is sufficient to allow a portion of the formation in the second layer to thermally expand into the first layer of the hydrocarbon formation;

controlling the heat from the second set of heaters such that at least part of the portion of the formation that thermally expanded into the first layer expands back towards the surface of the formation; and producing hydrocarbons from the formation.

2. The method of claim 1, wherein a depth of the first layer is about 400 m to about 750 m from the surface of the formation.

3. The method of claim 1, wherein a depth of the second layer is about 150 m to about 400 m from the surface of the formation.

4. The method of claim 1, wherein an initial porosity of the first layer is different than an initial porosity of the second layer.

5. The method of claim 1, wherein heat from the first set of heaters heats the first layer to a temperature of about 230° C.

6. The method of claim 1, wherein the selected time ranges from about nine months to about twenty-four months.

7. The method of claim 1, wherein heat from the second set of heaters heats the section layer to a temperature above a pyrolyzation temperature.

8. The method of claim 1, wherein heat from the second set of heaters heats the second layer to a temperature of from about 200° C. to about 370° C.

9. The method of claim 1, wherein heat from the first set of heaters mobilizes hydrocarbons in the first layer.

10. The method of claim 1, wherein the produced hydrocarbons comprise pyrolyzed hydrocarbon from the second layer.

11. The method of claim 1, wherein hydrocarbons are produced from the first layer.

12. The method of claim 1, wherein hydrocarbons are produced from the first layer and the hydrocarbons comprise pyrolyzed hydrocarbons from the second layer.

13. The method of claim 1, wherein thermal expansion of materials in the second layer into the first layer inhibits fracturing of an overburden of the formation.

14. The method of claim 1, wherein controlling heat from the first set of heaters heats the first layer to a pyrolysis temperature after at least some materials in the second layer have thermally expanded into the first layer.

15. A method of treating a hydrocarbon containing formation in situ, comprising:

providing heat from a first set of heaters to a section of the hydrocarbon containing formation;

allowing heat from the first set of heaters to transfer to a first layer of the section such that at least a majority of the first layer at a depth of about 400 m below a surface of the formation is heated to a pyrolyzation temperature;

providing heat from a second set of heaters to the section of the hydrocarbon containing formation;

allowing heat from the second set of heaters to transfer to a second layer of the section after allowing heat from the first set of heaters to transfer to the first layer for a selected time, wherein the second layer is at a depth of about 150 m from the surface of the formation and substantially above the first layer, and wherein heating of the second layer is at a heating rate sufficient to allow at least part of the formation in the second layer to thermally expand into the first layer of the hydrocarbon formation;

continuing heating of the second layer from the second set of heaters until at least some of the formation that has thermally expanded into the first layer expands back towards the surface of the formation to inhibit fracturing of the overburden above the second layer of the formation; and producing hydrocarbons from the formation.

16. The method of claim 15, wherein a pyrolyzation temperature ranges from about 230° C. to about 370° C.

17. The method of claim 15, wherein the selected time ranges from about nine months to about twenty-four months.

18. The method of claim 15, wherein heat from the second set of heaters heats the second layer to a temperature above a pyrolyzation temperature.

19. The method of claim 15, wherein heat from the first set of heaters mobilizes hydrocarbons in the first layer and the hydrocarbons produced from the formation comprise mobilized hydrocarbon from the first layer.

20. The method of claim 15, wherein the produced hydrocarbons comprise pyrolyzed hydrocarbon from the second layer.

21. The method of claim 15, wherein hydrocarbons are produced from the first layer.

22. The method of claim 15, wherein hydrocarbons are produced from the first layer and the hydrocarbons comprise pyrolyzed hydrocarbons from the second layer.

* * * * *